US006445975B1

(12) United States Patent
Ramsey

(10) Patent No.: US 6,445,975 B1
(45) Date of Patent: Sep. 3, 2002

(54) CARRIER ROUTE OPTIMIZATION SYSTEM

(75) Inventor: Thomas E. Ramsey, Bowling Spring, SC (US)

(73) Assignee: R.R. Donnelly & Sons Company, Chicago, IL (US)

( * ) Notice: Subject to any disclaimer, the term of this patent is extended or adjusted under 35 U.S.C. 154(b) by 0 days.

(21) Appl. No.: 09/454,097

(22) Filed: Dec. 3, 1999

(51) Int. Cl.[7] ..... G06F 7/08

(52) U.S. Cl. ..... 700/226; 700/224; 209/583; 209/584; 270/52.02

(58) Field of Search ..... 209/583, 584; 700/225, 223, 226, 227, 224; 270/52.02

(56) References Cited

U.S. PATENT DOCUMENTS 3,899,165 A 8/1975 Abram et al.
4,121,818 A 10/1978 Riley et al.
4,395,031 A 7/1983 Gruber et al.
B14,121,818 A 6/1988 Riley et al.
4,789,147 A 12/1988 Berger et al.
5,042,667 A * 8/1991 Keough ..... 209/584 X
5,249,687 A * 10/1993 Rosenbaum et al. .... 209/584 X
5,287,976 A * 2/1994 Mayer et al. ..... 209/584 X
5,749,473 A * 5/1998 Yamashita et al. ..... 209/584
6,107,587 A * 8/2000 Itoh et al. ..... 209/584 X

* cited by examiner

*Primary Examiner*—Christopher P. Ellis
*Assistant Examiner*—Patrick Mackey
(74) *Attorney, Agent, or Firm*—Fitch, Even, Tabin & Flannery

(57) ABSTRACT

A method and system for collating and binding signatures includes a plurality of signature feeders responsive to a signature feed control signal. Coded data is stored on a magnetic disk. The coded data is representative of like groups of signatures and unlike groups of signatures. Apparatus transfers the coded data to a printer which prints related mailing information on the groups of like signatures.

14 Claims, 38 Drawing Sheets

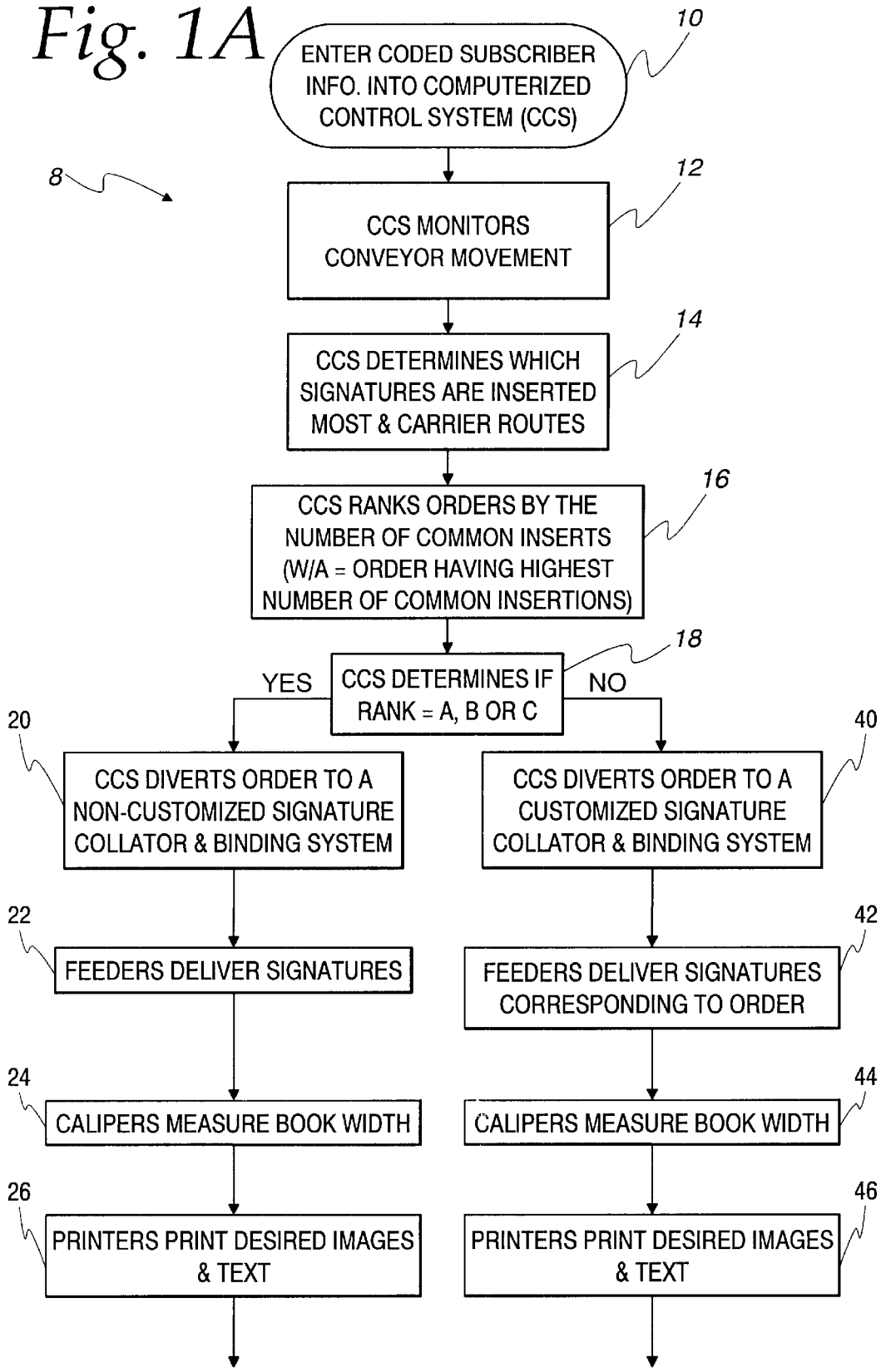
Fig. 1A
8
10
ENTER CODED SUBSCRIBER INFO. INTO COMPUTERIZED CONTROL SYSTEM (CCS)
12
CCS MONITORS CONVEYOR MOVEMENT
14
CCS DETERMINES WHICH SIGNATURES ARE INSERTED MOST & CARRIER ROUTES
16
CCS RANKS ORDERS BY THE NUMBER OF COMMON INSERTS (W/A = ORDER HAVING HIGHEST NUMBER OF COMMON INSERTIONS)
18
CCS DETERMINES IF RANK = A, B OR C
YES
NO
20
CCS DIVERTS ORDER TO A NON-CUSTOMIZED SIGNATURE COLLATOR & BINDING SYSTEM
40
CCS DIVERTS ORDER TO A CUSTOMIZED SIGNATURE COLLATOR & BINDING SYSTEM
22
FEEDERS DELIVER SIGNATURES
42
FEEDERS DELIVER SIGNATURES CORRESPONDING TO ORDER
24
CALIPERS MEASURE BOOK WIDTH
44
CALIPERS MEASURE BOOK WIDTH
26
PRINTERS PRINT DESIRED IMAGES & TEXT
46
PRINTERS PRINT DESIRED IMAGES & TEXT

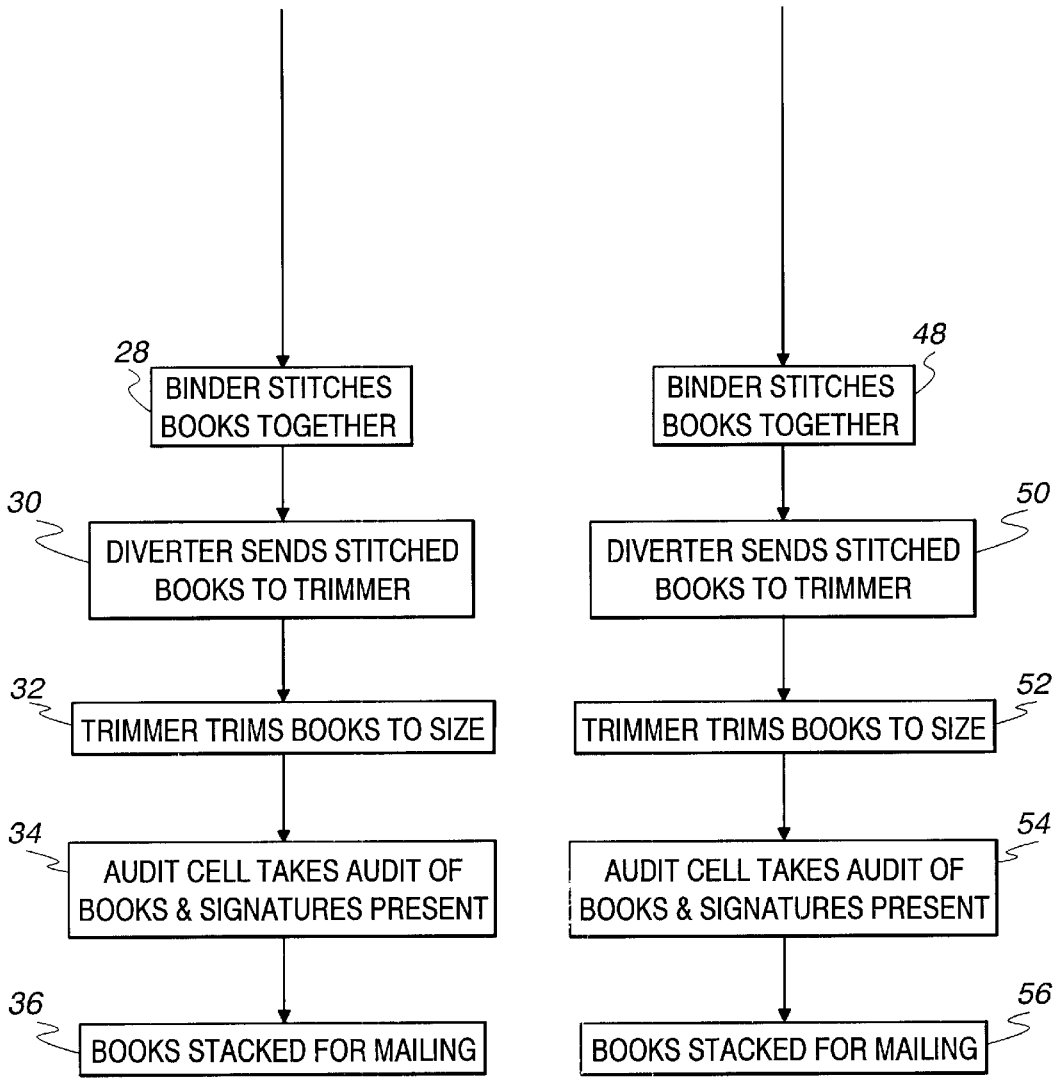
Fig. 1B
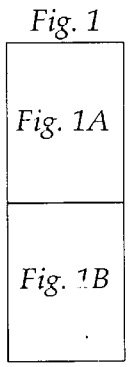

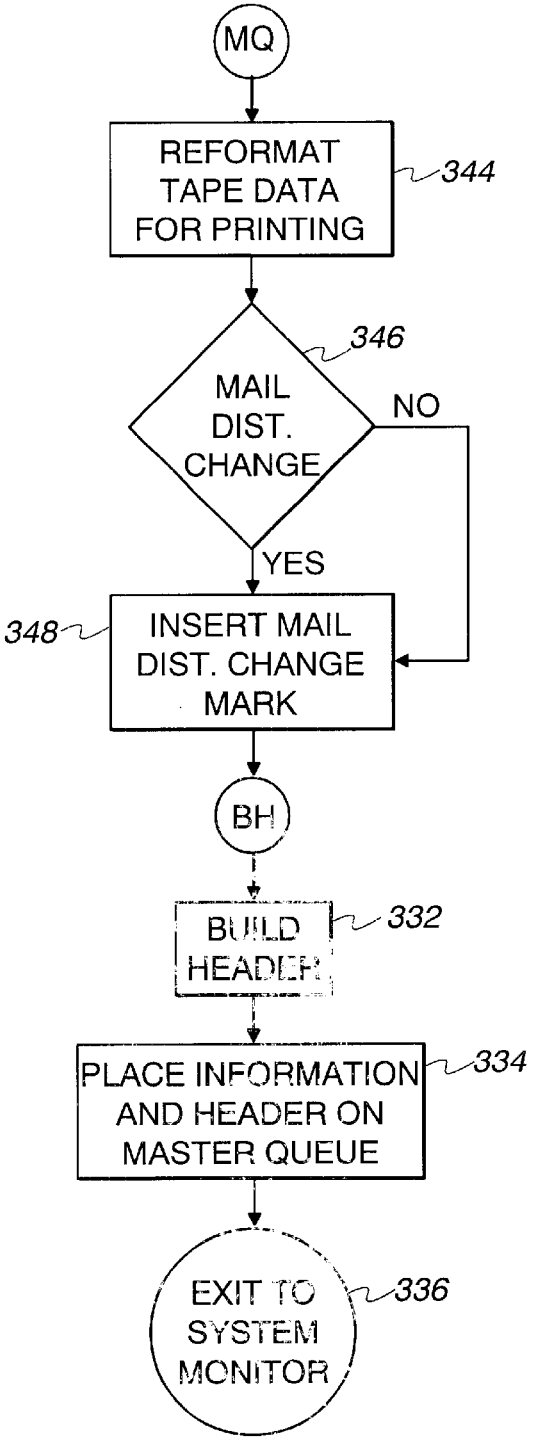
Fig. 19B
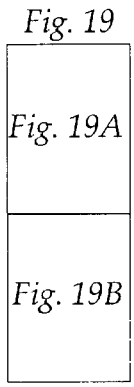

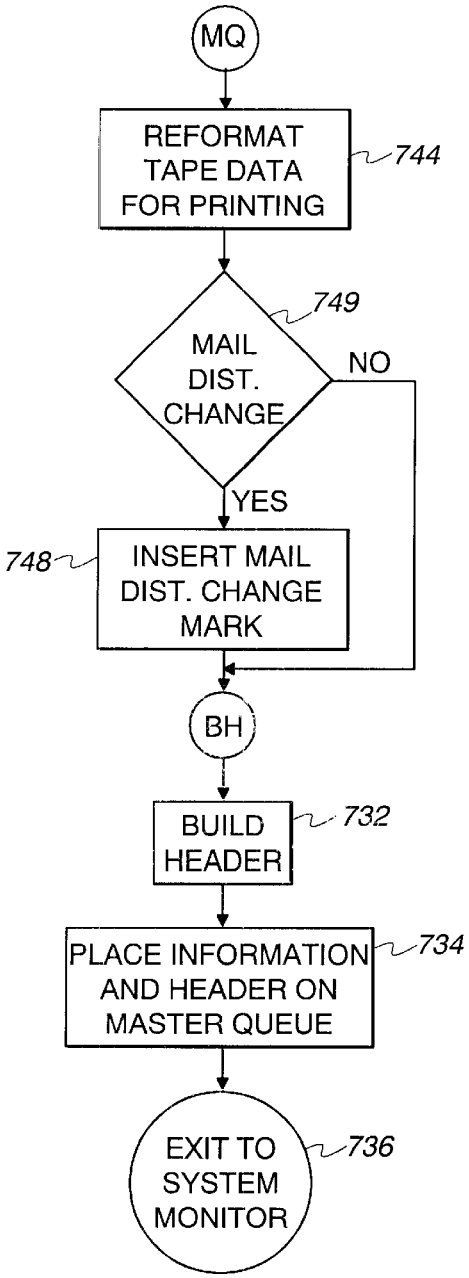
Fig. 42B
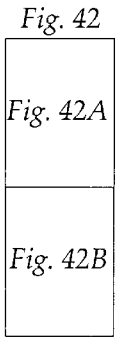

CARRIER ROUTE OPTIMIZATION SYSTEM

BACKGROUND OF THE INVENTION

The invention relates to a signature collating and binding system with selectively controllable signature feeders, printers, and other apparatus.

Selective actuation of signature feeders by coded subscriber information is a known procedure which allows a single collating and binding system to simultaneously build different versions of a book of signatures, such as different editions of a magazine. As is conventional, a book of signatures is any collection or group of signatures. Each signature is comprised of one or more sheets. The thicknesses of different books of signatures will vary depending on which feeders or inserters are actuated in response to the special interests of the subscribers. Examples of such systems are disclosed in Abram et al., U.S. Pat. No. 3,899,165, and Riley et al., U.S. Pat. No. 4,121,818.

Mailing labels are placed on each book of signatures and must correspond to the coded information which produced the customized books of signatures. In the past this has been accomplished by reading pre-printed labels to develop the coded information. Alternatively, the coded information was stored on magnetic tape which was read and later controlled a printer which printed the mailing information directly on the books of signatures.

Printers also have been associated with card inserters. The printers were located after the signature feeders and before the stitcher. This allowed custom information, such as renewal information on a loose card, to be printed before it is inserted in an already-constructed book of signatures. The card could be bound in by paste to prevent it being separated from its book of signatures.

While those systems were versatile for producing different editions of magazines or the like during a single production run, they could be improved. The contents of the different editions or variations are determined entirely by the signatures which are loaded in the signature feeders and selected. Since the number of signature feeders reaches a practical maximum, there is a limit to the number of signature permutations in concurrently run books of signatures. In order to provide customer flexibility many bindery lines now have thirty signature-gatherer boxes or more. Such bindery lines consume large amounts factory space. At the same time customers want even more capability and flexibility as to mixing and matching signatures.

When running such multi-version jobs many production bindery lines may use twenty out of twenty four signature-gatherer boxes rather consistently. Selections of signatures from the other four boxes are only made infrequently. This is because not many customers receive the versions which include one or more of these four other signatures. As a result, the contents of these four signature-gatherer boxes are accessed rarely, perhaps only once or twice during an eight-hour shift. The signature feeding mechanism of each of these boxes, however, runs all the time. Only the vacuum is left off. This results in rarely-selected signatures that are mechanically vibrated back and forth to the extent that when the vacuum is finally turned on to feed a signature, the signature is sometimes out of position and causes a jam and shutdown of the entire collating and binding line.

What is needed is a collating and binding system that satisfies the customers' requirements for running more versions of a single bindery production while maintaining postal discounts due to carrier route bundling and, at the same time, not to increase the length of the bindery lines.

Obviously, the cost of each additional signature-gatherer box used only once or twice in an eight-hour shift is exorbitant.

SUMMARY OF THE INVENTION

The present invention is embodied in a collating and binding system which can rapidly and efficiently produce customized books of signatures. The system includes a plurality of feeders for delivering signatures. A conveyor receives the signatures to build like groups of signatures. Coded dates of like groups of signatures and unlike groups is stored in a machine readable medium such as a tape or disk. A coded data transfer apparatus transfers a portion of the data and prints marking information on groups of like signatures in response thereto.

One of the objects of the present invention is to change the coded information on the magnetic tape supplied by the publisher in order to first strip out and create a new tape file for the greatest quantity version. Secondly, to maintain the carrier route bundling advantage. For example, version A contains 1.2 million insertion counts, version B contains 900,000, version C 700,000 and versions D through I decreasing amounts. Based on these amounts, the present invention will sort bundles on codes A, B and C in non-selective runs. The remaining versions D through I will continue in selective runs, however, they will obviously be shorter runs.

The results of such a reorganization of production and the obvious advantages are as follows:

(1) Reduction of the number of packer boxes;

(2) Shorter make-ready times;

(3) Increased machine speeds;

(4) Greatly reduced postal reorders;

(5) Lower wages;

(6) Fewer press lifts;

(7) Reduced spoilage requirements; and (8) Less equipment

In another example, customer A was to be 100% electronic. This method reduced the requirement to only 17% electronic and 83% non-electronic with a postal increase of only $300.00. Looking at this in another way, the 100% electronic translates to seven bindery lines with 10 packer boxes each. However, the 17% electronic requires only one machine with ten packer boxes. Meanwhile, the remaining 83% which is now non-electronic can be run on six machines with only five packer boxes each. The result here is an overall binding day reduction of twenty days and a postal charge increase of only $300.00. Otherwise, the product going to the addresses has not changed at all and the changes in the method of creating the individual versions are totally transparent to the customer.

BRIEF DESCRIPTION OF THE DRAWINGS

FIG. 1 is a flow diagram for a signature collating and binding system embodying the present invention;

FIGS. 19A–B are logic flow diagrams for the master queue program task;

FIGS. 42A–B are logic flow diagrams for the master queue program task;

DETAILED DESCRIPTION OF THE PREFERRED EMBODIMENT

Figure 2:
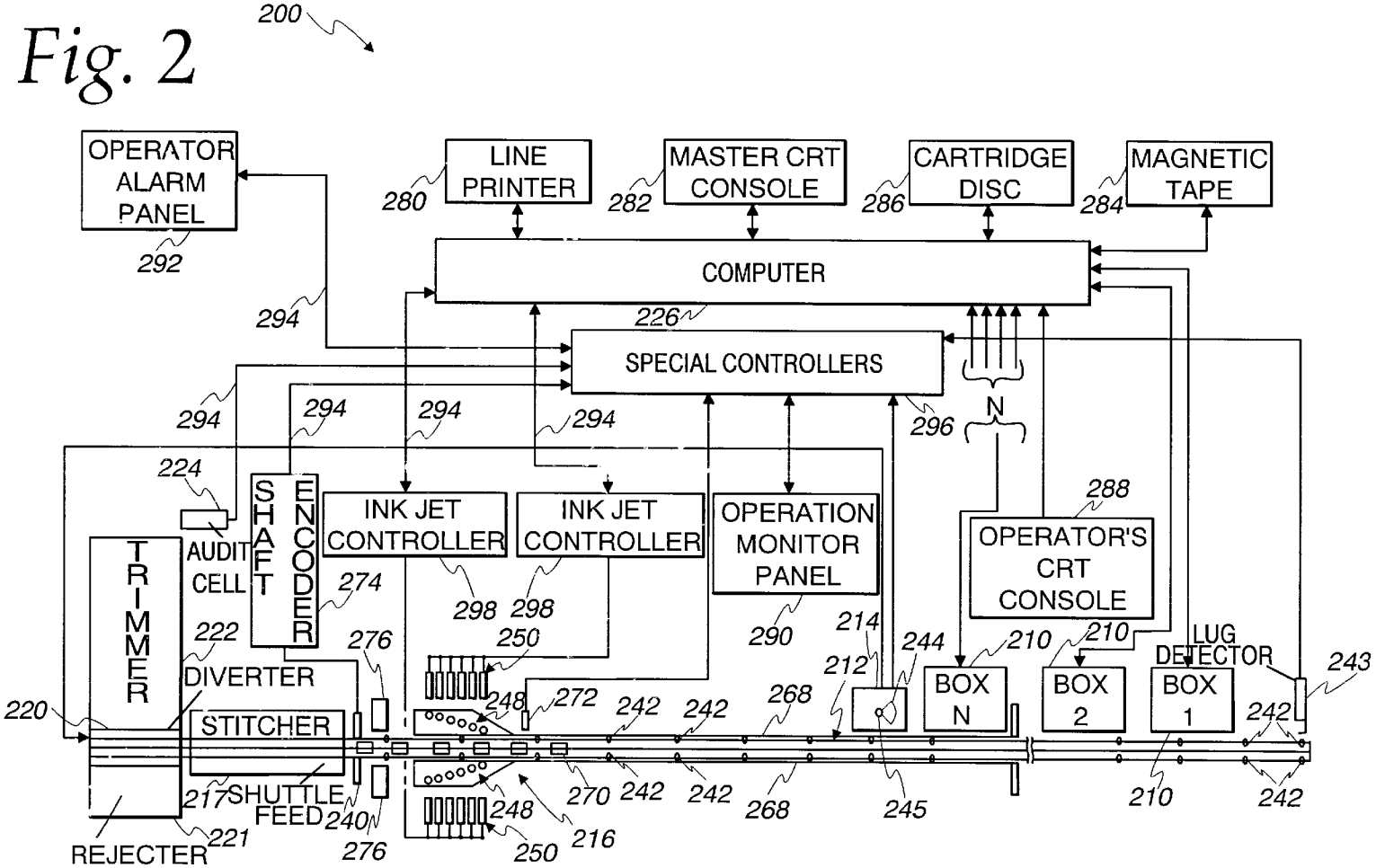
FIG. 2 is a block diagram of the selective signature collating and binding system of FIG. 1.

Referring now to the drawings and especially to FIG. 1, a system embodying the present invention is shown therein and referred generally to by reference numeral 8. The system 8 includes a signature collating and binding system can rapidly and efficiently produce customized books of signatures. During the initial stages of operation, the coded subscriber information pertaining to the signatures about to be produced is entered into the computerized control system (CCS) 10 of the signature collating and binding system. The CCS 10 also monitors conveyor movement 12 to track the position of signatures, or books of signatures, as they travel through the signature collating and binding system. After the coded subscriber information is entered, the CCS determines which signatures are inserted most often and what carrier routes apply to each 14. The CCS ranks the orders by the number of common inserts 16, (with A=the order having the highest number of common inserts). Next, the CCS determines whether the current order is ranked A, B, or C 18. If the current order is A, B or C, the CCS diverts the order to a non-customized signature collator and binding system 20. Once this step has been accomplished, feeders deliver signatures to the conveyer 22. Calipers measure the size of the collection of signatures, or books, 24 to determine if the correct number of signatures have been collected. Then, the books are sent to the printing stations 26 via the conveyer, where the desired text and/or images are printed. The conveyer carries the printed books of signatures to a binding station 28 where the books are then stitched. A diverter 30 sends the stitched books to a trimming station 32, where they are trimmed to the appropriate size. Next, an audit cell 34 takes an audit of the books and signatures present to determine if any need to be sent back for further processing, or if any simply should be rejected. Lastly, the collated and bound books are stacked for mailing 36.

If the current order is not A, B or C, the CCS diverts the order to a customized signature collator and binding system 40. Once this step has been accomplished, feeders deliver signatures corresponding to the order to the conveyer 42. Calipers 44 measure the size of the collection of signatures, or books, to determine if the correct number of signatures have been collected. Then, the books are sent to the printing stations 46 via the conveyer, where the desired text and/or images are printed. The conveyer carries the printed books of signatures to a binding station 48 where the books are then stitched. A diverter 50 sends the stitched books to a trimming station 52, where they are trimmed to the appropriate size. Next, an audit cell 54 takes an audit of the books and signatures present to determine if any need to be sent back for further processing, or if any simply should be rejected. Lastly, the collated and bound books are stacked for mailing 56.

Referring now to FIG. 2, system 8 includes a system 200 for collating and binding signatures. The system 200 includes a plurality of feeders 210 at longitudinally spaced stations adjacent collating conveyor chain 212 for delivering signatures 230 to the conveyor chain 212 in superpositioned relationship so as to progressively build up books or collections of signatures 229 as illustrated prospectively in FIG. 3. The conveyor chain 212 conveys the books of signatures 229 past a caliper 214 which measures the thickness of the books of signatures 229 to determine if any of the books of signatures 229 has an improper number of signatures 230 or book pages 231, 233. The books of signatures 229 are next conveyed from the caliper 214 to a printing station 216. At the printing station 216, information is printed on the pages 231, 233 desired, such as customized information on inside pages 233 of the books of signatures 229.

The conveyor chain 212 conveys the books of signatures 229 to a stitcher 218 which stitches the books of signatures 229. From the stitcher 218, the books of signatures 229 are moved to a diverter 220 which transfers books of signatures 229 which are found to be of the proper size and otherwise in good condition are transferred by the diverter 220 to the trimmer 222 which trims the books of signatures 229. After trimming process an audit cell 224 monitors all of the completed books of signatures 229 to check any missing books of signatures 229.

The functions of the signature printing system 200 are monitored and controlled by a computerized control system. The computerized control system will include a suitable programmable general purpose digital computer 226 and its associated peripherals and sensors which are described in more detail hereinafter.

More particularly, the feeders 210 utilized in the present invention are well-known in the prior art, and may be any suitable mechanism for delivering signatures 230 onto the conveyor chain 212. Feeders 210 deliver one signature 230 at a time to locations on the convertor chain 212 such that a plurality of feeders 210 mounted tandemly at longitudinally spaced stations adjacent the conveyor chain 212, diagrammatically illustrated in FIG. 2 as Boxes 1 through N, are capable of progressively building up books or collections of signatures 229 on the conveyor chain 212. This is shown perspectively in FIG. 3 where signatures 230 are being delivered onto a conveyor chain 212 so as to progressively build up books of signatures 229.

Figure 3:
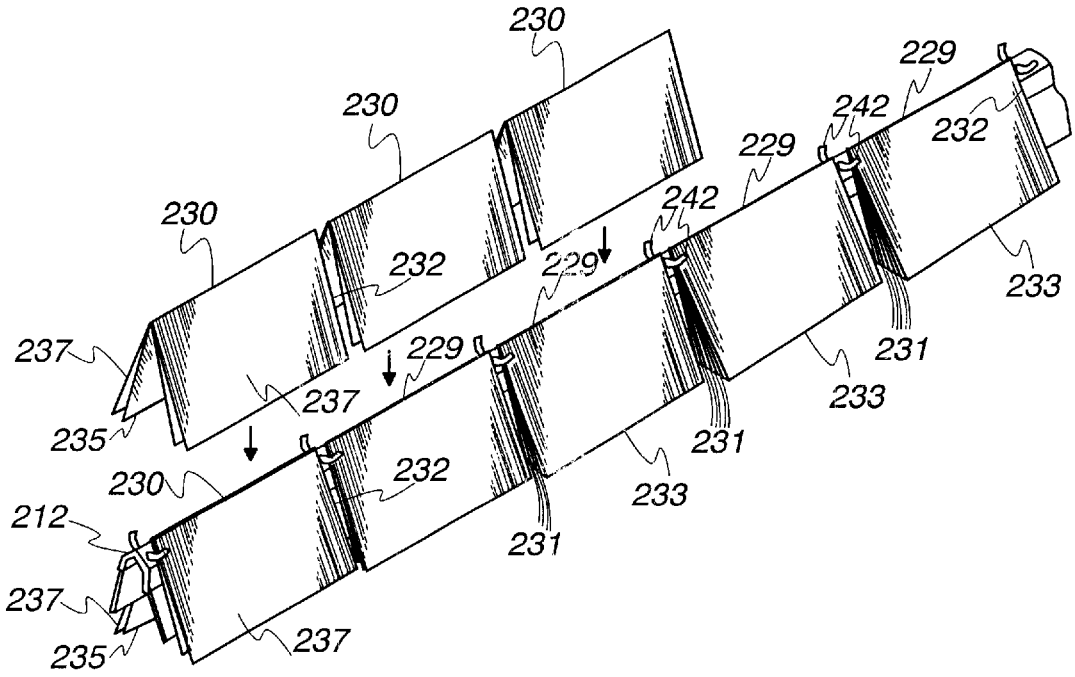
FIG. 3 is a perspective view of a plurality of signatures being progressively delivered on top of each other to form collections or books of signatures on the conveyor chain.
Figure 4:
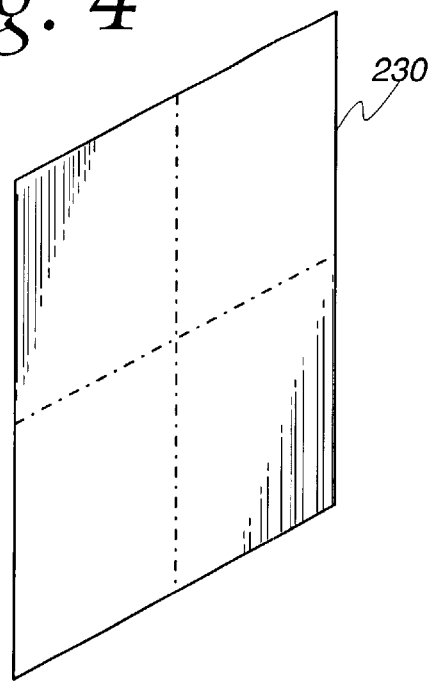
FIG. 4 is a perspective view of an unfolded signature having eight pages.
Figure 5:
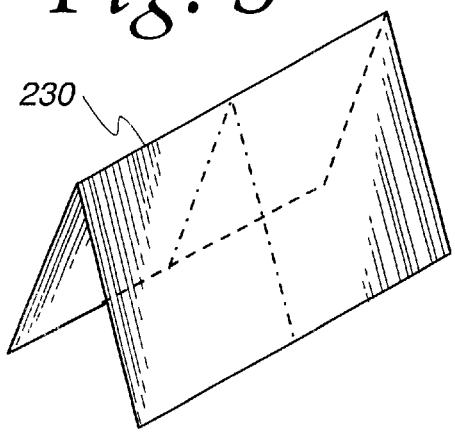
FIG. 5 is a perspective view of the signature illustrated in FIG. 4 after one fold.
Figure 6:
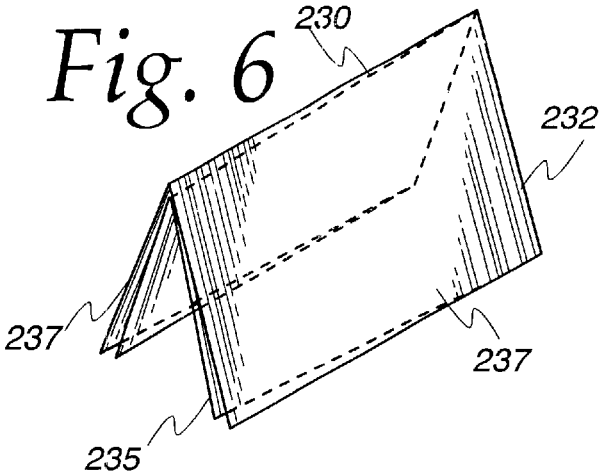
FIG. 6 is a perspective view of the signature illustrated in FIG. 5 after two folds.

FIGS. 4, 5 and 6 show a sequence for formation of a signature 230 having two centerfold pages 235 and two outside pages 237 for a total of eight pages. One must realize, of course, that a signature can have any number of pages, with a typical number being thirty-two pages. As illustrated in FIG. 3, the two outside pages 237 of the signature last delivered onto the conveyor chain 212 may form the cover pages 233 of the book of signatures 229. The remainder of the signature pages will be inside pages 231 of the book of signatures 229.

Figure 7:
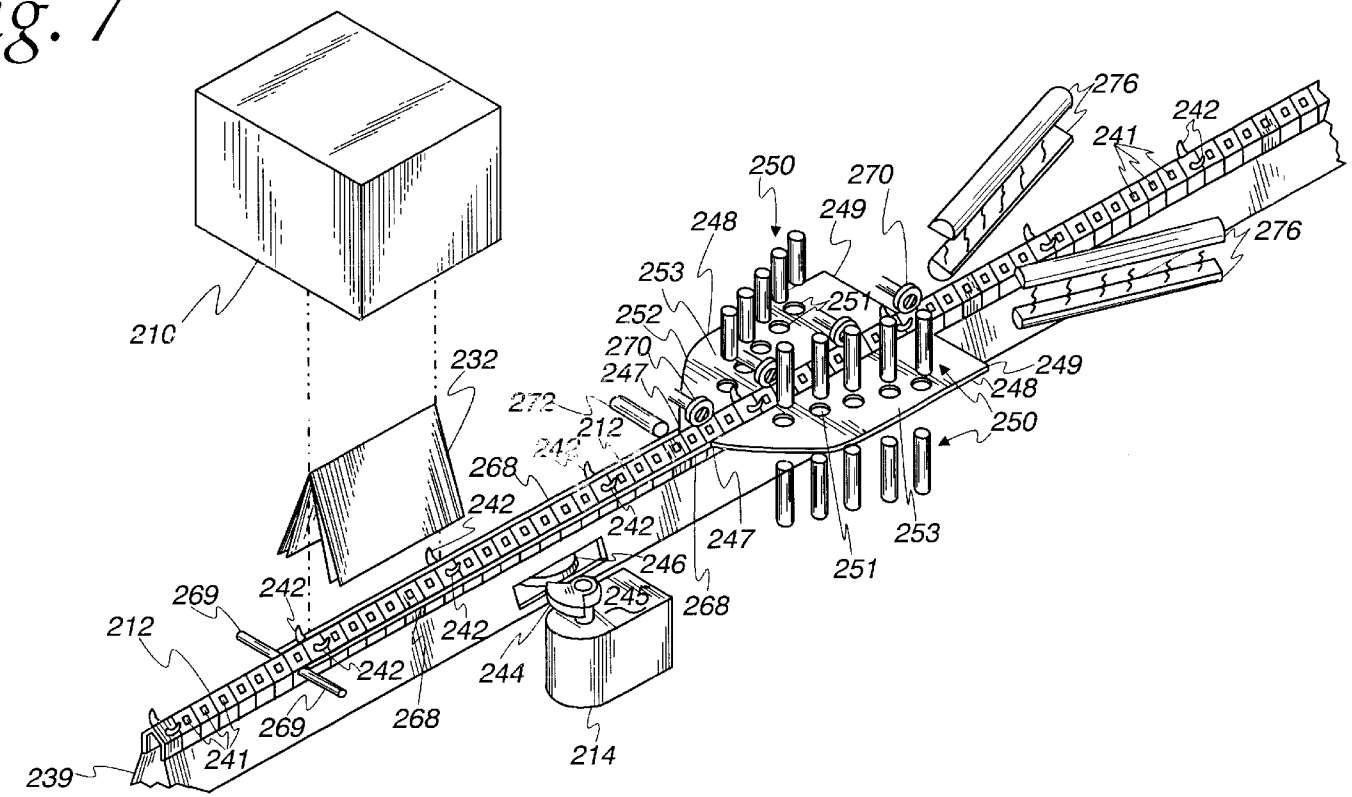
FIG. 7 is a fragmentary perspective view of a side-by-side mounting of plate-like members and adjacent portions of a signature printing system.
Figure 8:
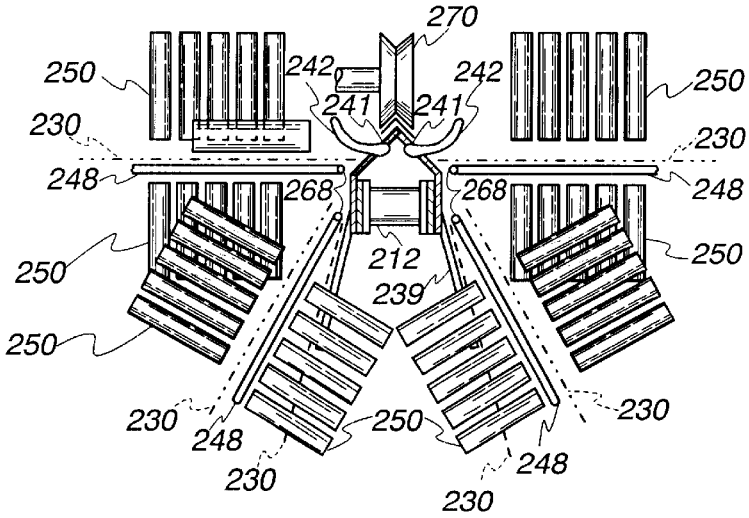
FIG. 8 is a sectional view of a fan mounted plate-like member having the printing platen portions extended to allow space for the printer heads.

The conveyor chain 212 of the present invention may be a sprocket chain conveyor of the type well known to the prior art. The conveyor chain 212 as illustrated in FIG. 7 normally has a skirt-like member 239 projecting downward therefrom. The conveyor chain 212 is driven by a conventional chain sprocket drive shaft 240 diagrammatically shown in the system block diagram of FIG. 2. As illustrated in FIG. 7, the conveyor chain 212 contains several lugs 242 attached thereto. At equally spaced locations along the conveyor chain 212, pairs of lugs 242 are removably mounted in apertures 241 in the conveyor chain 212 as illustrated in FIG. 8. The lugs 242 project above the conveyor chain 212 thereby preventing the signatures 230 from slipping on the conveyor chain 212 as they are moved along. The pairs of lugs 242 are equally spaced from one another, such that every two pairs of lugs 242 define a location on the conveyor chain 212 where the signatures 230 are to be progressively delivered so as to build books or collections of signatures 229. While the lugs 242 are equally spaced for a given run, the spacing between lugs 242 will be adjusted between runs depending on the size of the books of signatures 229 to be printed by removing the lugs 242 from apertures 241 and inserting the lugs 242 in apertures 241 spaced a desirable distance apart.

The movement of the conveyor chain 212 is monitored by a lug detector 243 (FIG. 2) mounted adjacent the conveyor chain 212. The lug detector 243 may be any suitable photocell which sends an interrupt to the computerized control system when a lug 242 is detected. The lugs 242 and lug detector 243 enable the computerized control system to monitor where the various books of signatures 229 are located during the printing process at any give time by keeping track of the conveyor chain 212 movement. It should be understood that several separate chains and associated sprocket drive shafts may be provided throughout the entire system, so as to effectively form a continuous conveyor chain 212.

As is illustrated in FIG. 7, the caliper 214 is mounted adjacent to the conveyor chain 212 upstream of the printing station 216 (FIG. 2) and is utilized to detect books of signatures 229 which have an improper umber of signatures 230 or pages 231, 233 (FIG. 3). The caliper 214 may be any suitable caliper utilized by the printing industry. The thickness of the books of signatures 229 is measured as the books of signatures 229 pass between a probe 244 of the caliper and a reference base 246. If the measured thickness of the books of signatures 229 is found to be unacceptable or out of tolerance an interrupt is sent to the computerized control system. The probe 244 of the caliper 214 is normally rotatably mounted about a shaft 245, the rotation of the caliper probe 244 being synchronized with the movement of signatures 230 along the conveyor chain 212. In FIG. 7 the skirt 239 is shown cut away between the reference base 246 and probe 244 to enable the measurements to be made.

Figure 9:
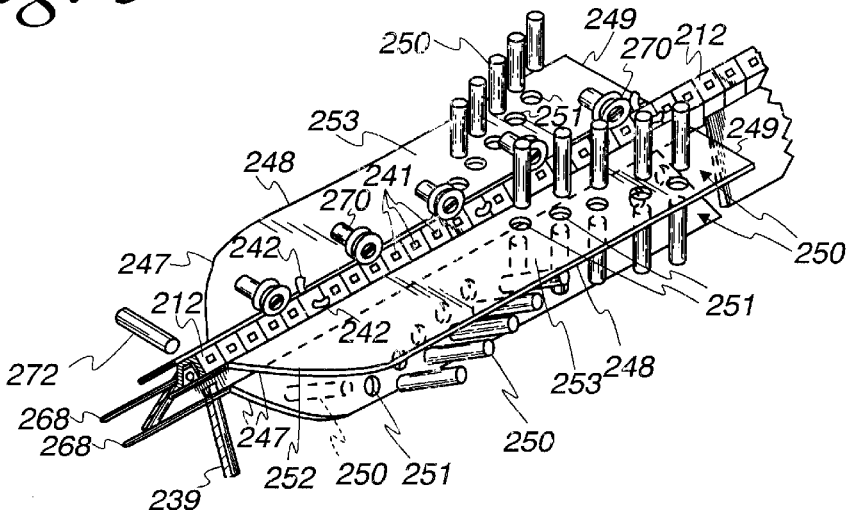
FIG. 9 is a perspective view of a fan mounted plate-like member having the printing platen portions extended to allow space for the printer heads.

As shown in FIGS. 7 and 9, the printing station 216 located downstream of the feeders 210 and caliper 214 includes printer heads 250 mounted adjacent relatively flat plate-like members 248, each of which is attached to a wire 268 extending upstream adjacent the conveyor chain 222. Each plate-like member 248 is mounted adjacent the conveyor chain 212 and lies generally in a plane extending radially from a line defined by the path of the conveyor chain 212. Each plate-like member 248 has an upstream end 247 and a downstream end 249 and has a generally rectangular shape, although any suitable shape will do. The upstream end 247 is tapered in toward the conveyor chain 212 to form a plow portion 252. The plow portion 252 extends outward from the conveyor chain 212 to form a printing platen 253. It should be noted that although multiple plate-like members 248 are shown in FIGS. 7 and 9 being mounted adjacent the conveyor chain 212, the printing station 216 may have a single plate-like member 248 with associated printer heads 250.

As is illustrated in FIGS. 7 and 9, each plate-like member 248 has the wire 268 connected to an edge of the plow portion 252 adjacent the conveyor chain 212 at the upstream end 247 of the plate-like member 248. It should be understood that any elongated member can be used in place of the wire 268. The wire 268 extends generally parallel to and adjacent the conveyor chain 212 upstream from the plate-like member 248 to a location just beyond but adjacent one of the feeders 210 feeding the signatures 230, such that the signatures 230 delivered therefrom and from feeders downstream therefrom are delivered onto the conveyor chain 212 over the wire 268. The wire 268 is attached at its upstream end to a retaining structure 269 which retains the wire in place. Note that in FIG. 8 wire 268 is shown slightly removed from the conveyor chain 212, thereby forming a space between the wire 268 will be conveyed by the conveyor chain 212 under the wire 268. Those signatures 230 delivered onto the conveyor chain 212 upstream of the wire 268 and the conveyor chain 212, so those signatures 230 delivered onto the conveyor chain 212 downstream of the wire 268 will be conveyed over the wire 268. Therefore, as the books of signatures 229 are progressively built up, some of the pages 231, 233 will be positioned over the wire 268. In this fashion, the wire 268 is able to select the signatures 230 where the books of signatures 229 are to be opened by the plate-like member 248. In the case where there are a plurality of plate-like members 248, each having a wire 268 attached, each wire 268 may extend upstream adjacent the conveyor chain 212 to differing locations adjacent the feeders 210 such that different signatures 230 are selected by the wires 268 from a plurality of feeders 210.

When the books of signatures 229 which include signatures 230 delivered over the wire 268, are conveyed past plate-like member 248, the plate like-member 248 cooperates with the conveyor chain 212 and wire 268 to move a page of the selected signature out of superpositioned relationship with a signature delivered to the conveyor just prior to the delivery of the selected signature and thereby open the books of signatures 229 at the signature 230 selected for opening by the wire 268 to expose an inside page of the book of signatures. The plow portion 252 lifts the pages 231, 233 of the books of signatures 229 delivered over the wire 268 onto the printing platen 253 while the pages 231, 233 of the books of signatures 229 not delivered over the wire 268 are left hanging substantially vertically from the conveyor chain 212, thereby forming two groups of pages 231, 233 located in planar positions arcuately spaced from each other and each extending approximately radially from a line defined by the path of travel of the conveyor chain 212 past the plate-like member 248. Note that those pages 231, 233 not over the wire 268 include those pages 231, 233 physically under the wire 268 between the wire 268 and the conveyor chain 212 and those pages hanging from the other side of the conveyor chain 212 as shown in FIG. 8. The pages 231, 233 lifted by the plow portion 252 are retained in a planar position which is roughly parallel to the plate-like member 248 and which extends generally radially from a line defined by the path of travel of the conveyor chain 212 as the conveyor chain moves the pages 231, 233 over the surface thereof. A plurality of the plate-like members 248 enable each book of signatures 229 to be opened at a plurality of selected signatures 230 as each book of signatures 229 is conveyed past the plate-like members 248.

The signatures 230 are retained on the conveyor chain 212 in their open condition by rollers 270, illustrated in FIGS. 7 and 9, mounted above the conveyor chain 212. The rollers 270 bias the binding of the books of signatures 229 downward against the conveyor chain 212 so as to offset any tendency the books of signatures 229 might have to be lifted upward from the conveyor chain 212.

Figure 10:
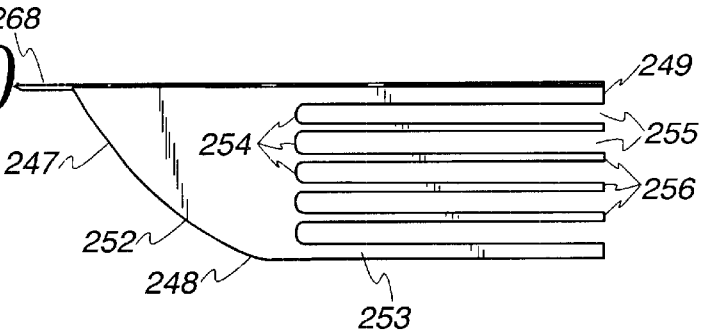
FIG. 10 is a plan view of a plate-like member having multiple elongated apertures.
Figure 11:
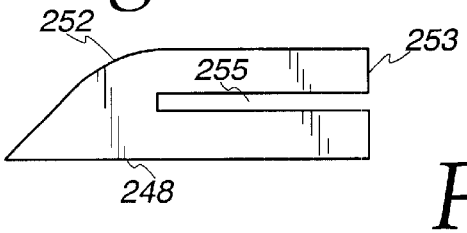
FIG. 11 is a plan view of a plate-like member having a single elongated aperture.
Figure 12A:
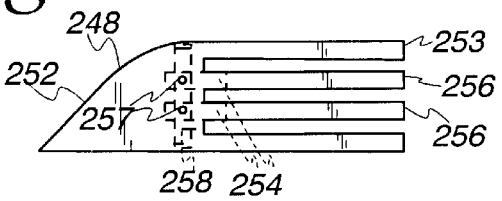
FIGS. 12A–D are varying views of a plate-like member having adjustable appendages.
Figure 12B:
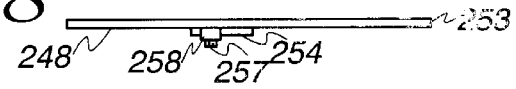
Figure 12C:
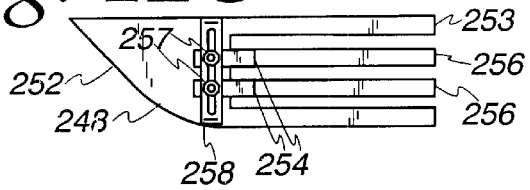
Figure 12D:
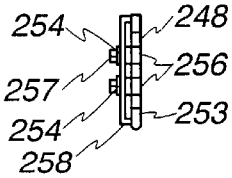

The printing platen 253 has apertures 251 therein to allow printing by the printer heads 250 mounted below the printing platen 253 on pages 231, 233 as they are moved over the surface of the printing platen 253. Although the apparatus 251 are shown as cylindrical openings in FIGS. 8 and 9, the apertures 251 may take on other various shapes and arrangements as is illustrated in FIGS. 10–12*d*. As is shown in FIG. 10, the apertures 251 frequently take the form of elongated apertures 255 formed by a plurality of elongated appendages or fingers 256 extending roughly parallel the conveyor chain 212 to the downstream end 249 of the printing platen 253. The apertures 255 are preferably open at the downstream end 249 so that the freshly printed ink is not smeared by the surface of the printing platen 253. While there are four fingers 256 shown in FIG. 10, there may be any number of fingers 256. As illustrated in FIG. 11, there is only one elongated aperture 255. As shown in FIGS. 12A–D, there are two adjustable fingers 256. The fingers 256 each may be made adjustable in any number of ways and in FIGS. 12A–D are shown as each being attached to the top surface of an elongated rectangular splice plate 254. The splice plates 254 are slidingly attached via bolts 257 to a slotted support member 258 attached to the bottom of the printing platen 253 such that the fingers 256 are adjustable radially from the conveyor chain 212.

The printing platen 253 with its apertures 251 allows printer heads 250 to be mounted below the printing platen 253 in alignment with the apertures 251 or 255 to enable printing on a centerfold page 235 of a selected signature 230 facing and immediately adjacent the printing platen 253 as the pages 231, 233 are conveyed by the conveyor over the plate-like member. In addition, the printer heads 250 can be mounted above the printing platen 253 so as to be capable of printing on the outside pages 237 of a signature 230. The plate-like member 248 thus enables the near simultaneous printing of two or more pages, such as the inside page 231 and the cover page 233, of a book of signatures 229.

Figure 13:
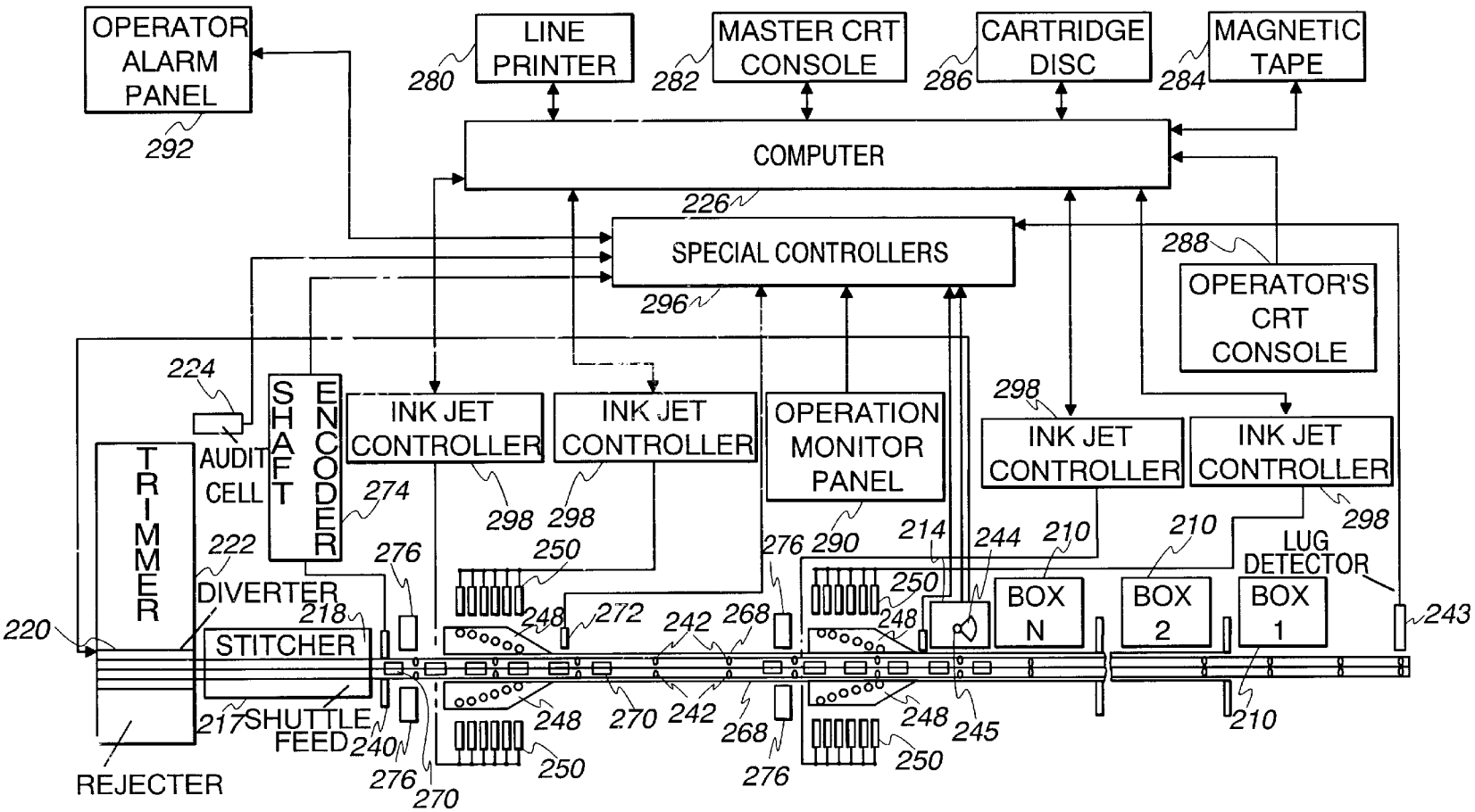
FIG. 13 is a block diagram of the signature collating and binding system of FIG. 1 utilizing side-by-side and tandem mounting of plate-like members.

As is shown in FIGS. 2 and 13, another plate-like member 248 can be mounted adjacent the conveyor chain 212, opposite the above mentioned plate-like member 248 at the same longitudinal location along the conveyor chain 212 to enable the printing of another centerfold page 235 and outside page 237 of the same signature 230 or of a different one. In addition, printer heads 250 can be mounted horizontally underneath the plate-like members 248 to print on the outside pages 237 of the signatures 230 hanging in a substantially vertical plane on the conveyor chain 212 unopened. Should it be necessary to print on more pages 231, 233, additional plate-like members 248 could be fan mounted about the conveyor chain 212 as illustrated in FIG. 9. The number of plate-like members 248 which can be fan mounted will depend on the size and arrangement of the printer heads 250 utilized.

If the plate-like members 248 become so numerous in a fan mounting configuration so as to not allow room to mount the printer heads 250, the plate-like members 248 can be staggered or mounted tandemly along the conveyor chain 212, as is illustrated in FIG. 13, or the printing platens 253 of the fan mounted plate-like members 248 could be extended in length, as is illustrated in FIG. 9, such that the printer heads 250 need not be mounted directly above and below each other but can be longitudinally off-set from each other along the printing platen 253. This is illustrated in the end view shown in FIG. 8, where four plate-like members 248 with extended printing platens 253 are utilized to provide the capability to print on eight pages 231, 233 of each book of signatures 229. The various configurations of the plate-like members 248 enable a virtually unlimited number and combination of pages 231, 233 of each book of signatures 229 to be printed.

Figure 14:
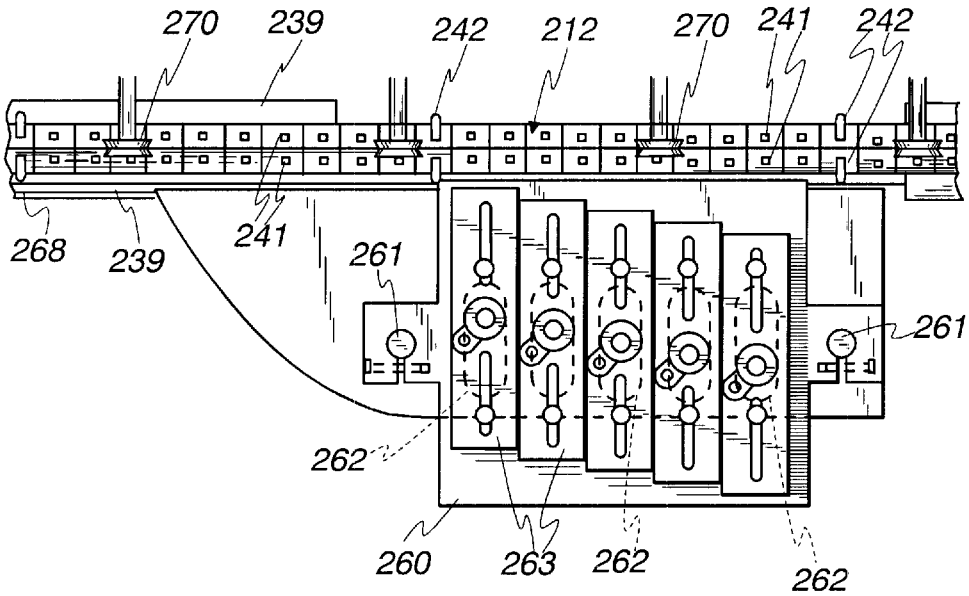
FIG. 14 is a fragmentary plan view of a printing station mounting structure.
Figure 15:
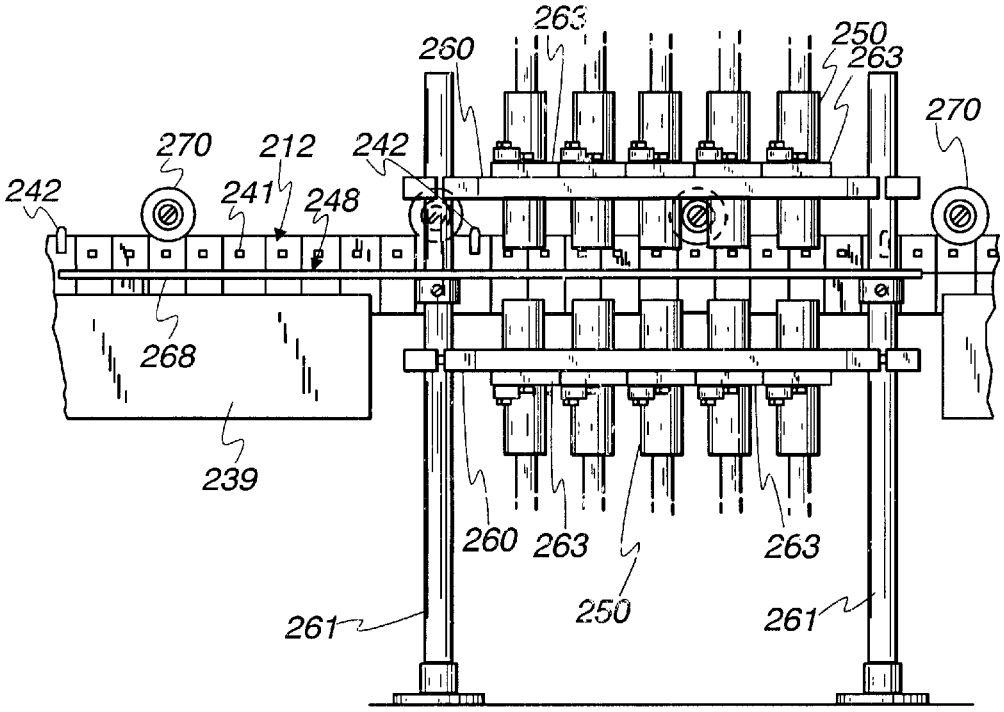
FIG. 15 is a side view of the printing station mounting structure of FIG. 14.
Figure 16:
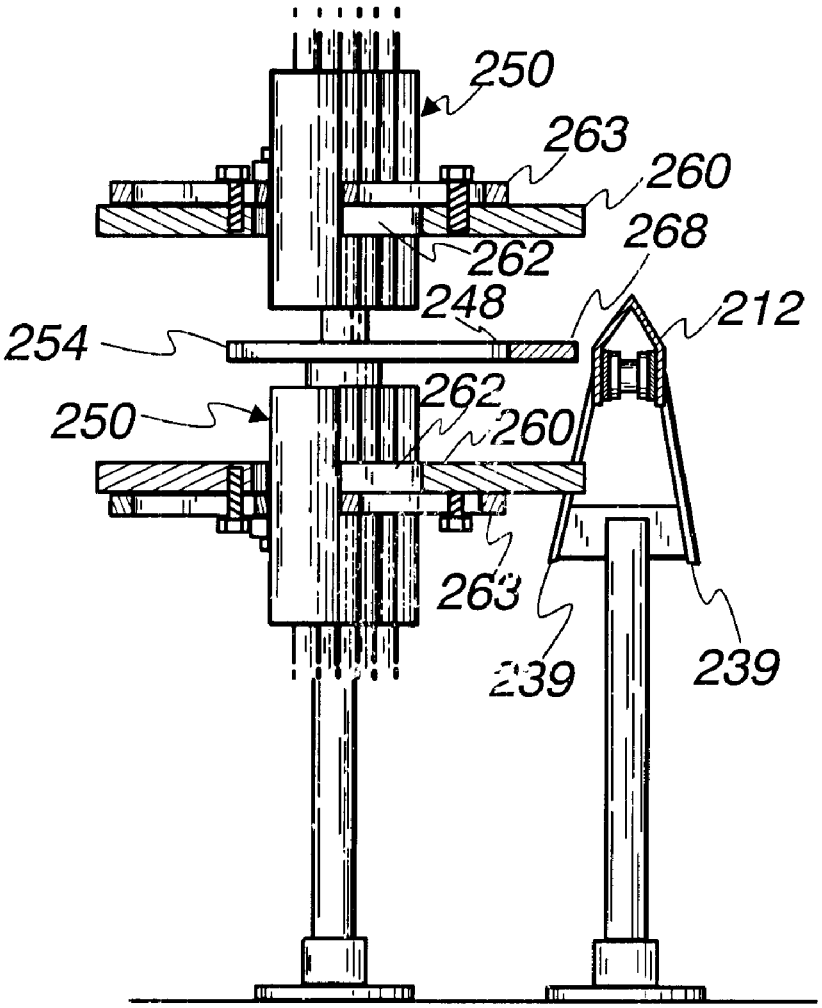
FIG. 16 is an end view of the printing station mounting structure of FIG. 15.

The plate-like member 248 may be supported adjacent the conveyor chain in any suitable manner, the method of mounting being obvious to those skilled in the art. Illustrated in FIGS. 14–16 is an example of a mounting structure constructed and arranged to support the plate-like member 248 and the associated printer heads 250 for printing on two pages, such as an inside page 231 and a cover page 233, of a book signatures 229. Plate-like member 248 is shown as being supported by vertically upright mounting standards 261. The mounting standards 261 are shown supporting printer head mounting plates 260 above and below said plate-like member 248. The printer head mounting plates 260 contain elongated apertures 262 therein so as to enable the printer heads 250 to extend vertically through the plates so as to be in close proximity to the plate-like member 248 and to enable the printer heads 250 to be adjustable radially from the conveyor chain 212. The printer heads 250 are attached to sliding members 263 positioned on the mounting plates 260 at varying distances from the conveyor chain 212.

The printer heads 250 are desirably of a dot matrix non-contact type. The printer head 250 of the dot matrix type are positioned adjacent the plate-like member 248 so as to be able to selectively print dots in a matrix to form characters on an inside page 231 or an outside page 233 or any combination thereof of the books of signatures 229 as the conveyor chain 212 conveys each book of signatures 229 past the plate-like member 248.

More particularly, the printer heads 250 are desirably of the ink jet type well known in the art and utilized in U.S. Pat. No. 4,121,818. As the signatures 230 move past the printer heads 250 matrices of dots are selectively printed by projecting droplets of ink along a direction transverse to the direction of movement of the conveyor chain 212, thereby creating alphanumeric characters on the pages 231, 233 of each book of signatures 229 as conveyed past printer heads 2250. Each plate-like member 248 will usually have a number of printer heads 250 which equals the number of lines of information to be printed as the book of signatures 229 is conveyed past the plate-like member 248 since each printer head 250 is capable of printing one line of information. Operation and control of the printer heads 250 is well known to the art. As illustrated in FIG. 2, positioned immediately upstream of the plate-like member 248 is a leading edge detector 272 for detecting the leading edge 232 of books of signatures 229 as they arrive at the printing station 16. The detector 272 may be any suitable photocell. The leading edge detector 272 sends an interrupt to the computerized control system whenever a leading edge 232 is detected.

A shaft encoder 274 driven by the conveyor chain sprocket drive shaft 240, which is diagrammatically illustrated in FIG. 2, detects the movement of the conveyor chain 212 and together with the leading edge detector 272 is utilized by the computerized control system for proper spacing and indexing of characters printed on the books of signatures 229. Shaft encoders and their uses are well-known to the art.

As shown in FIG. 7, strip heaters or dryer 276 are mounted adjacent the printing station 216 to assure quick and efficient drying of the ink by direct and reflected infra-red techniques. Preferably the dryers 276 are mounted adjacent the elongated apertures 255 of the printing platen 253 as illustrated in FIG. 11 so the fresh ink is dried as the pages 231, 233 move along the elongated apertures 255.

As shown in FIG. 2, after the ink is dried, shuttle feed 217 feeds the signatures 230 past a stitcher 218 which stitches the binding of the books of signatures 229. A diverter 220 transfers books of signatures 229, when so notified by the caliper 214, to contain an improper number of signatures 230 to a rejector 221. Books of signatures 229 which are found to have a proper number of signatures 230 are diverted to a trimmer 222 for trimming. The shuttle feed 217, stitcher 218, diverter 220, rejector 221, and trimmer 222 are all well known to the art of printing and any suitable embodiment may be utilized.

An audit cell 224 senses and notifies the computerized control system, after the trimming process is complete, whether or not there are any books of signatures 229 missing from the assembly line just prior to stacking for mailing. The audit cell 224 sends an interrupt to the computerized control system if a book of signatures 229 is determined to be present. If any books of signatures 229 are found to be missing, the control system reprints the information contained in those books of signatures 229. The audit cell 224 thus serves as a final automated check of whether any books of signatures 229 are missing for any reason, such as being removed after being cut up by the trimmer 222, thereby assuring as nearly as possible that all subscribers will receive a book of signatures 229. The audit cell 224 may be of any suitable photocell type.

The Control System for System 200

Figure 17:
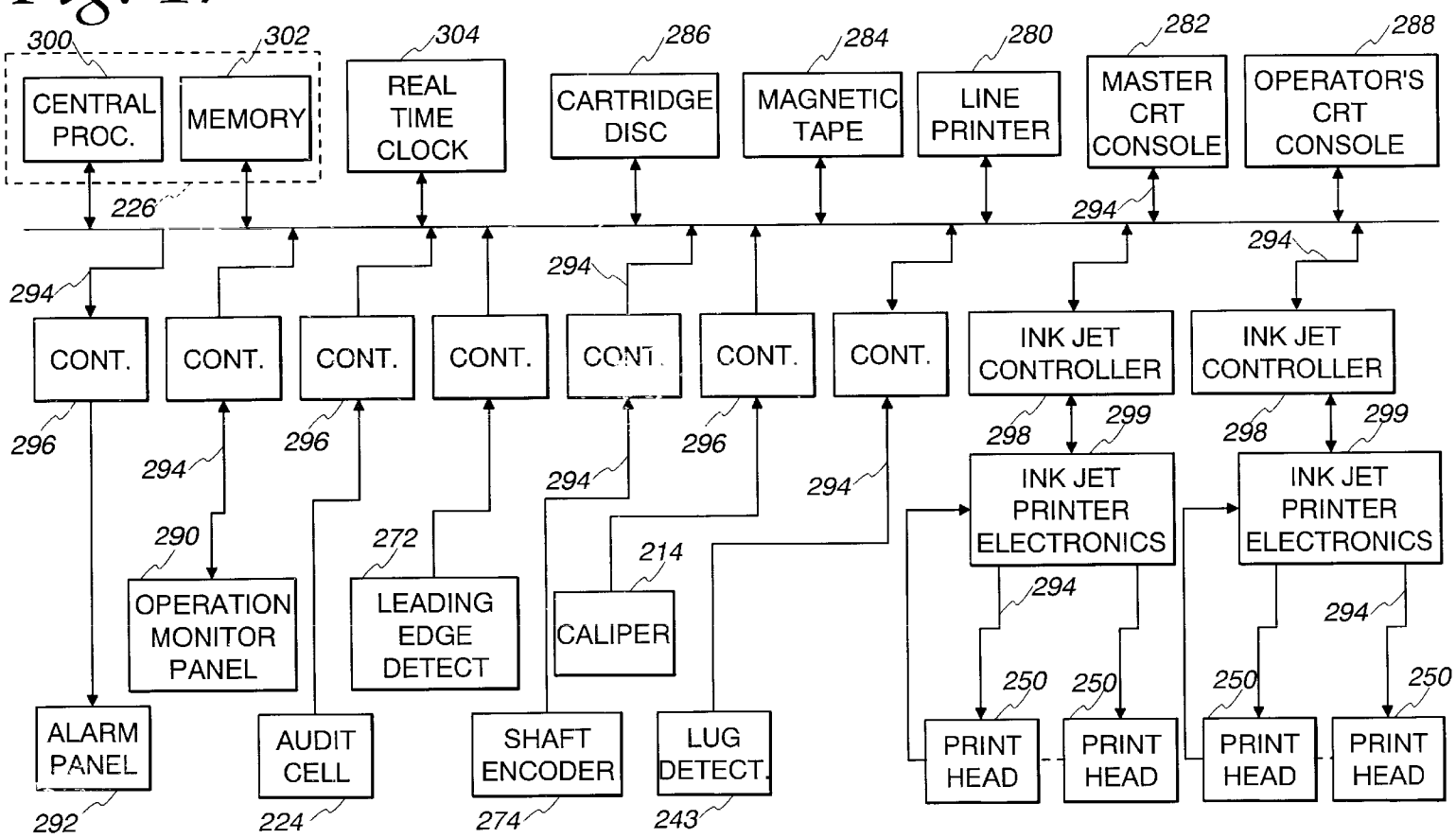
FIG. 17 is a block diagram of a computerized control system for a signature collating and binding system in accordance with the invention.

It is contemplated that the selective signature printing system 200 will be monitored and controlled by a computerized control system, a preferred embodiment of which, as is illustrated in FIGS. 2 and 17, includes the following elements or equivalents thereof: a programmed general purpose computer 226, a line printer 280, a master CRT console 282, a magnetic tape storage device 284, a disc storage device 286, an operator CRT console 288, an operation monitor panel 290, an alarm panel 292, associated communications lines 294 between the programmed general purpose computer 226 and the various elements of the signature printing system (audit cell 224, leading edge detector 272, shaft encoder 274, caliper 214, and lug detector 243), various special controllers 296, ink-jet printer controllers 298, and ink-jet printer electronics 299.

In general, the computerized control system performs the following functions during system operations:

a. monitors where the books of signatures 229 are at in the signature printing process via the lug detector 243 which detect conveyor chain 212 movement;

b. monitors whether the books of signatures 229 contain a proper number of pages 231, 233 via the caliper 214;
c. initiates printing at the printing station 216 of books of signatures 229 which contain a proper number of pages 231, 233;
d. inhibits printing of books of signatures 229 determined to contain an improper number of pages 231, 233 by the caliper 214;
e. initiates printing, on the next sequential book of signatures 229 found to contain a proper number of pages 231, 233 of the information which is not printed on the faulty book of signatures 229;
f. prints a mail distribution change mark on the books of signatures 229 when a mail distribution change occurs.
g. monitors via the audit cell 224 the presence or absence of books of signatures 229 prior to stacking of the books of signatures 229 for mailing;
h. reprints the customized information and mailing information contained by the books of signatures 229 found to be missing by the audit cell 224 if so desired;
i. notifies via the alarm panel 292 when the system is approaching an end of run, when there is an end of run, when a mail distribution change has occurred and a book of signatures 229 so marked is determined to be present by the audit cell 224, when a mail distribution change has occurred but the book of signatures 229 containing the mail distribution change mark is determined to be missing by the audit cell 224;
j. presents detailed system status at the operation monitor panel 290;
k. prints system status and job information at the line printer 280; and
l. displays system status at master CRT console 282 and operator's CRT console 288.

Referring now to FIG. 17, the computer 226 may be any suitable commercially available computer which includes a central processor 300, and a memory 302 or the equivalent thereof. The central processor 300 enable execution of preprogrammed instructions which may be loaded into the memory 302 of the computer 226 from any suitable mass storage device such as magnetic tape 284. An external real-time clock 304 enables synchronization lines 294 enable communications between the computer 226 and the various sensors and devices of the signature printing system.

Subscriber customized information and mailing label information is prepared for storage on a mass storage medium which is capable of being accessed by the computer 226. In the preferred embodiment of the present invention, the magnetic tape storage device 284 is utilized to store the subscriber information. The mass storage medium is prepared by any one of many common well-known data processing techniques wherein subscriber information is stored according to a pre-determined machine readable format. To facilitate the mailing and sorting of books of signatures 229, the subscriber information should be stored on tape so information relating to subscribers in a particular mail distribution sequence can be printed sequentially as a group, thereby assisting in the grouping of books of signatures 229 for mailing purposes.

The computerized control system can operate on the stored subscriber information in several different ways depending on the particular system structure, (i.e., computer, printers, consoles, etc.), and programming utilized. Various computerized control system arrangements can be utilized, the system disclosed herein being but one of an endless variety of choices for implementing control of the signature printing system.

In the preferred embodiment, the disc 286 is used to store subscriber information which must be reprinted due to books of signatures 229 found to be missing by the audit cell 224. When a book of signatures 229 is detected as missing, the computerized control system will determine what information had been printed on the missing book of signatures 229 and will store that information on the disc 286. At the end of a run after having printed the subscriber information contained on magnetic tape 284, the computerized control system will check if there is any subscriber information on the disc 286 which needs to be reprinted. If there is, the computerized control system will print the information from the disc 286. Note that, as explained hereinafter, the operator has the option of selecting whether reprinting is to occur at the end of a run. Note also that the subscriber information to be printed during a given run might be on more than one tape.

In the preferred embodiment, the line printer 280 is used for hard copy print-out of signature printing system status and other information of interest to an operator. The operator can use this information for trouble-shooting and isolating system problems as well as determining signature printing system status at any given time. The line printer 280 can also be used for print-out of job information, e.g., customer name, number of signature books 229 printed, type of books of signatures 229 printed, etc.

The master CRT console 282 and operator's CRT console 288 enable operator input to the computer 226. In addition, the console 220, 288 are capable of displaying computer 226 output. The master CRT console 282 is located in close proximity to the computer 226 and used mainly for initializing and starting the computerized control system. The operator's CRT console 288 is located in close proximity to the conveyor chain 212 with its various stations and used mainly for displaying signature printing system status to the operator and for operator control of signature printing system operation once the computerized control system has been initialized and started.

In the preferred embodiment, the operation monitor panel 290 which is located in close proximity to the computer 226 is normally used for trouble shooting purposes as it displays detailed system status via various indicators.

The alarm panel 292 is located next to the conveyor chain 212 with its various stations and is used for providing various visual and audio alarm indications such as approaching the end of a run, end of run, mail distribution change and a book of signatures 229 so marked with a mail distribution change mark is present, and mail distribution change but the book of signatures 229 so marked is missing. Note that while only one alarm panel 292 is shown in FIG. 2, there may be several scattered throughout the system.

The special controllers 296 and ink-jet controllers 298 along with te ink-jet electronics 299 enable the computerized system to interface with the various elements of the signature printing system by providing for the proper formatting and timing of information transfer on the communication lines 294. As illustrated in FIGS. 2 and 17, there is an ink-jet controller 298 and associated ink-jet printer electronics for each set of printer heads 250, the operation and control of which being well known in the art. Each ink-jet controller 298 and associated ink-jet printer electronics 299 is typically capable of controlling up to six individual printer heads 250. In FIG. 17, a dashed line is drawn between printer heads 250 to indicate from one to six heads per controller 298. Note that while the communication lines 294 are drawn as one line, they may actually represent several wires or cables.

Prior to initiating the computerized control system, a preformatted tape containing subscriber information is placed on the magnetic tape storage device 284. An operator at the master CRT console 282 then positions the tape via computer program control or manually so it is ready for access by the computer 226.

After starting the computer program the operator enters various parameters from the master CRT console 282 which are necessary for proper initialization of the computer program. Examples of parameters the operator must enter prior to starting a signature printing system run are as follows:

(a) the number of books of signatures 229 before the end of a run that the approaching end of run alarm is to be sent to the alarm panel 292;

(b) whether books of signatures 229 found missing by the audit cell 224 are to be reprinted;

(c) how the subscriber information is formatted and located on the preformatted tape, (e.g., which information fields are allocated to subscriber name, street number, town, etc.);

(d) the number of lugs 242 between the caliper 214 and printing station 216;

(e) the number of lugs 242 between the printing station 16 and audit cell 224;

(f) whether double label information is to be printed on book page 231, 233;

(g) the run identifier and description;

(h) number of ink-jet controllers 298 to be used;

(i) nature of information to be printed by each ink-jet controller 298; and (j) how far offset from the leading edge 232 of a signature book 29 information is to be printed.

Note, the above are but some examples of the type of system parameters which are necessary for system initialization and should not be considered as limiting the extent of operator parameter entries as this will vary from system to system.

Figure 18:
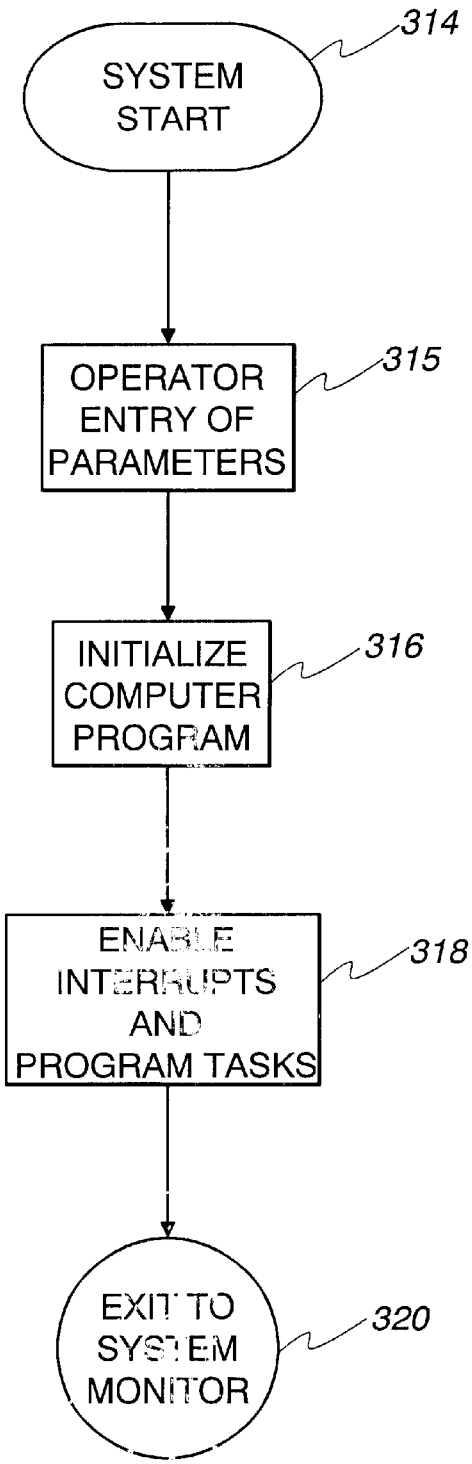
FIG. 18 is a logic flow diagram for start-up of the computer program.

As illustrated in FIG. 18, after the operator has started the computer program at block 314 and has entered various system parameters at block 315, the computer program initializes its data stores; i.e., arrays, tables, counters, variables, buffers, etc. as indicated at block 316. The computer program then enables interrupts from the various signature printing system sensors and devices and initializes program tasks or functions.

The computer program has a number of standard tasks for executive, supervisory, utility, communication, and other various tasks in addition to the tasks for controlling the signature printing system. The operation of the standard tasks is well-known to those skilled in the art. For clarity, only certain aspects of the logical flow paths associated with the tasks for controlling the signature printing system will be described in detail herein, the other alternatives and possibilities in the logic flow paths being apparent. The program tasks for controlling the signature printing system for ease of explanation and clarity have been broken down into four programmed tasks labeled master queue, print manager, digital IO manager, and audit manager as illustrated in FIGS. 12A–D and 17–19B and described in more detail hereafter.

It will be appreciated, however, by those skilled in the computer art that other logic arrangements may be employed to achieve the functional results of the present invention. When not performing the various tasks, the computer program returns to a system monitor task as indicated by block 320, which is a standard executive housekeeping task. In the system monitor task, the computer program 226 monitors the various activities of the computerized control system by responding to interrupts and initiating program tasks as necessary.

Figure 19A:
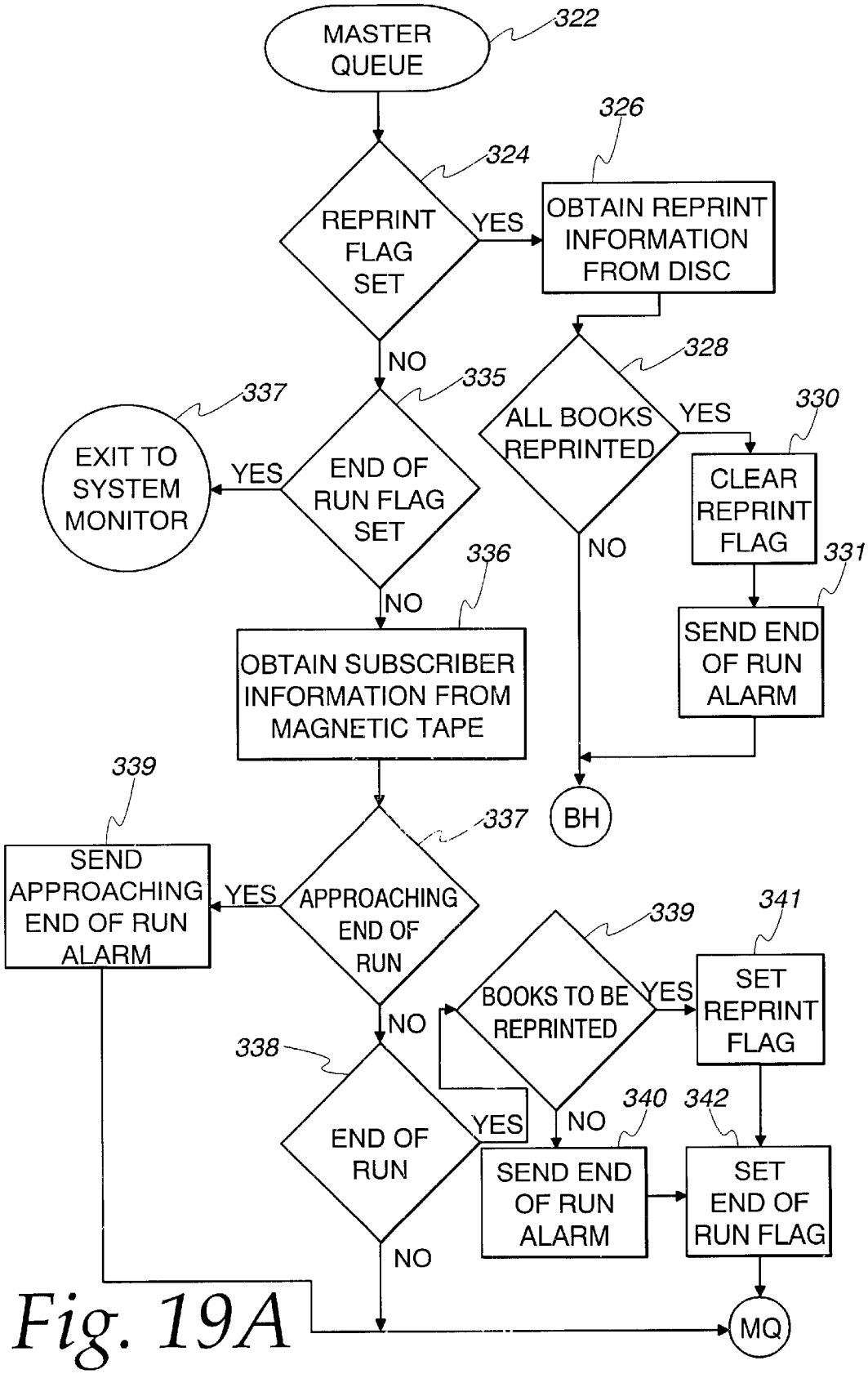

As illustrated in FIGS. 19A–B, the master queue task starting at block 322 reads the subscriber information off the magnetic tape 284 or disk 286 and reformats the information for printing. Note that the logic flow is illustrated by arrowed lines. In certain of the other tasks it is not feasible or possible to illustrate the logic flow interconnected by arrowed lines, e.g., where the logic flow extends onto another page, so logic flow connectors indicated by encircled letters are utilized to indicate the logic flow in such instances. After reformatting the information, the master queue task places the information in an area of memory 302 referred to as the master queue 500 diagrammatically illustrated in FIG. 23.

Figure 23:
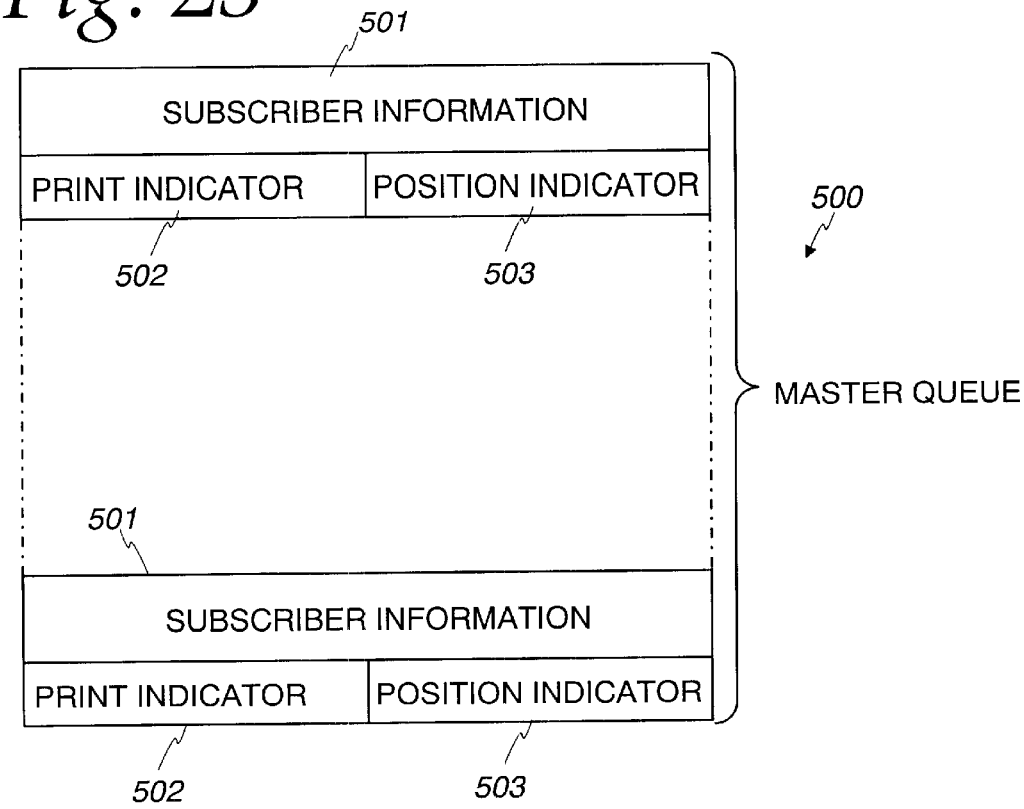
FIG. 23 is a diagramatic representation of the aster queue in memory.
Figure 24:
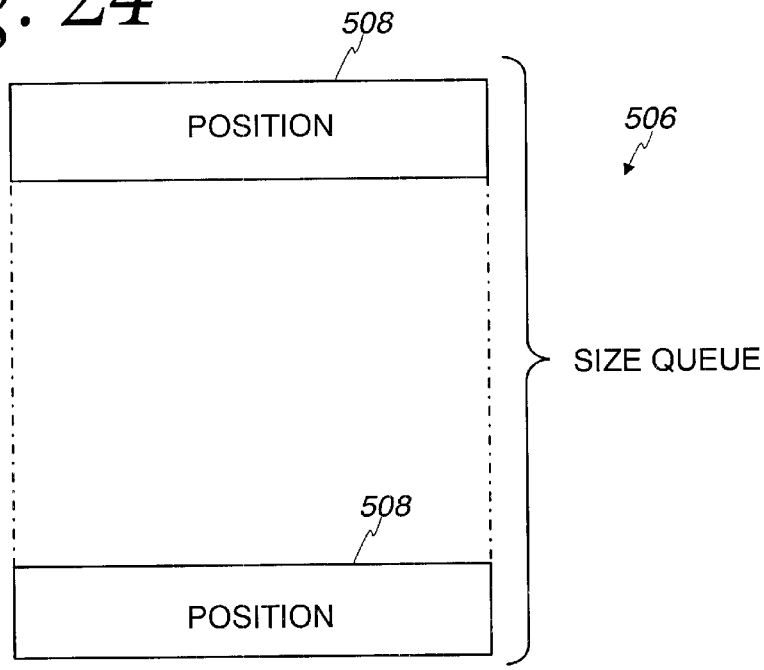
FIG. 24 is a diagramatic representation of the size queue in memory.

The master queue 300 is the area of memory 302 in the computer 226 where the subscriber information for each signature book 229 is stored for access by the print manager task after being loaded into memory 302 from magnetic tape 284 or disc 286. The print manager task accesses the master queue 500 when printing of books of signatures 229 occurs. In addition to a subscriber information field 501 containing the subscriber information to be printed on each book of signatures 229 and an identifying header, the master queue 500 contains other fields of information. As illustrated in FIG. 23, the master queue 500 contains a print field 502 and a position indicator field 503 for each set of subscriber information. As each book of signatures 229 is printed, the print indicator field 502 associated with the subscriber information field 501 is set indicating a book of signatures 229 is now on the conveyor chain 212 with this information. Once a book of signatures 229 is so printed, the associated position indicator field 503 is incremented by the digital IO manager task whenever a lug 242 is detected by the lug detector 243. In this way, the computerized control system monitors how far along in the signature printing process the books of signatures 229 have progressed. As mentioned earlier, one of the parameter entries made by the operator at system start-up is the number of lugs 242 between the leading edge detector 272 and the audit cell 224.

Thus, for example, if the operator indicated the audit cell 224 was thirty-seven lugs 242 from the leading edge detector 272, when the position indicator field 503 is incremented to 237 the computerized control system will know a printed book of signatures 229 containing the subscriber information in the associated subscriber information field 501 should be present at the audit cell 224. If the audit cell 224 doesn't detect a book of signatures 229 present at this location on the conveyor chain 212 and if the operator in his parameter entries indicated missing books of signatures 229 are to be reprinted, the subscriber information in the subscriber information field 501 is placed on the disc 286 to be reprinted and the subscriber information for the missing signature book 220 is deleted from the master queue 500.

If a book of signatures 229 is detected as being present by the audit cell 224, the subscriber information on that book of signatures 229 is deleted from the master queue 500 as there is no longer any need for retaining the subscriber information in the master queue 500. Note that it might be desirable to wait until the books of signatures 229 have traveled some distance beyond the audit cell, e.g.., five lug 242 positions, before the subscriber information is removed from the master queue 500.

As indicated by decision block 324 in FIG. 19A, the master queue task checks a reprint flag to see if in the reprint mode, i.e., missing books of signatures 229 are currently being reprinted. If books of signatures 229 are being reprinted, then as indicated by block 326, the reprint information is obtained from the disc 286. At 328 a check is made to see if all the missing books of signatures 229, including those missing, have been completed. Next, as indicated by logic flow connector BH, regardless of whether reprinting is completed or not, an information header record identifying the formatted subscriber information is built at block 332, illustrated in FIG. 19B, after which the information with its header record is placed on the master queue at block 334 and then at 336 the program exits to the system monitor.

If at 324 the reprint flag was not set, indicating the master queue task is not in the reprint mode, a check is made at 335 to see if all the subscriber information has been obtained from the magnetic tape 284. If so, a return to system monitor occurs at 337. If any subscriber information remains on magnetic tape 294, it is obtained from the magnetic tape 284 at block 336. At 337 a check is made to see if approaching end of run. This check is made based on the parameter entry by the operator which indicates how many books of signatures 229 before the end of run the operator wants an alarm sent to the alarm panel 292. If approaching an end of run, at 339 the approaching end of run an alarm is sent to the alarm panel 292.

Next, as indicated via logic flow connector MQ, the tape data is reformatted for printing at 344. At decision block 346 a check is made for a change in mail distribution. If there is a mail distribution change, at 348 a mail distribution change mark is inserted in the reformatted subscriber information so it will be printed on the book of signatures 229 along with the subscriber information and the logic then follow along blocks 332 through 336. If there was no mail distribution change the computer program performs steps 332–336. The mail distribution change mark will indicate to the personnel sorting the books of signatures 229 for mailing that a new bundle, sack, or pallet is to be started.

If at decision block 337 it was determined the signature printing system was not approaching an end of fun, a check is then made at decision block 338 to see if all the subscriber information has been obtained from magnetic tapes 284. If it has, at 339 a check is made to see if the operator via parameter entries indicated that missing books of signatures 229 were to be reprinted. If books of signatures 229 are to be reprinted, at 341 the reprint flag is set and at 342 the end of run flag is set. If missing books of signatures 229 are not to be reprinted at 340, the end of run alarm is sent to the alarm panel 292 and then at 342 the end of run flag is set. Next, as indicated by logic flow connector MQ, steps 344 through 336 are performed in FIG. 19B.

Figure 20:
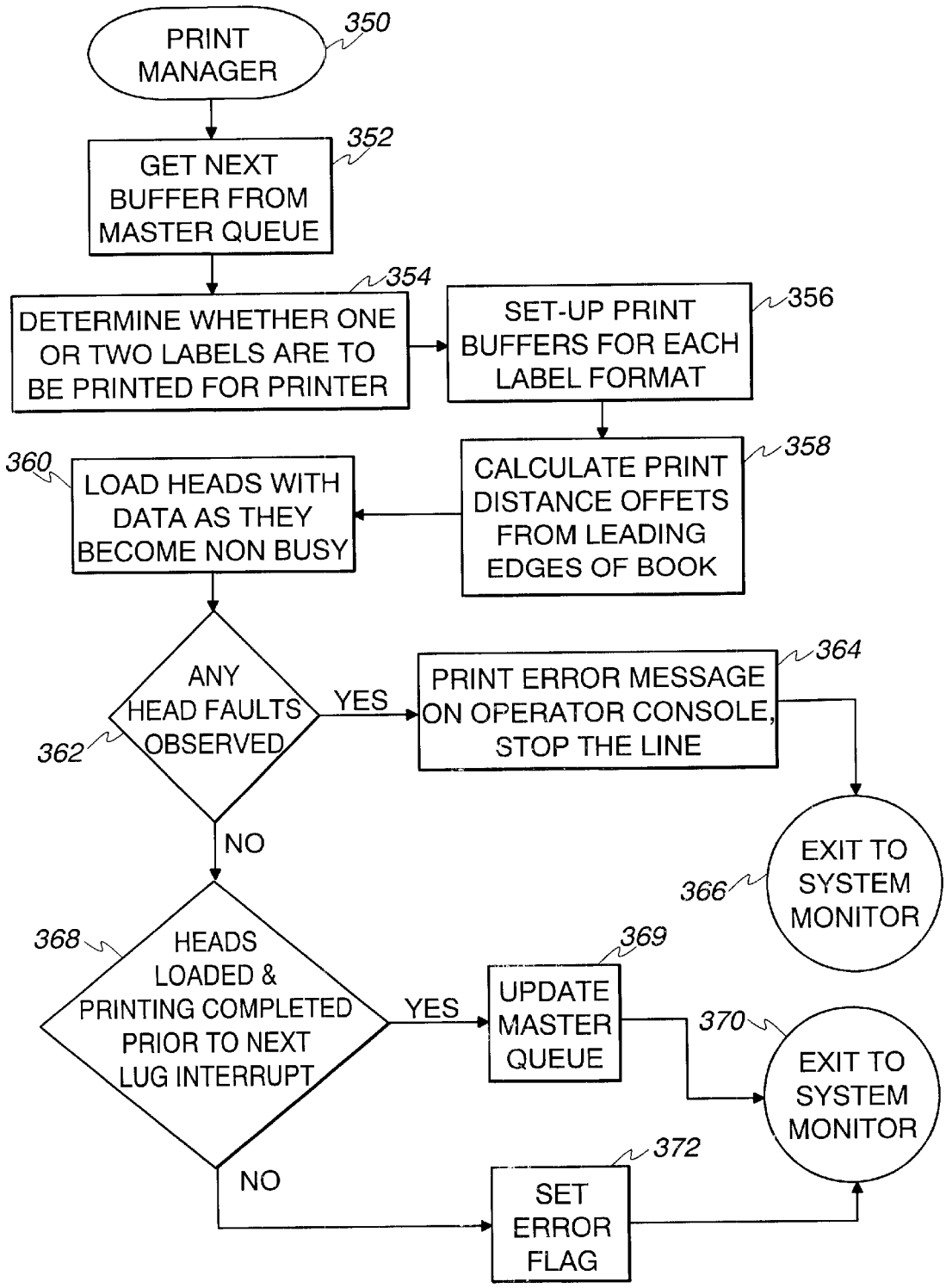
FIG. 20 is a logic flow diagram for the print manager program task.

As illustrated in FIG. 20, the print manager task controls the printing of subscriber information at the printing station 216. The print manager starts at block 350 and obtains the next subscriber information to be printed from the master queue at block 352. At 354, the print manager determines whether a duplicate set of subscriber information or double label is to be printed on a book page 231, 233. Note that this is one of the parameter entries made by the operator when the system is first started. At 356, the buffers for each label format are created for the printer heads 350. At 358, the offset distance from the leading edge of a book of signatures 329 is calculated based on the operator's parameter entry when the system is first started. At 360 the printer heads 350 are loaded with data as they become non-busy. A check is then made at 362 for any printer head faults. If a printer head fault is observed, an error message is printed at the operator console 288 and the signature printing system is stopped at 364. The print manager task then exits through the system monitor at 366.

If no faults were observed a check is next performed at 368 to see whether all the printer heads 350 are loaded and printing completed prior to the next interrupt being received from the lug detector 243. If all printing has been completed, 369 the print indicator field 502 of the master queue is set indicating the subscriber information in the subscriber information field 501 has been printed and then the print manager task returns to the system monitor at 370. If all printing is not completed prior to receipt of the next lug interrupt an error flag is set indicating the book of signatures 229 is not printed at 372. A return to the system monitor at 370 is then performed.

Figure 21A:
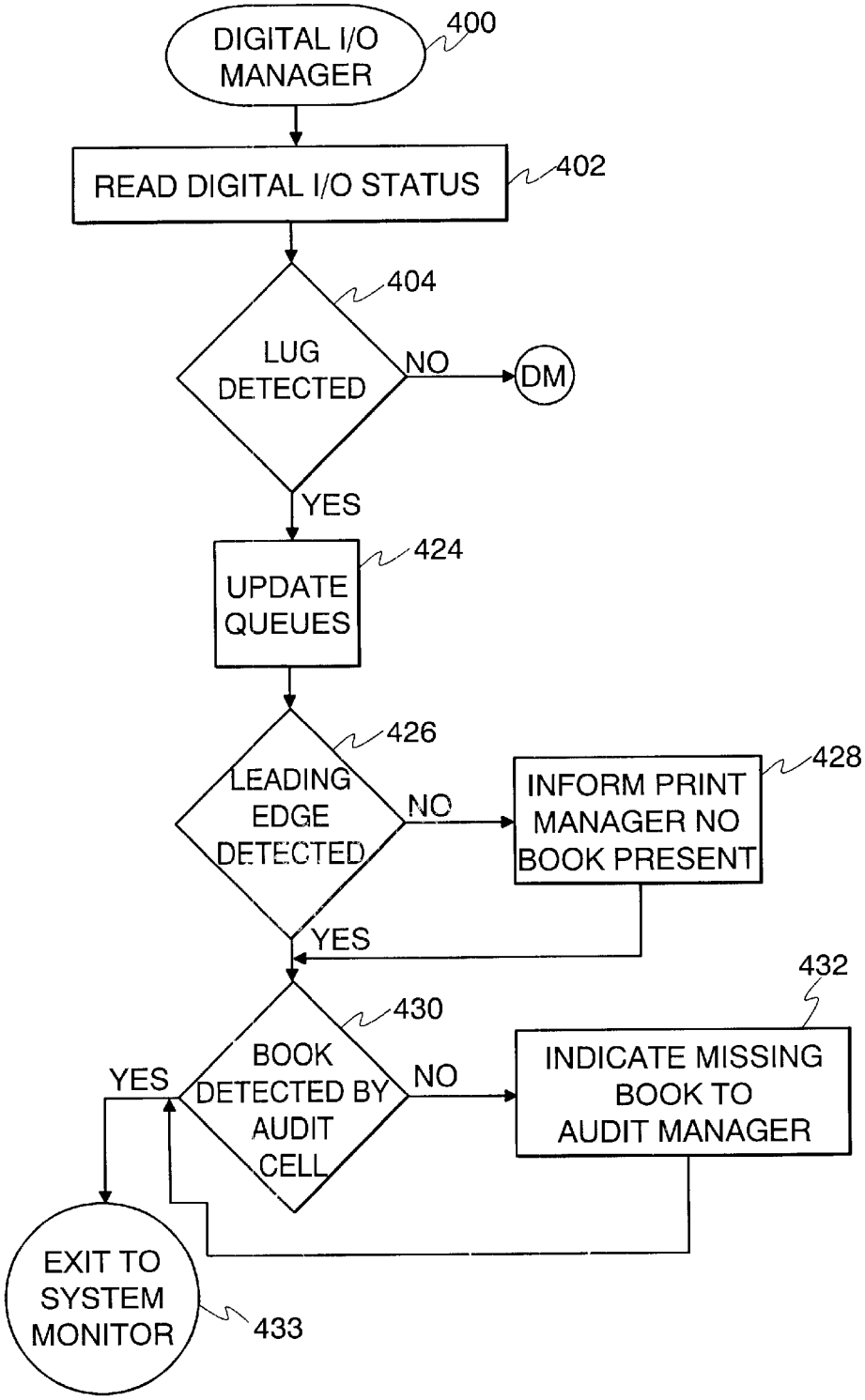
FIGS. 21A–B are logic flow diagrams for the digital I/O manager program task.
Figures 21, 21A, 21B:
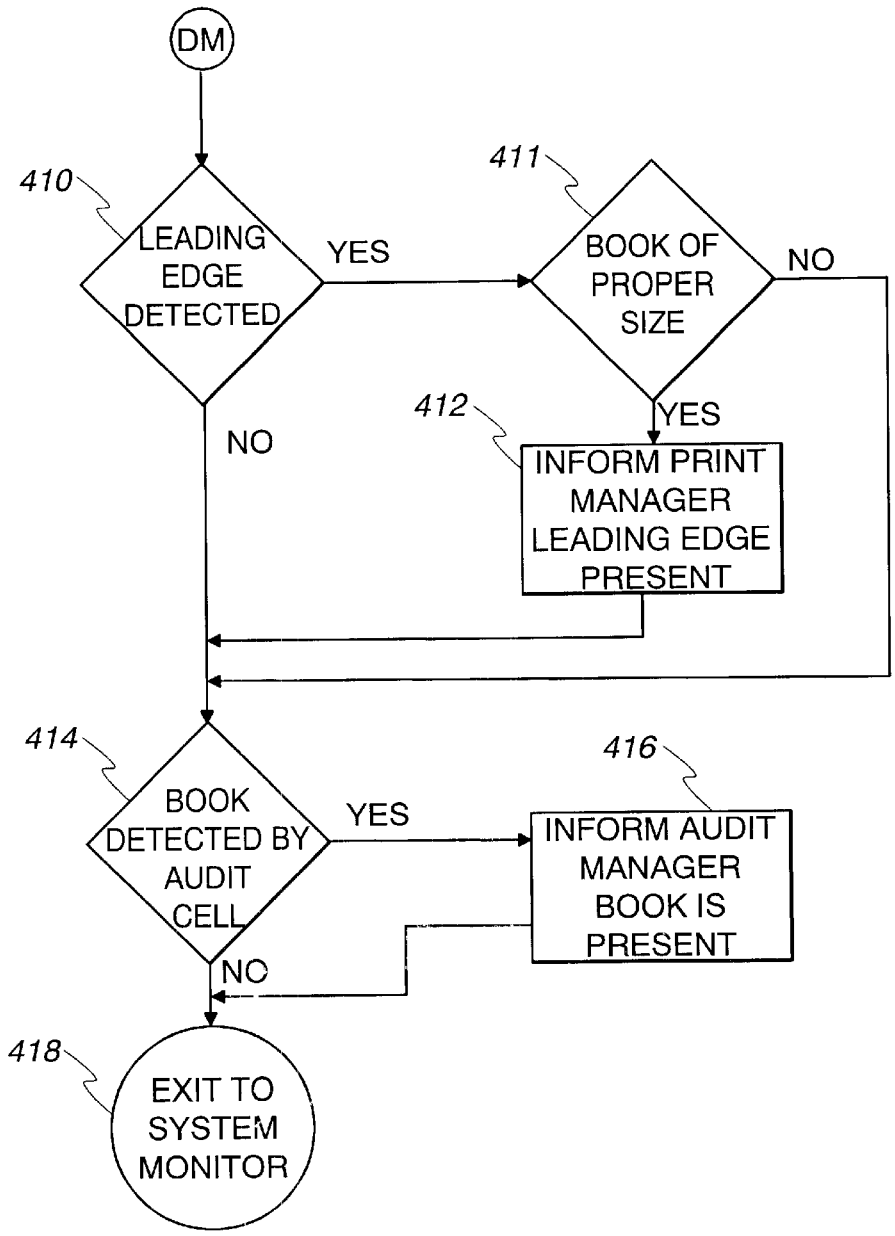

The digital I/O manager task as illustrated in FIGS. 21A–B monitors the status of the caliper 214 the lug detector 243, the leading edge detector 272, and the audit cell 224. The digital I/O manager starts at block 400 and reads the digital I/O status of the system devices at 402. A check is made at decision block 404 of whether an interrupt was received from the lug detector 243 indicating a lug 242 was detected passing the lug detector 243. If no lug is detected by the lug detector 243, at 410, as illustrated in FIG. 21B, a check is made on whether the leading edge 232 of a book of signatures 229 has been detected by the leading edge detector 272 at the print station 216. If a leading edge 232 is detected, at 411 a check is made to see if the caliper 214 indicated the book of signatures 229 had a proper number of pages 231, 33 the print manager is not informed that a leading edge is present and thus the book signatures 229 is not printed.

The I/O manager task is able to determine whether a book of signatures 229 has a proper number of pages 231, 233 due to the caliper 214 which notifies the computerized control system whether each book of signatures 229 has a proper number of pages 231, 233. As each book of signatures 229 passes the caliper 214, the caliper 214 via an interrupt informs the computerized control system if the book of signatures 229 has an improper number of book pages 231, 233. When the computerized control system is informed of a book of signatures 220 having an improper number of pages 231, 233, a location may be reserved in an area of memory 302 referred to as a size queue 506. Each location in the size queue 506 includes a position field 508 as illustrated in FIG. 11. The position field 508 for each area of the size queue 506 reserved is incremented by one each time a lug 242 is detected by the lug detector 243. Thus the computerized control system monitors how far along the conveyor chain 212 each book of signatures 229 having an improper number of pages 231, 233, has advanced beyond the caliper 214. As noted earlier, one of the parameter entries made by the operator at system start-up is the number of lugs 242 between the caliper 214 and the leading edge detector 272.

Thus, for example, if the operator says there were five lugs 242 between the caliper 214 and the leading edge detector 272, when the position field 508 for a book of signatures 229 is incremented to a value of 5, the computerized control system knows that the book of signatures 229 having an improper number of pages 231, 233, is now at the leading edge-detector 272. The computerized control system can then inhibit printing station 216. The memory 302 location for that particular book of signatures 229 is then removed from the size queue 506 as it is no longer required.

Regardless of whether a leading edge 232 is present, a check is made at 414 in FIG. 21B to see whether a book of signatures 229 has been detected by the audit cell 224. If a book of signatures 229 is detected as being present at 416, the audit manager is informed that a book of signatures 229 is present. At 418 an exit to the system monitor is performed whether or not a book of signatures 229 has been detected.

If back at decision 404 a lug 242 was detected, the position fields 503 and 508 in the master queue and size queue are updated at 424. A check is then made at 426 to see whether a leading edge 232 of a book of signatures 229 has been detected since the last lug 242 detection. If not, at 428 a no book condition at the print station 216 is indicated to the print manager. Regardless of the results of the check made above, a check is then made at 430 to determine whether or not a book of signatures 229 has been detected by the audit cell 224 since the last lug 242 detection. If not, missing book of signatures 229 condition is indicated to the audit manager at 432 and at 433 an exit to the system monitor is performed. If a book of signatures 229 has been detected at 433, an exit to the system monitor at 433 is performed.

Figure 22:
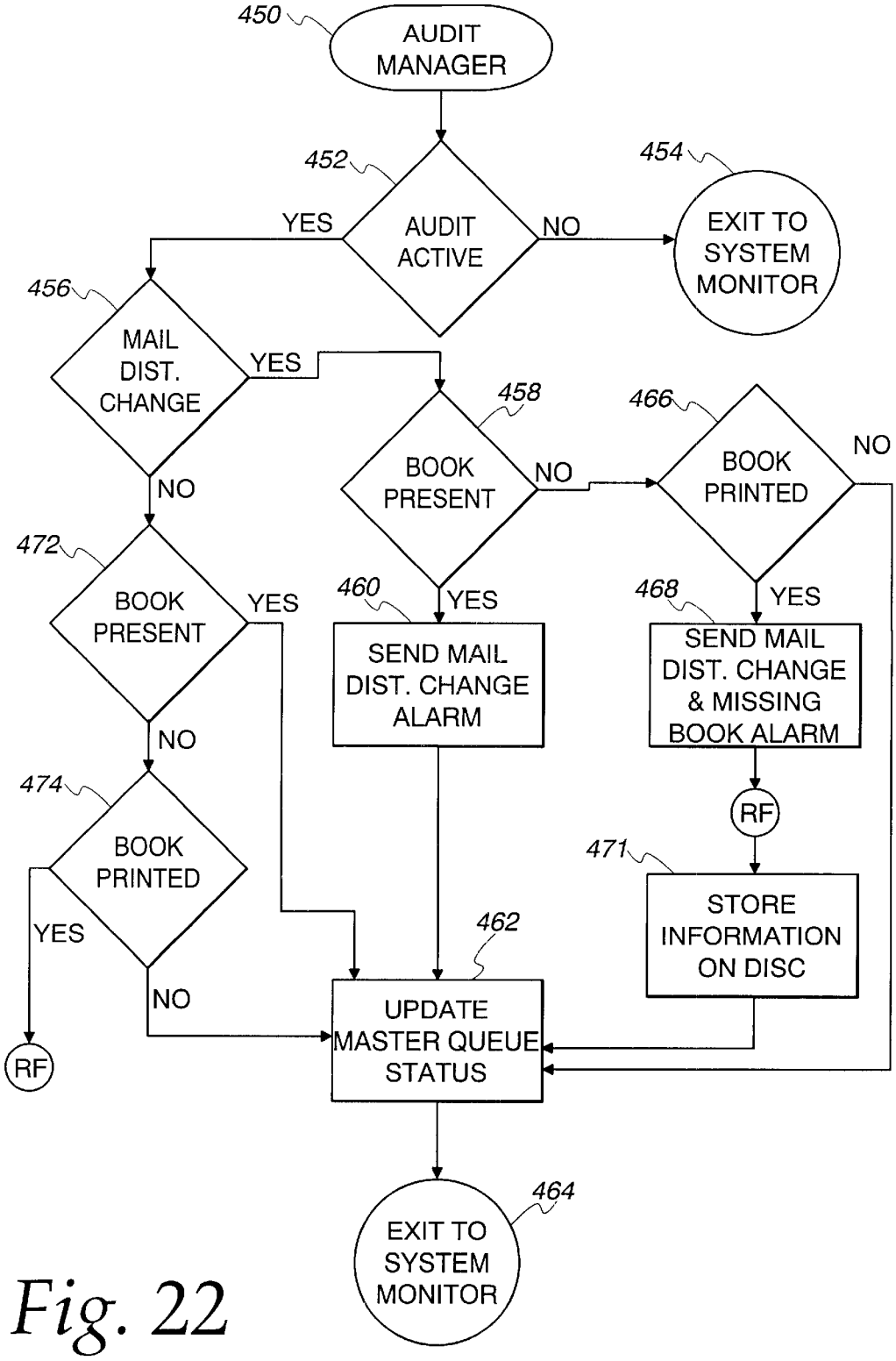
FIG. 22 is a logic flow diagram for the audit manager program task.

The audit manager task as illustrated in FIG. 22 starting at block 450, determines the action to be taken when a book of signatures 229 is present or absent at the audit cell 224 just prior to stacking for mailing. At block 452 a check is made to determine whether or not the audit cell is active. The operator indicates when the computer program is first started via parameter entry whether the audit cell 224 is to be utilized. If not, at 454 an exit to the system monitor is performed. At 456 a check is made for a mail distribution change. If a change in mail distribution is detected, at 458 a check is made for the presence of a book of signatures 229. If the book of signatures 229 is present, at 460 an alarm is sent to the alarm panel 292 indicating a mail distribution change and the presence of a book of signatures 229 so marked. At 462 the master queue 500 status is updated by removing the information for the book signatures 229 from the master queue 500 and at 464 an exit to the system monitor is performed. If there was a mail distribution change and there is no book of signatures 229 present, at decision block 466 a check is made for whether a book of signatures 229 has been printed for that location. If not, steps 462 and 464 are performed. If a book of signatures 229 has been printed, at 468 an alarm is sent to the alarm panel 292 to indicate a mail distribution change condition with the signature book 229 marked with the mail distribution change mark missing. At 471 the information for the missing book of signatures 229 is stored on the disc 284. Steps 462 and 464 are then performed. If at 456 there was no mail distribution change, a check is made at 472 for whether a book of signatures 229 is present. If no book of signatures 229 is present, at 474 a check is made as to whether a book of signatures 229 had been printed for the location. If a book of signatures 229 been printed but is now missing, steps 471, 462 and 464 are next performed so another book of signatures 229 can be reprinted. If a book of signatures 229 was not detected as being present and no book of signatures 229 had been printed for that location, steps 462 and 464 are performed. If a book of signatures 229 was detected as being present but there was no mail distribution change steps 462 and 464 are performed.

While various schematic diagrams of the computer program have been illustrated and described, it is to be understood that these have been utilized merely as a means to describe the possible logic function of a preferred embodiment of the present invention. Obviously, the logic functions can vary depending on how implemented and the nature of the computerized control system being used.

In operation, after the operator has initialized and started the system, the feeders 210 feed the signatures 220 onto the moving conveyor chain 212 so as to progressively build up the books or collections of signatures 229. Downstream from the feeders 210, the thickness of the books of signatures 229 are measured by the caliper 214. The caliper 214 detects variations in thickness which indicate a book of signatures 229 has an improper number of books pages 231, 233 or signatures 230. The caliper 214 notifies the diverter 220 and computerized control system of those books of signatures 229 which are determined to be faulty. When the faulty books of signatures 229 reaches the diverter 220, they will be diverted to the rejector or rejection. The computerized control system upon receiving notice of a faulty book of signatures 229 will inhibit printing of subscriber information on that book of signatures 229 at printing station 216.

After being measured by the caliper 214, the books of signatures 229 are conveyed downstream to the printing station 216. A leading edge detector 272 detects the approach of the books of signatures 229 and notifies the computerized control system of such. The computerized control system utilizes this information along with information from the shaft encoder 274 which monitors conveyor chain 212 movement to determine the proper indexing and spacing of characters to be printed. If the book of signatures 229 detected by the leading edge detector 272 was previously determined to have an improper number of book pages 231, 233 the computerized control system will initiate printing on the next book of signatures 229 in sequence found to have a proper number of book pages 231, 233.

Note that the computerized control system does not require a complex program architecture for indexing and collation of mailing label information printed on the cover page 233 of a book of signatures 229 and customized information printed on the inside page 231 of a book of signatures 229. In the present system, since both types of information are printed near simultaneously, a simplified indexing scheme can be used.

After being printed, bindings of the books of signatures 229 are stitched. Books of signatures 229 which were determined to be faulty by the caliper 214 are then directed to the rejector 221 by the diverter 220. Those books of signatures 229 found to contain a proper number of book pages 231, 233 are next trimmed by the trimmer 222.

After the stitching and trimming is completed an audit cell 224 senses or detects the presence or absence of the books of signatures 229 on the conveyor chain 212 prior to stacking for mailing. The audit cell 224 informs the computerized system of the books of signatures 229 found to be missing. The computerized control system then determines the information which was printed on the missing books of signatures 229 and stores that information on disc 286. The audit cell 224 thus assures that all of the books of signatures 229, for whatever reason missing, are reprinted and delivered to their intended subscribers.

The computerized control system monitors the status of the signature printing process and generates alerts when the signature printing system 200 is approaching an end of a book of signatures 229 run and is at the end of a run. In addition, while printing subscriber information on the books of signatures 229 at the printing station 216, the computerized control system causes a mail distribution change mark to be printed on the book of signatures 229 where the mail distribution change occurs. In addition, the computerized control system generates an alert if there is a mail distribution change and the audit cell 224 has detected the presence of a book of signatures 229 containing the mail distribution change mark or generates a different alert if there is a mail distribution change but the audit cell 224 has detected that the book of signatures 229 so marked with the mail distribution change mark is missing. These alerts or alarms will appear at the alarm panel 292 in the form of various indicator lights or audible alarms.

The present invention thus discloses a signature printing system capable of near simultaneous printing on two or more pages 231, 233, such as a cover page 233 and an inside page 231 of a book of signatures 229. Because of this and other features, the present invention assures that subscriber mailing label information will be properly coordinated with subscriber customized information printed on the inside of the books of signatures 229. In addition, because of the capability to print near simultaneously on the inside page 231 and cover 233, the present invention requires a much less complicated control architecture.

Figure 25:
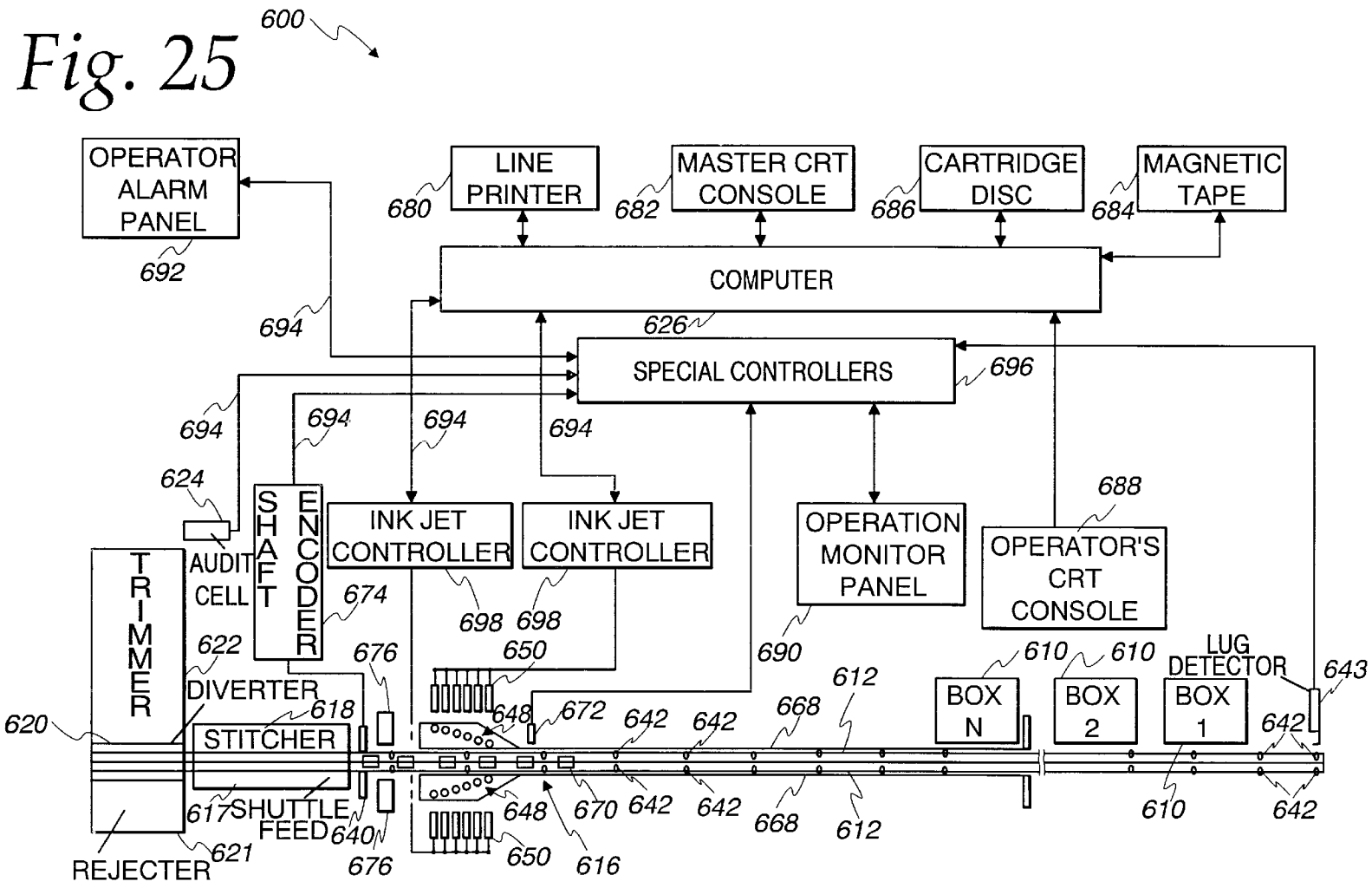
FIG. 25 is a block diagram of the non-selective signature collating and binding system of FIG. 1.

Referring now to FIG. 25, system 8 includes a system 600 for collating and binding signatures. The system 600 includes a plurality of feeders 610 at longitudinally spaced stations adjacent collating conveyor chain 612 for delivering signatures 630 to the conveyor chain 612 in superpositioned relationship so as to progressively build up books or collections of signatures 629 as illustrated prospectively in FIG. 26. The conveyor chain 612 conveys the books of signatures 629 past a caliper 614 which measures the thickness of the books of signatures 629 to determine if any of the books of signatures 629 has an improper number of signatures 630 or book pages 631, 633. The books of signatures 629 are next conveyed from the caliper 614 to a printing station 616. At the printing station 616, information is printed on the pages 631, 633 desired, such as information on inside pages 633 of the books of signatures 629.

The conveyor chain 612 conveys the books of signatures 629 to a stitcher 618 which stitches the books of signatures 629. From the stitcher 618, the books of signatures 629 are moved to a diverter 620 which transfers books of signatures 629 which are found to be of the proper size and otherwise in good condition are transferred by the diverter 620 to the trimmer 622 which trims the books of signatures 629. After trimming process an audit cell 624 monitors all of the completed books of signatures 629 to check any missing books of signatures 629.

The functions of the signature printing system 600 are monitored and controlled by a computerized control system 602. The computerized control system 602 will include a suitable programmable general purpose digital computer 626 and its associated peripherals and sensors which are described in more detail hereinafter.

More particularly, the feeders 610 utilized in the present invention are well-known in the prior art, and may be any suitable mechanism for delivering signatures 630 onto the conveyor chain 612. Feeders 610 deliver one signature 630 at a time to locations on the convertor chain 612 such that a plurality of feeders 610 mounted tandemly at longitudinally spaced stations adjacent the conveyor chain 612, diagrammatically illustrated in FIG. 25 as Boxes 1 through N, are capable of progressively building up books or collections of signatures 629 on the conveyor chain 612. This is shown perspectively in FIG. 26, where signatures 630 are being delivered onto a conveyor chain 612 so as to progressively build up books of signatures 629.

Figure 26:
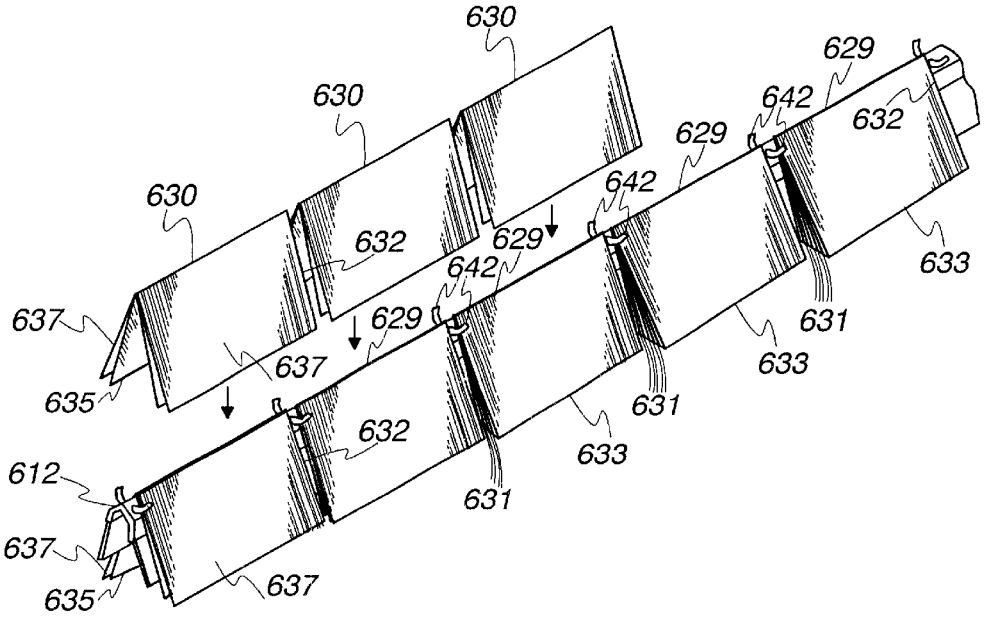
FIG. 26 is a perspective view of a plurality of signatures being progressively delivered on top of each other to form collections or books of signatures on the conveyor chain.
Figure 27:
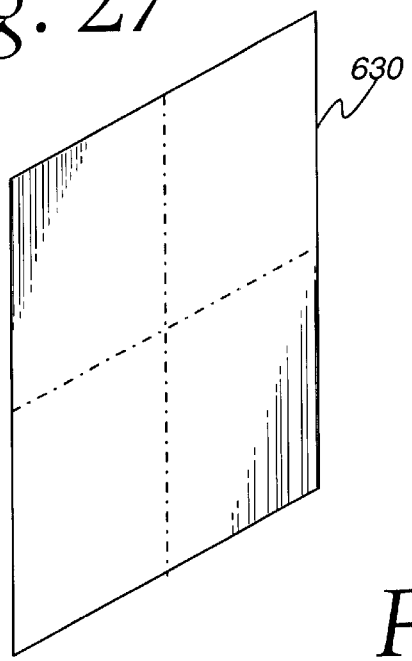
FIG. 27 is a perspective view of an unfolded signature having eight pages.
Figure 28:
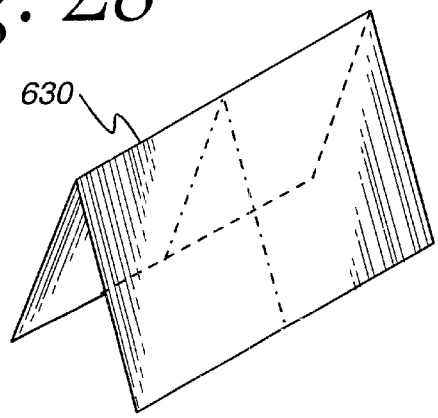
FIG. 28 is a perspective view of the signature illustrated in FIG. 27 after one fold.
Figure 29:
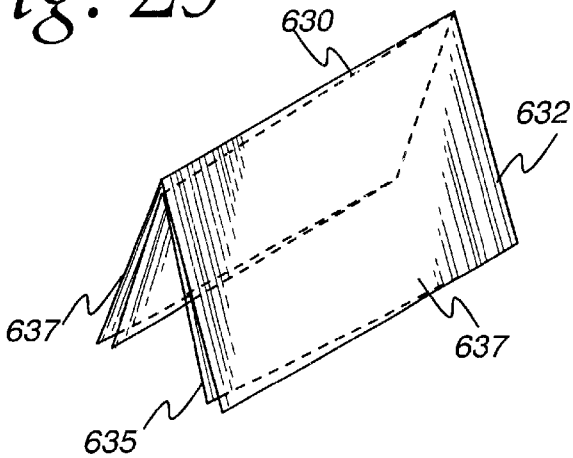
FIG. 29 is a perspective view of the signature illustrated in FIG. 27 after two folds.

FIGS. 27, 28 and 29 show a sequence for formation of a signature 630 having two centerfold pages 635 and two outside pages 637 for a total of eight pages. One must realize, of course, that a signature can have any number of pages, with a typical number being thirty-two pages. As illustrated in FIG. 26, the two outside pages 637 of the signature last delivered onto the conveyor chain 612 may form the cover pages 633 of the book of signatures 629. The remainder of the signature pages will be inside pages 631 of the book of signatures 629.

Figure 30:
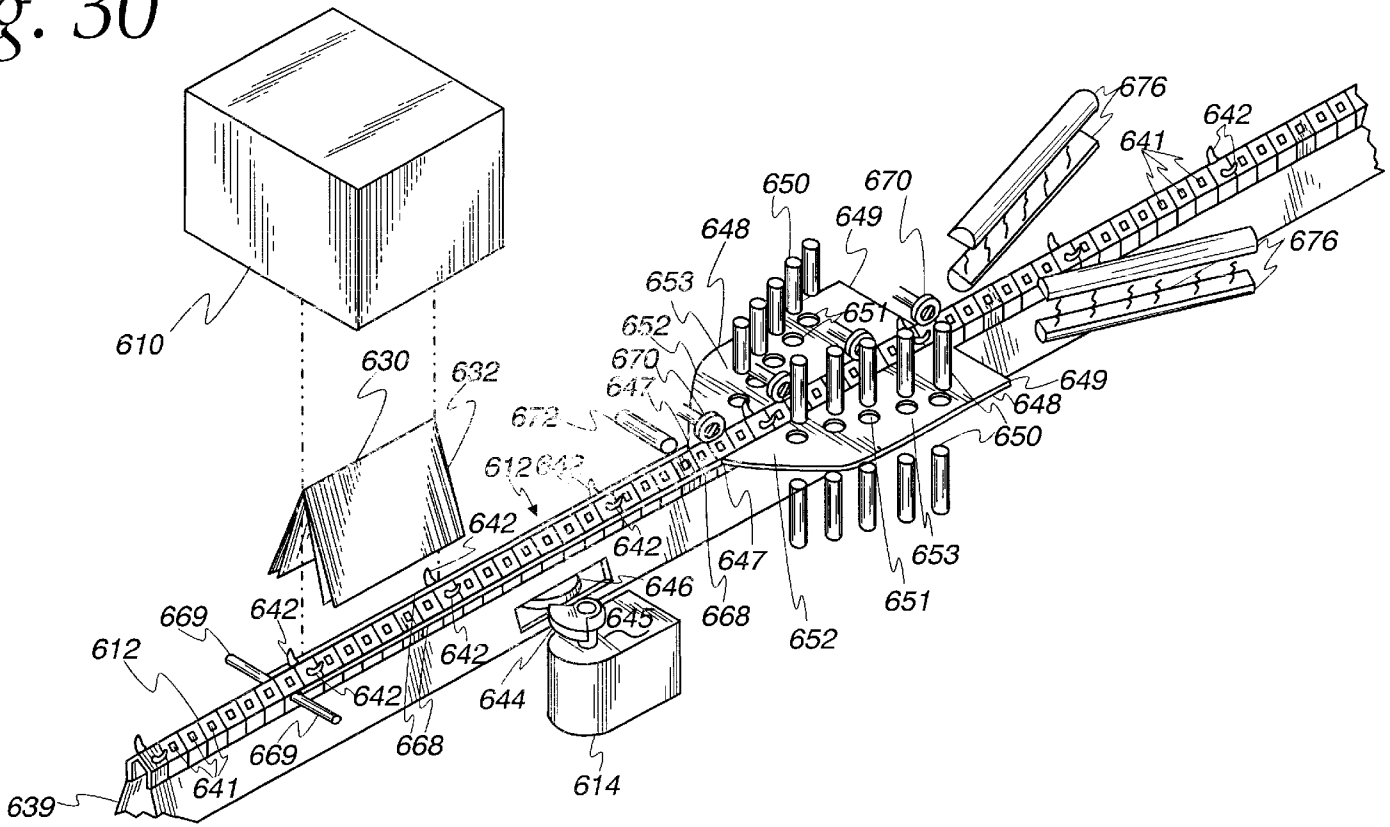
FIG. 30 is a fragmentary perspective view of a side-by-side mounting of plate-like members and adjacent portions of a signature printing system.
Figure 31:
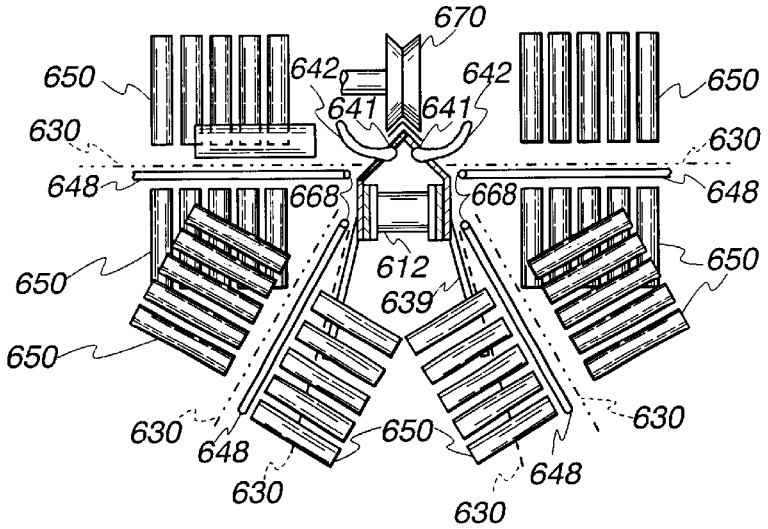
FIG. 31 is a sectional view of a fan mounted plate-like member having the printing platen portions extended to allow space for the printer heads.

The conveyor chain 612 of the present invention may be a sprocket chain conveyor of the type well known to the prior art. The conveyor chain 612 as illustrated in FIG. 30 normally has a skirt-like member 639 projecting downward therefrom. The conveyor chain 612 is driven by a conventional chain sprocket drive shaft 640 diagrammatically shown in the system block diagram of FIG. 25. As illustrated in FIG. 30, the conveyor chain 612 contains several lugs 642 attached thereto. At equally spaced locations along the conveyor chain 612, pairs of lugs 642 are removably mounted in apertures 641 in the conveyor chain 612 as illustrated in FIG. 31. The lugs 642 project above the conveyor chain 612 thereby preventing the signatures 630 from slipping on the conveyor chain 612 as they are moved along. The pairs of lugs 642 are equally spaced from one another, such that every two pairs of lugs 642 define a location on the conveyor chain 612 where the signatures 630 are to be progressively delivered so as to build books or collections of signatures 629. While the lugs 642 are equally spaced for a given run, the spacing between lugs 642 will be adjusted between runs depending on the size of the books of signatures 629 to be printed by removing the lugs 642 from apertures 641 and inserting the lugs 642 in apertures 641 spaced a desirable distance apart.

The movement of the conveyor chain 612 is monitored by a lug detector 643 (FIG. 25) mounted adjacent the conveyor chain 612. The lug detector 643 may be any suitable photocell which sends an interrupt to the computerized control system when a lug 642 is detected. The lugs 642 and lug detector 643 enable the computerized control system to monitor where the various books of signatures 629 are located during the printing process at any give time by keeping track of the conveyor chain 612 movement. It should be understood that several separate chains and associated sprocket drive shafts may be provided throughout the entire system, so as to effectively form a continuous conveyor chain 612.

As is illustrated in FIG. 30, the caliper 614 is mounted adjacent to the conveyor chain 612 upstream of the printing station 616 (FIG. 25) and is utilized to detect books of signatures 629 which have an improper number of signatures 630 or pages 631, 633 (FIG. 26). The caliper 614 may be any suitable caliper utilized by the printing industry. The thickness of the books of signatures 629 is measured as the books of signatures 629 pass between a probe 644 of the caliper and a reference base 646. If the measured thickness of the books of signatures 629 is found to be unacceptable or out of tolerance an interrupt is sent to the computerized control system. The probe 644 of the caliper 614 is normally rotatably mounted about a shaft 645, the rotation of the caliper probe 644 being synchronized with the movement of signatures 630 along the conveyor chain 612. In FIG. 30 the skirt 639 is shown cut away between the reference base 646 and probe 644 to enable the measurements to be made.

Figure 32:
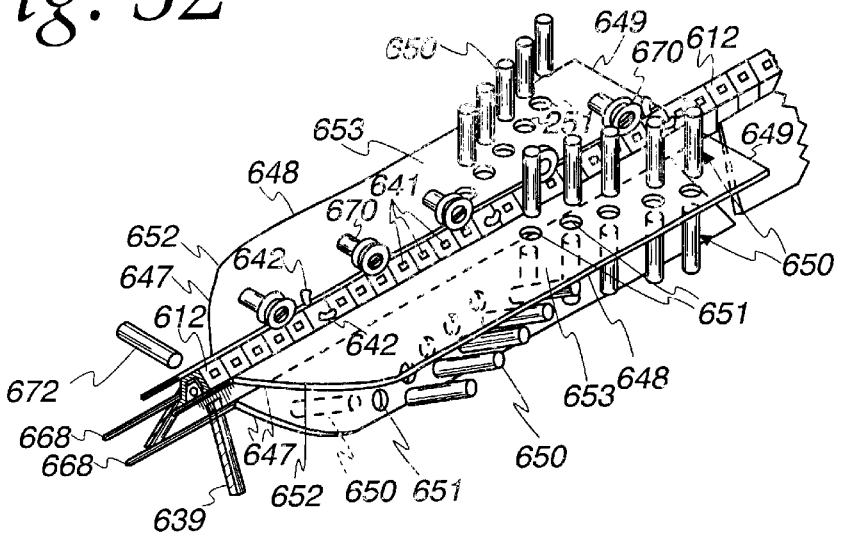
FIG. 32 is a perspective view of a fan mounted plate-like member having the printing platen portions extended to allow space for the printer heads.

As shown in FIGS. 30 and 32, the printing station 616 located downstream of the feeders 610 and caliper 614 includes printer heads 650 mounted adjacent relatively flat plate-like members 648, each of which is attached to a wire 668 extending upstream adjacent the conveyor chain 612. Each plate-like member 648 is mounted adjacent the conveyor chain 612 and lies generally in a plane extending radially from a line defined by the path of the conveyor chain 612. Each plate-like member 648 has an upstream end 647 and a downstream end 649 and has a generally rectangular shape, although any suitable shape will do. The upstream end 647 is tapered in toward the conveyor chain 612 to form a plow portion 652. The plow portion 652 extends outward from the conveyor chain 612 to form a printing platen 653. It should be noted that although multiple plate-like members 648 are shown in FIGS. 30 and 32 being mounted adjacent the conveyor chain 612, the printing station 616 may have a single plate-like member 648 with associated printer heads 650.

As is illustrated in FIGS. 30 and 32, each plate-like member 648 has the wire 668 connected to an edge of the plow portion 652 adjacent the conveyor chain 612 at the upstream end 647 of the plate-like member 648. It should be understood that any elongated member can be used in place of the wire 668. The wire 668 extends generally parallel to and adjacent the conveyor chain 612 upstream from the plate-like member 648 to a location just beyond but adjacent one of the feeders 610 feeding the signatures 630, such that the signatures 630 delivered therefrom and from feeders downstream therefrom are delivered onto the conveyor chain 612 over the wire 668. The wire 668 is attached at its upstream end to a retaining structure 669 which retains the wire in place. Note that in FIG. 31 wire 668 is shown slightly removed from the conveyor chain 612, thereby forming a space between the wire 668 and the conveyor chain 612, so those signatures 630 delivered onto the conveyor chain 612 upstream of the wire 668 will be conveyed by the conveyor chain 612 under the wire 668. Those signatures 630 delivered onto the conveyor chain 612 downstream of the wire 668 will be conveyed over the wire 668. Therefore, as the books of signatures 629 are progressively built up, some of the pages 631, 633 will be positioned over the wire 668. In this fashion, the wire 668 is able to accumulate the signatures 630 where the books of signatures 629 are to be opened by the plate-like member 648. In the case where there are a plurality of plate-like members 648, each having a wire 68 attached, each wire 668 may extend upstream adjacent the conveyor chain 612 to differing locations adjacent the feeders 610 such that different signatures 630 are accumulated by the wires 668 from a plurality of feeders 610.

When the books of signatures 629 which include signatures 630 delivered over the wire 668, are conveyed past plate-like member 648, the plate like-member 648 cooperates with the conveyor chain 612 and wire 668 to move a page of the accumulated signature out of superpositioned relationship with a signature delivered to the conveyor just prior to the delivery of the accumulated signature and thereby open the books of signatures 629 at the signature 630 accumulated for opening by the wire 668 to expose an inside page of the book of signatures. The plow portion 652 lifts the pages 631, 633 of the books of signatures 629 delivered over the wire 668 onto the printing platen 653 while the pages 631, 633 of the books of signatures 629 not delivered over the wire 668 are left hanging substantially vertically from the conveyor chain 212, thereby forming two groups of pages 631, 633 located in planar positions arcuately spaced from each other and each extending approximately radially from a line defined by the path of travel of the conveyor chain 612 past the plate-like member 648. Note that those pages 631, 633 not over the wire 668 include those pages 631,633 physically under the wire 668 between the wire 668 and the conveyor chain 612 and those pages hanging from the other side of the conveyor chain 612 as shown in FIG. 31. The pages 631, 633 lifted by the plow portion 652 are retained in a planar position which is roughly parallel to the plate-like member 648 and which extends generally radially from a line defined by the path of travel of the conveyor chain 612 as the conveyor chain moves the pages 631, 633 over the surface thereof. A plurality of the plate-like members 648 enable each book of signatures 629 to be opened at a plurality of certain signatures 630 as each book of signatures 629 is conveyed past the plate-like members 648.

The signatures 630 are retained on the conveyor chain 612 in their open condition by rollers 670, illustrated in FIGS. 30 and 32, mounted above the conveyor chain 612. The rollers 670 bias the binding of the books of signatures 629 downward against the conveyor chain 612 so as to offset any tendency the books of signatures 629 might have to be lifted upward from the conveyor chain 612.

Figure 33:
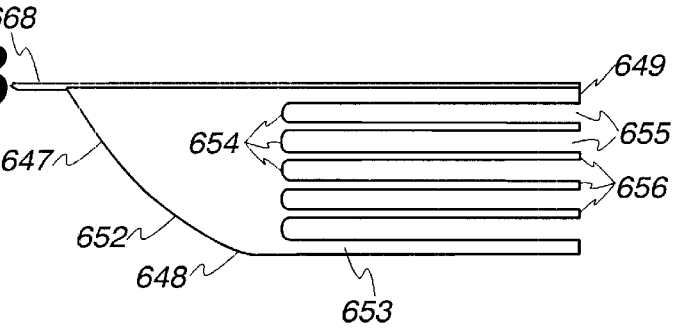
FIG. 33 is a plan view of a plate-like member having multiple elongated apertures.
Figure 34:
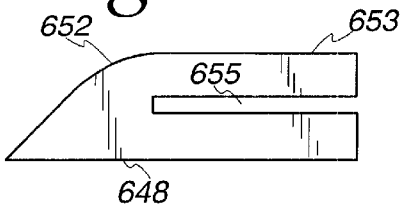
FIG. 34 is a plan view of a plate-like member having a single elongated aperture.
Figure 35A:
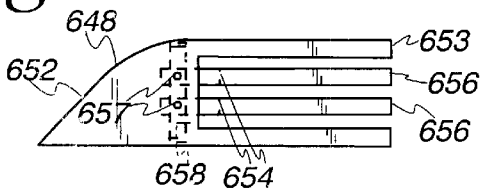
FIGS. 35A–D are varying views of a plate-like member having adjustable appendages.
Figure 35B:
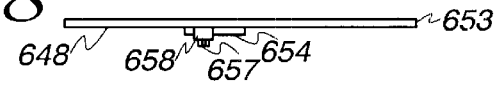
Figure 35C:
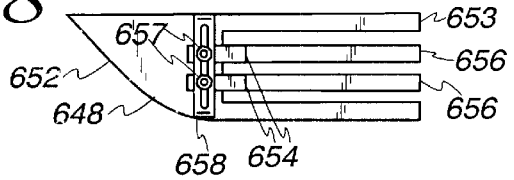
Figure 35D:
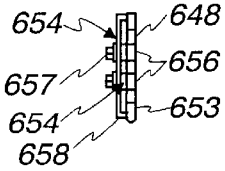

The printing platen 653 has apertures 651 therein to allow printing by the printer heads 650 mounted below the printing platen 653 on pages 631, 633 as they are moved over the surface of the printing platen 653. Although the apparatus 651 are shown as cylindrical openings in FIGS. 31 and 32, the apertures 651 may take on other various shapes and arrangements as is illustrated in FIGS. 33–35D. As is shown in FIG. 33, the apertures 651 frequently take the form of elongated apertures 655 formed by a plurality of elongated appendages or fingers 656 extending roughly parallel the conveyor chain 612 to the downstream end 649 of the printing platen 653. The apertures 655 are preferably open at the downstream end 649 so that the freshly printed ink is not smeared by the surface of the printing platen 653. While there are four fingers 656 shown in FIG. 33, there may be any number of fingers 656. As illustrated in FIG. 34, there is only one elongated aperture 655. As shown in FIGS. 35A–D, there are two adjustable fingers 656. The fingers 656 each may be made adjustable in any number of ways and in FIGS. 35A–D are shown as each being attached to the top surface of an elongated rectangular splice plate 654. The splice plates 654 are slidingly attached via bolts 657 to a slotted support member 658 attached to the bottom of the printing platen 653 such that the fingers 656 are adjustable radially from the conveyor chain 612.

The printing platen 653 with its apertures 651 allows printer heads 650 to be mounted below the printing platen 653 in alignment with the apertures 651 or 655 to enable printing on a centerfold page 635 of a selected signature 630 facing and immediately adjacent the printing platen 653 as the pages 631, 633 are conveyed by the conveyor over the plate-like member. In addition, the printer heads 650 can be mounted above the printing platen 653 so as to be capable of printing on the outside pages 637 of a signature 630. The plate-like member 648 thus enables the near simultaneous printing of two or more pages, such as the inside page 631 and the cover page 633, of a book of signatures 629.

Figure 36:
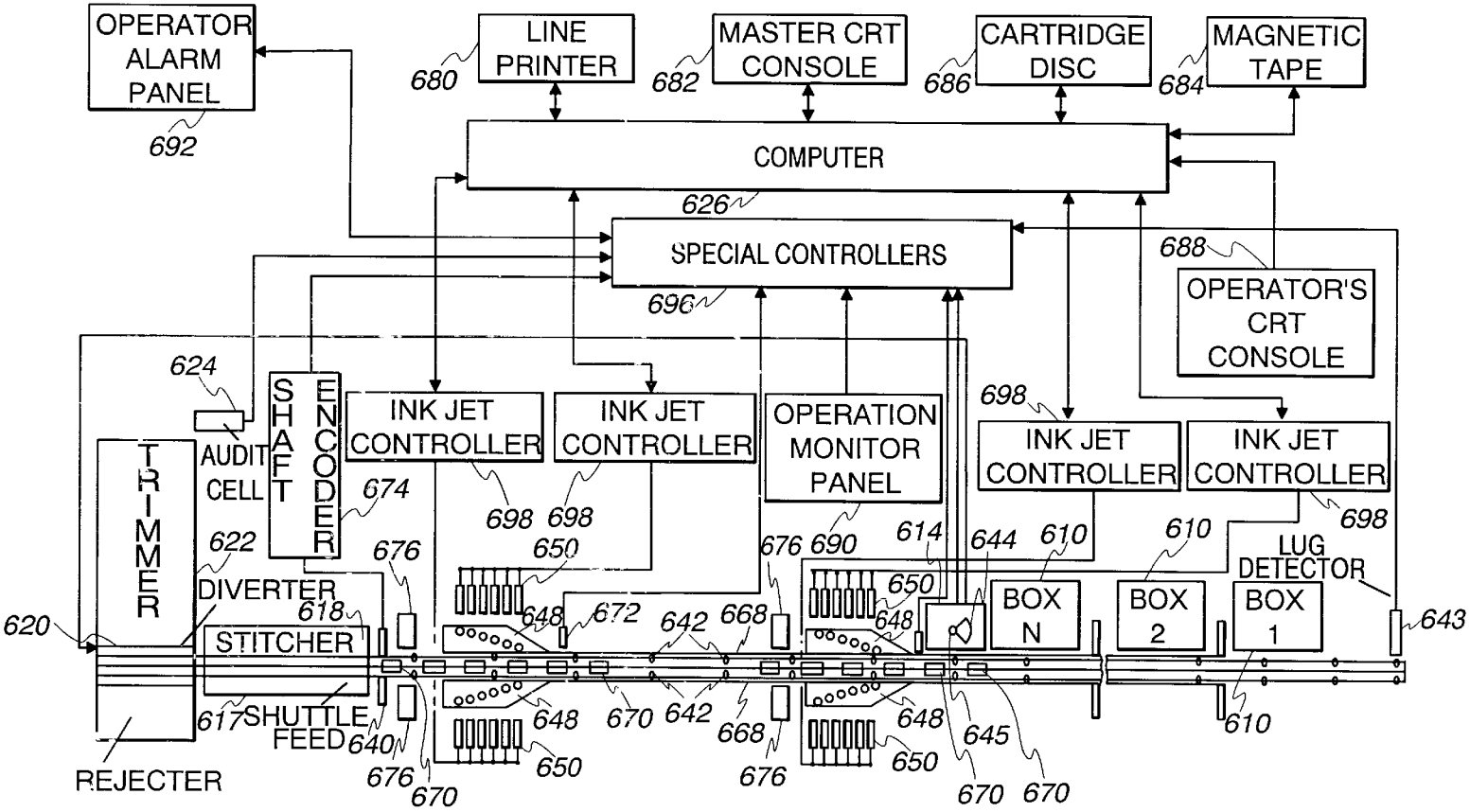
FIG. 36 is a block diagram of the signature collating and binding system of FIG. 25 utilizing side-by-side and tandem mounting of plate-like members.

As is shown in FIGS. 25 and 36, another plate-like member 648 can be mounted adjacent the conveyor chain 612, opposite of the above mentioned plate-like member 648 at the same longitudinal location along the conveyor chain 612 to enable the printing of another centerfold page 635 and outside page 637 of the same signature 630 or of a different one. In addition, printer heads 650 can be mounted horizontally underneath the plate-like members 648 to print on the outside pages 637 of the signatures 630 hanging in a substantially vertical plane on the conveyor chain 612 unopened. Should it be necessary to print on more pages 631, 633, additional plate-like members 648 could be fan mounted about the conveyor chain 612 as illustrated in FIG. 32. The number of plate-like members 648 which can be fan mounted will depend on the size and arrangement of the printer heads 650 utilized.

If the plate-like members 648 become so numerous in a fan mounting configuration so as to not allow room to mount the printer heads 650, the plate-like members 648 can be staggered or mounted tandemly along the conveyor chain 612, as is illustrated in FIG. 36, or the printing platens 653 of the fan mounted plate-like members 648 could be extended in length, as is illustrated in FIG. 32, such that the printer heads 650 need not be mounted directly above and below each other but can be longitudinally off-set from each other along the printing platen 653. This is illustrated in the end view shown in FIG. 31, where four plate-like members 648 with extended printing platens 653 are utilized to provide the capability to print on eight pages 631, 633 of each book of signatures 629. The various configurations of the plate-like members 648 enable a virtually unlimited number and combination of pages 631, 633 of each book of signatures 629 to be printed.

Figure 37:
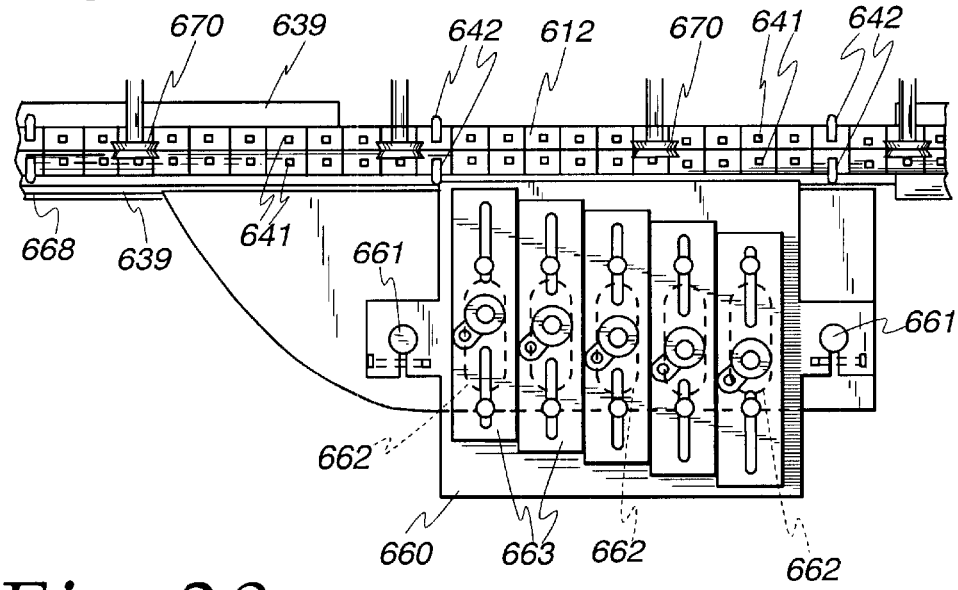
FIG. 37 is a fragmentary plan view of a printing station mounting structure.
Figure 38:
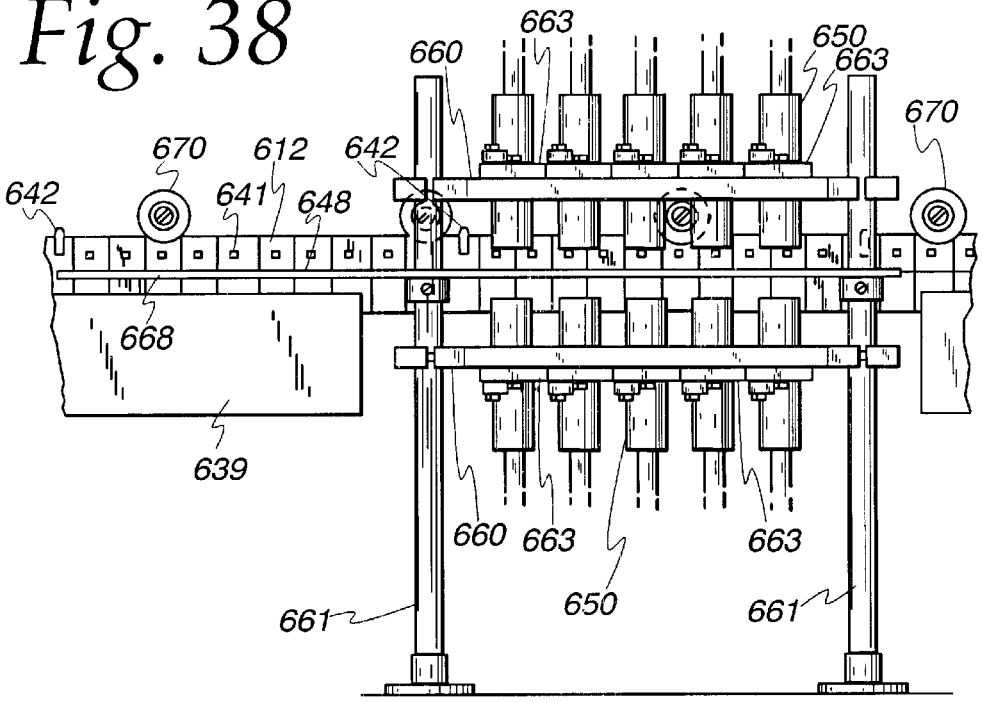
FIG. 38 is a side view of the printing station mounting structure of FIG. 37.
Figure 39:
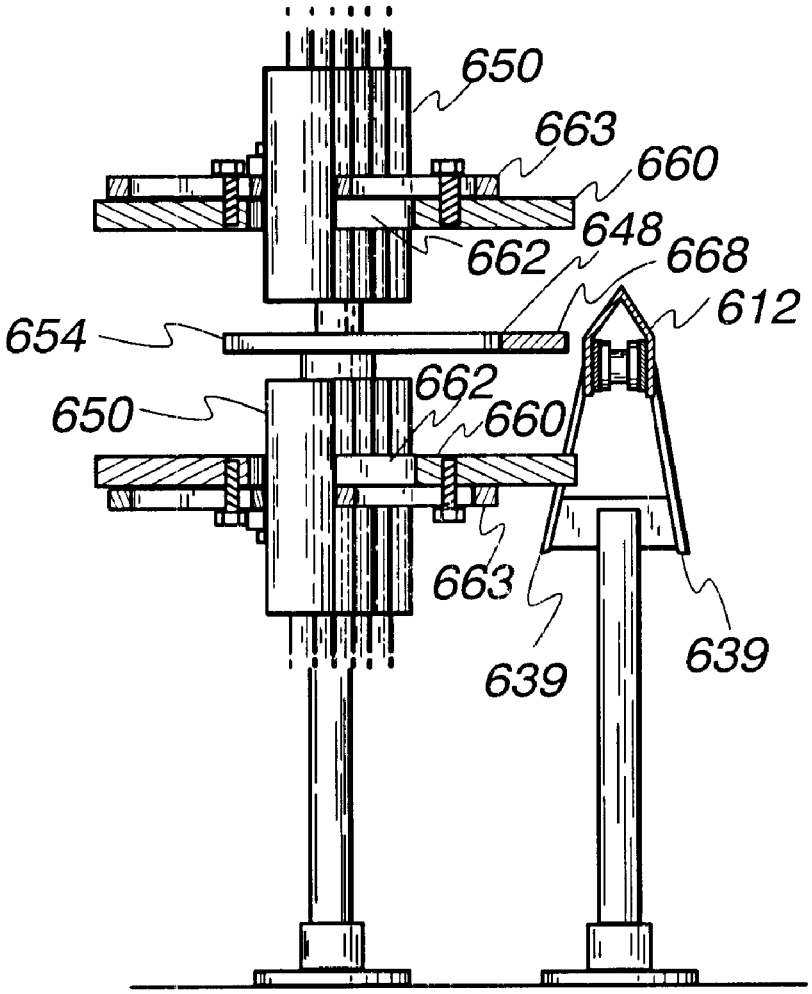
FIG. 39 is an end view of the printing station mounting structure of FIG. 38.

The plate-like member 648 may be supported adjacent the conveyor chain in any suitable manner, the method of mounting being obvious to those skilled in the art. Illustrated in FIGS. 37–39 is an example of a mounting structure constructed and arranged to support the plate-like member 648 and the associated printer heads 650 for printing on two pages, such as an inside page 631 and a cover page 633, of a book signatures 629. Plate-like member 648 is shown as being supported by vertically upright mounting standards 661. The mounting standards 661 are shown supporting printer head mounting plates 660 above and below said plate-like member 648. The printer head mounting plates 660 contain elongated apertures 662 therein so as to enable the printer heads 650 to extend vertically through the plates so as to be in close proximity to the plate-like member 648 and to enable the printer heads 650 to be adjustable radially from the conveyor chain 612. The printer heads 650 are attached to sliding members 663 positioned on the mounting plates 660 at varying distances from the conveyor chain 612.

The printer heads 650 are desirably of a dot matrix non-contact type. The printer head 650 of the dot matrix type are positioned adjacent the plate-like member 648 so as to be able to selectively print dots in a matrix to form characters on an inside page 631 or an outside page 633 or any combination thereof of the books of signatures 629 as the conveyor chain 212 conveys each book of signatures 629 past the plate-like member 648.

More particularly, the printer heads 650 are desirably of the ink jet type well known in the art and utilized in U.S. Pat. No. 4,121,818. As the signatures 630 move past the printer heads 650 matrices of dots are selectively printed by projecting droplets of ink along a direction transverse to the direction of movement of the conveyor chain 612, thereby creating alphanumeric characters on the pages 631, 633 of each book of signatures 629 as conveyed past printer heads 650. Each plate-like member 648 will usually have a number of printer heads 650 which equals the number of lines of information to be printed as the book of signatures 629 is conveyed past the plate-like member 648 since each printer head 650 is capable of printing one line of information. Operation and control of the printer heads 650 is well known to the art. As illustrated in FIG. 25, positioned immediately upstream of the plate-like member 648 is a leading edge detector 672 for detecting the leading edge 632 of books of signatures 629 as they arrive at the printing station 616. The detector 672 may be any suitable photocell. The leading edge detector 672 sends an interrupt to the computerized control system whenever a leading edge 632 is detected.

A shaft encoder 674 driven by the conveyor chain sprocket drive shaft 640, which is diagrammatically illustrated in FIG. 25, detects the movement of the conveyor chain 612 and together with the leading edge detector 672 is utilized by the computerized control system for proper spacing and indexing of characters printed on the books of signatures 629. Shaft encoders and their uses are well-known to the art.

As shown in FIG. 30, strip heaters or dryer 676 are mounted adjacent the printing station 616 to assure quick and efficient drying of the ink by direct and reflected infra-red techniques. Preferably the dryers 676 are mounted adjacent the elongated apertures 655 of the printing platen 653 as illustrated in FIG. 34 so the fresh ink is dried as the pages 631, 633 move along the elongated apertures 655.

As shown in FIG. 25, after the ink is dried, shuttle feed 617 feeds the signatures 630 past a stitcher 618 which stitches the binding of the books of signatures 629. A diverter 620 transfers books of signatures 629, when so notified by the caliper 614, to contain an improper number of signatures 630 to a rejector 621. Books of signatures 629 which are found to have a proper number of signatures 630 are diverted to a trimmer 622 for trimming. The shuttle feed 617, stitcher 618, diverter 620, rejector 621, and trimmer 622 are all well known to the art of printing and any suitable embodiment may be utilized.

An audit cell 624 senses and notifies the computerized control system, after the trimming process is complete, whether or not there are any books of signatures 629 missing from the assembly line just prior to stacking for mailing. The audit cell 624 sends an interrupt to the computerized control system if a book of signatures 629 is determined to be present. If any books of signatures 629 are found to be missing, the control system reprints the information contained in those books of signatures 629. The audit cell 624 thus serves as a final automated check of whether any books of signatures 629 are missing for any reason, such as being removed after being cut up by the trimmer 622, thereby assuring as nearly as possible that all subscribers will receive a book of signatures 629. The audit cell 624 may be of any suitable photocell type.

The Control System for System 600

Figure 40:
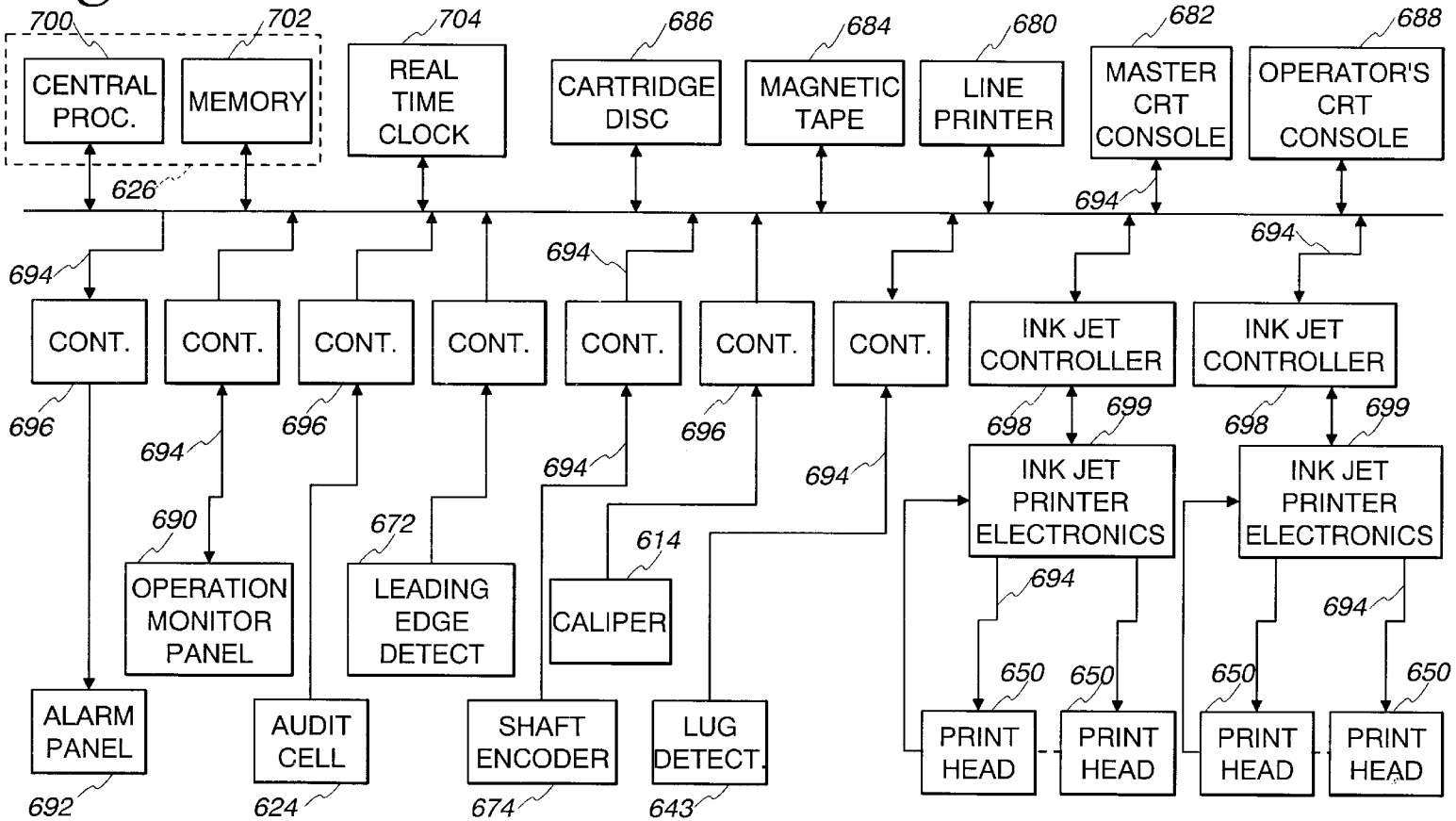
FIG. 40 is a block diagram of a computerized control system for a signature collating and binding system in accordance with the invention.

It is contemplated that the non-selective signature printing system 600 will be monitored and controlled by a computerized control system, a preferred embodiment of which, as is illustrated in FIGS. 25 and 40, includes the following elements or equivalents thereof: a programmed general purpose computer 626, a line printer 680, a master CRT console 682, a magnetic tape storage device 684, a disc storage device 686, an operator CRT console 688, an operation monitor panel 690, an alarm panel 692, associated communications lines 694 between the programmed general purpose computer 626 and the various elements of the signature printing system (audit cell 624, leading edge detector 672, shaft encoder 674, caliper 614, and lug detector 643), various special controllers 696, ink-jet printer controllers 698, and ink-jet printer electronics 699.

In general, the computerized control system 600 performs the following functions during system operations:

a. monitors where the books of signatures 629 are at in the signature printing process via the lug detector 643 which detect conveyor chain 612 movement;
b. monitors whether the books of signatures 629 contain a proper number of pages 631, 633 via the caliper 614;
c. initiates printing at the printing station 616 of books of signatures 629 which contain a proper number of pages 631, 633;
d. inhibits printing of books of signatures 629 determined to contain an improper number of pages 631, 633 by the caliper 614;
e. initiates printing, on the next sequential book of signatures 629 found to contain a proper number of pages 631, 633 of the information which is not printed on the faulty book of signatures 629;

f. prints a mail distribution change mark on the books of signatures 629 when a mail distribution change occurs.

g. monitors via the audit cell 624 the presence or absence of books of signatures 629 prior to stacking of the books of signatures 629 for mailing;

h. reprints the information and mailing information contained by the books of signatures 629 found to be missing by the audit cell 624 if so desired;

i. notifies via the alarm panel 692 when the system is approaching an end of run, when there is an end of run, when a mail distribution change has occurred and a book of signatures 629 so marked is determined to be present by the audit cell 624, when a mail distribution change has occurred but the book of signatures 629 containing the mail distribution change mark is determined to be missing by the audit cell 624;

j. presents detailed system status at the operation monitor panel 690;

k. prints system status and job information at the line printer 680; and l. displays system status at master CRT console 682 and operator's CRT console 688.

Referring now to FIG. 40, the computer 626 may be any suitable commercially available computer which includes a central processor 700, and a memory 702 or the equivalent thereof. The central processor 700 enable execution of preprogrammed instructions which may be loaded into the memory 702 of the computer 626 from any suitable mass storage device such as magnetic tape 684. An external real-time clock 304 enables synchronization lines 694 enable communications between the computer 626 and the various sensors and devices of the signature printing system.

Subscriber information and mailing label information is prepared for storage on a mass storage medium which is capable of being accessed by the computer 626. In the preferred embodiment of the present invention, the magnetic tape storage device 684 is utilized to store the subscriber information. The mass storage medium is prepared by any one of many common well-known data processing techniques wherein subscriber information is stored according to a pre-determined machine readable format.

The computerized control system can operate on the stored subscriber information in several different ways depending on the particular system structure, (i.e., computer, printers, consoles, etc.), and programming utilized. Various computerized control system arrangements can be utilized, the system disclosed herein being but one of an endless variety of choices for implementing control of the signature printing system.

In the preferred embodiment, the disc 686 is used to store subscriber information which must be reprinted due to books of signatures 629 found to be missing by the audit cell 624. When a book of signatures 629 is detected as missing, the computerized control system will determine what information had been printed on the missing book of signatures 629 and will store that information on the disc 686. At the end of a run after having printed the subscriber information contained on magnetic tape 684, the computerized control system will check if there is any subscriber information on the disc 686 which needs to be reprinted. If there is, the computerized control system will print the information from the disc 686. Note that, as explained hereinafter, the operator has the option of selecting whether reprinting is to occur at the end of a run. Note also that the subscriber information to be printed during a given run might be on more than one tape.

In the preferred embodiment, the line printer 680 is used for hard copy print-out of signature printing system status and other information of interest to an operator. The operator can use this information for trouble-shooting and isolating system problems as well as determining signature printing system status at any given time. The line printer 680 can also be used for print-out of job information, e.g., customer name, number of signature books 629 printed, type of books of signatures 629 printed, etc.

The master CRT console 682 and operator's CRT console 688 enable operator input to the computer 626. In addition, the console 620, 688 are capable of displaying computer 626 output. The master CRT console 682 is located in close proximity to the computer 626 and used mainly for initializing and starting the computerized control system. The operator's CRT console 688 is located in close proximity to the conveyor chain 612 with its various stations and used mainly for displaying signature printing system status to the operator and for operator control of signature printing system operation once the computerized control system has been initialized and started.

In the preferred embodiment, the operation monitor panel 690 which is located in proximity with the computer 626 is normally used for trouble shooting purposes as it displays detailed system status via various indicators.

The alarm panel 692 is located next to the conveyor chain 612 with its various stations and is used for providing various visual and audio alarm indications such as approaching the end of a run, end of run, mail distribution change and a book of signatures 629 so marked with a mail distribution change mark is present, and mail distribution change but the book of signatures 629 so marked is missing. Note that while only one alarm panel 692 is shown in FIG. 25, there may be several scattered throughout the system.

The special controllers 696 and ink-jet controllers 698 along with the ink-jet electronics 699 enable the computerized system to interface with the various elements of the signature printing system by providing for the proper formatting and timing of information transfer on the communication lines 694. As illustrated in FIGS. 25 and 40, there is an ink-jet controller 698 and associated ink-jet printer electronics for each set of printer heads 650, the operation and control of which being well known in the art. Each ink-jet controller 698 and associated ink-jet printer electronics 699 is typically capable of controlling up to six individual printer heads 650. In FIG. 40, a dashed line is drawn between printer heads 650 to indicate from one to six heads per controller 698. Note that while the communication lines 694 are drawn as one line, they may actually represent several wires or cables.

Prior to initiating the computerized control system, a preformatted tape containing subscriber information is placed on the magnetic tape storage device 684. An operator at the master CRT console 682 then positions the tape via computer program control or manually so it is ready for access by the computer 626.

After starting the computer program the operator enters various parameters from the master CRT console 682 which are necessary for proper initialization of the computer program. Examples of parameters the operator must enter prior to starting a signature printing system run are as follows:

(a) the number of books of signatures 629 before the end of a run that the approaching end of run alarm is to be sent to the alarm panel 692;

(b) whether books of signatures 629 found missing by the audit cell 624 are to be reprinted;

(c) how the subscriber information is formatted and located on the preformatted tape, (e.g., which information fields are allocated to subscriber name, street number, town, etc.);

(d) the number of lugs 642 between the caliper 14 and printing station 616;

(e) the number of lugs 642 between the printing station 16 and audit cell 624;

(f) whether double label information is to be printed on book page 631, 633;

(g) the run identifier and description;

(h) number of ink-jet controllers 698 to be used;

(i) nature of information to be printed by each ink-jet controller 698; and (j) how far offset from the leading edge 632 of a signature book 629 information is to be printed.

Note, the above are but some examples of the type of system parameters which are necessary for system initialization and should not be considered as limiting the extent of operator parameter entries as this will vary from system to system.

Figure 41:
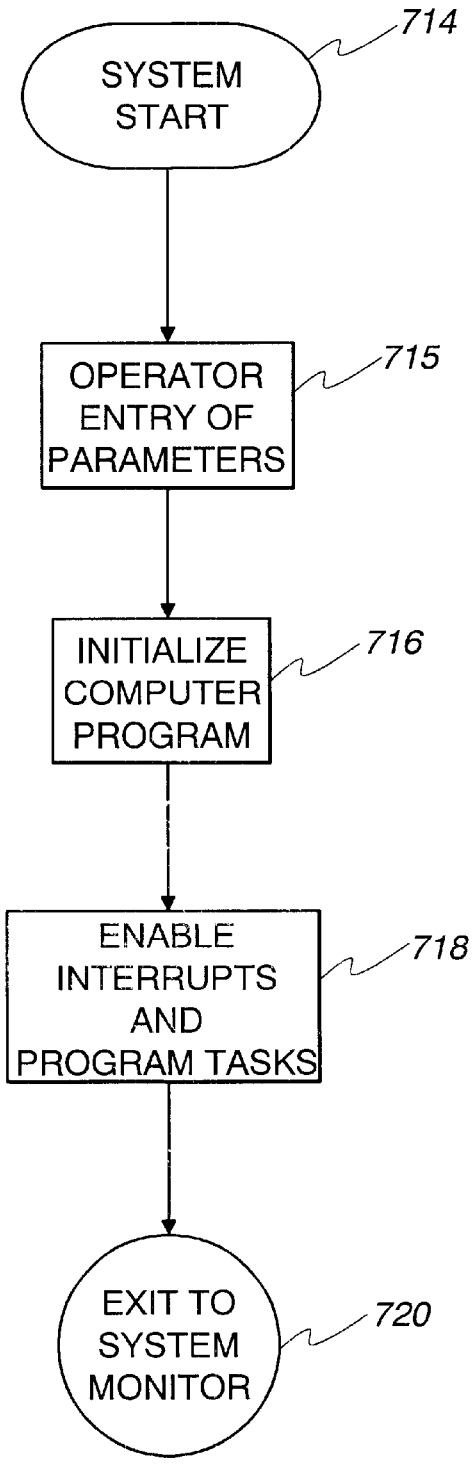
FIG. 41 is a logic flow diagram for start-up of the computer program.

As illustrated in FIG. 41, after the operator has started the computer program at block 714 and has entered various system parameters at block 715, the computer program initializes its data stores; i.e., arrays, tables, counters, variables, buffers, etc. as indicated at block 716. The computer program then enables interrupts from the various signature printing system sensors and devices and initializes program tasks or functions.

The computer program has a number of standard tasks for executive, supervisory, utility, communication, and other various tasks in addition to the tasks for controlling the signature printing system. The operation of the standard tasks is well-known to those skilled in the art. For clarity, only certain aspects of the logical flow paths associated with the tasks for controlling the signature printing system will be described in detail herein, the other alternatives and possibilities in the logic flow paths being apparent. The program tasks for controlling the signature printing system for ease of explanation and clarity have been broken down into four programmed tasks labeled master queue, print manager, digital IO manager, and audit manager as illustrated in FIGS. 35A–D and 40–42B and described in more detail hereafter.

It will be appreciated, however, by those skilled in the computer art that other logic arrangements may be employed to achieve the functional results of the present invention. When not performing the various tasks, the computer program returns to a system monitor task as indicated by block 720, which is a standard executive housekeeping task. In the system monitor task, the computer program 626 monitors the various activities of the computerized control system by responding to interrupts and initiating program tasks as necessary.

Figure 42A:
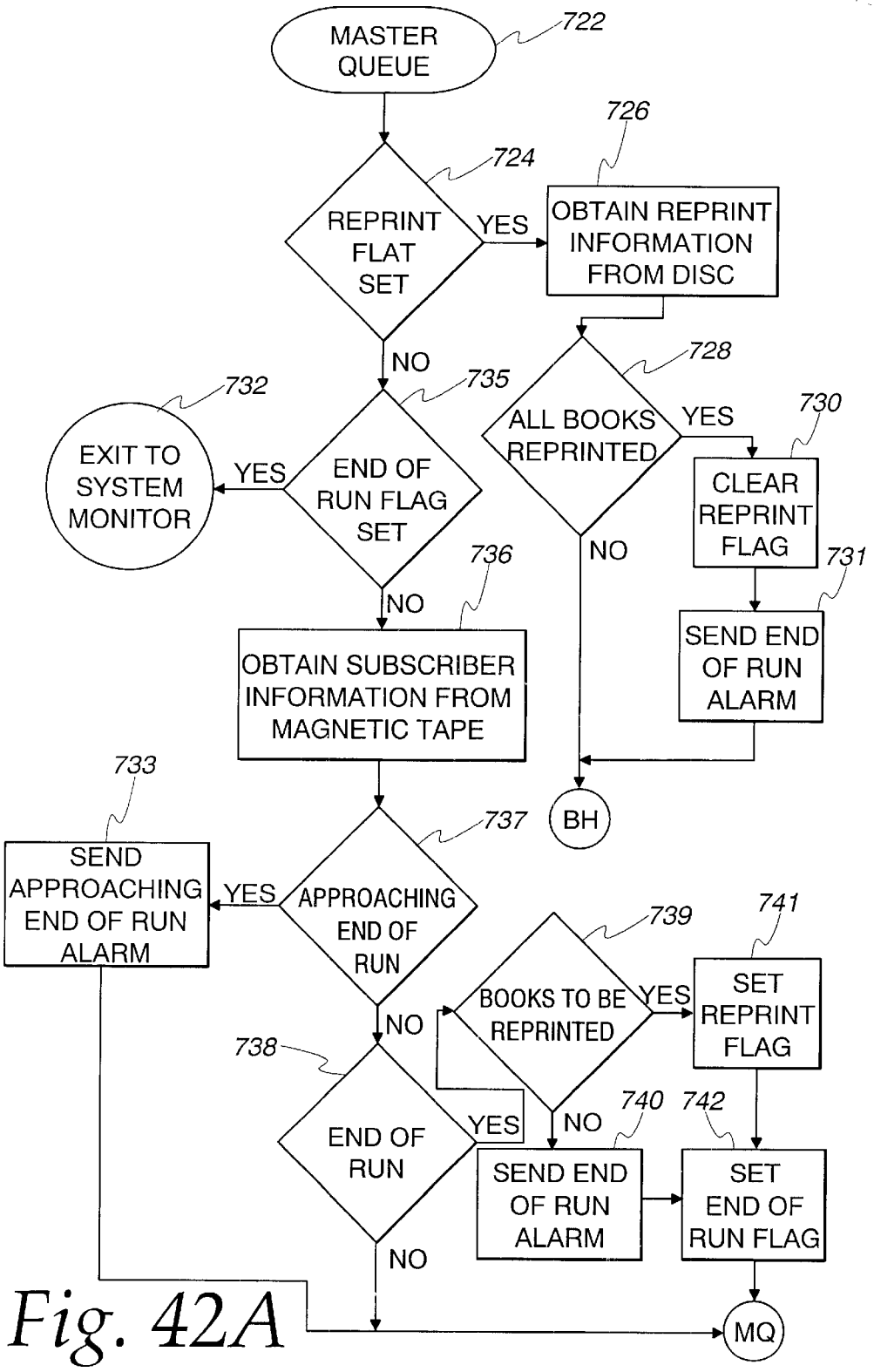

As illustrated in FIGS. 42A–B, the master queue task starting at block 722 reads the subscriber information off the magnetic tape 684 or disk 686 and reformats the information for printing. Note that the logic flow is illustrated by arrowed lines. In certain of the other tasks it is not feasible or possible to illustrate the logic flow interconnected by arrowed lines, e.g., where the logic flow extends onto another page, so logic flow connectors indicated by encircled letters are utilized to indicate the logic flow in such instances. After reformatting the information, the master queue task places the information in an area of main memory 702 referred to as the master queue 900 diagrammatically illustrated in FIG. 46.

Figure 46:
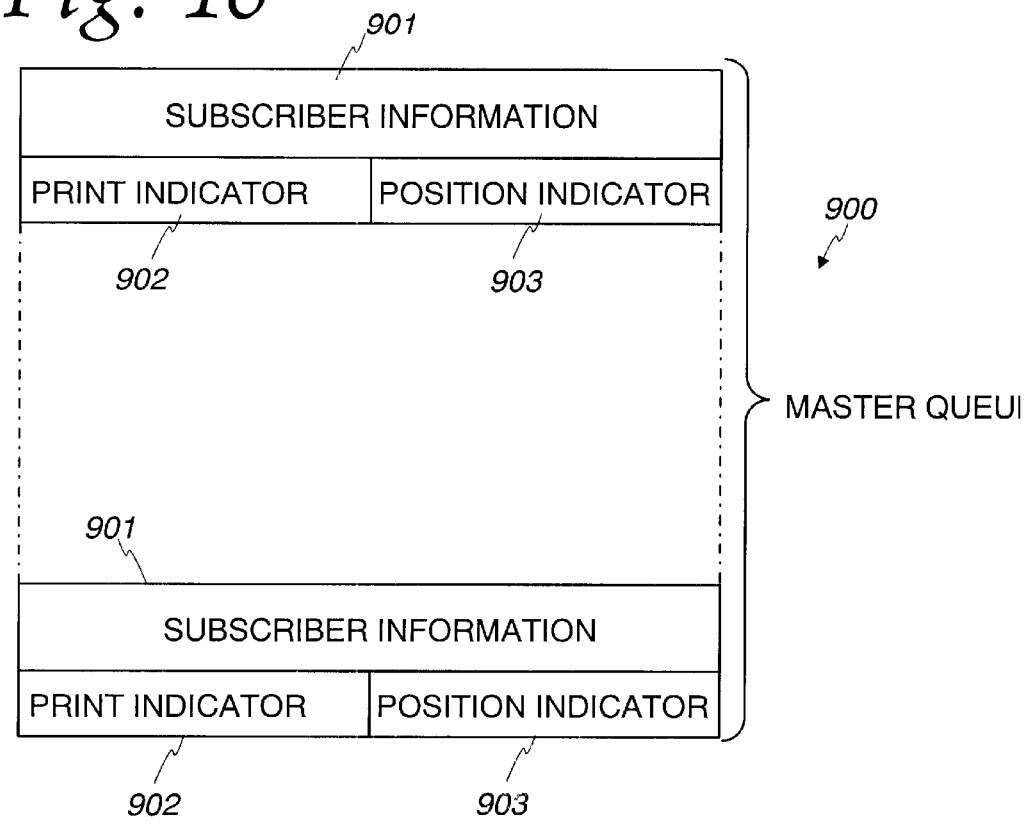
FIG. 46 is a diagramatic representation of the master queue in memory.
Figure 47:
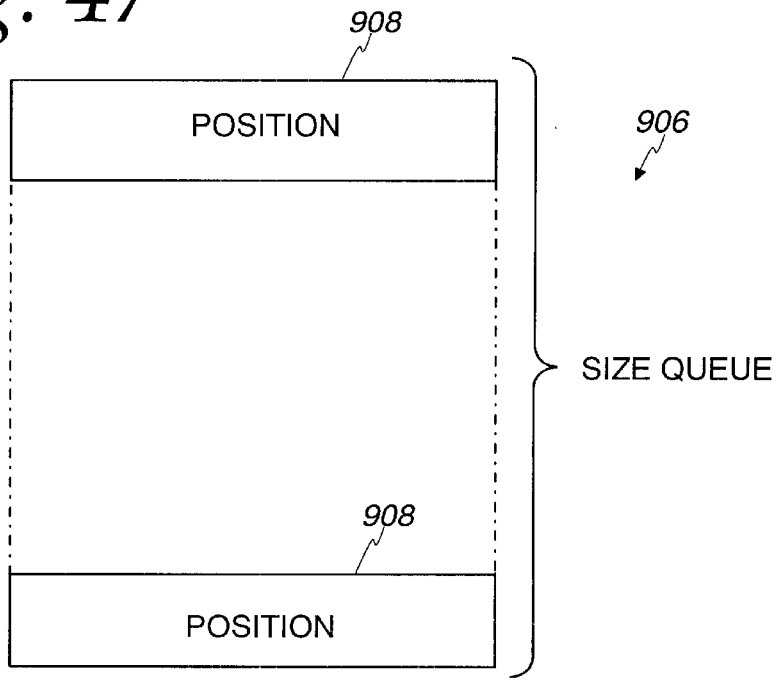
FIG. 47 is a diagramatic representation of the size queue in memory.

The master queue 900 is the area of memory 702 in the computer 626 where the subscriber information for each signature book 629 is stored for access by the print manager task after being loaded into memory 702 from magnetic tape 684 or disc 686. The print manager task accesses the master queue 900 when printing of books of signatures 629 occurs. In addition to a subscriber information field 901 containing the subscriber information to be printed on each book of signatures 629 and an identifying header, the master queue 900 contains other fields of information. As illustrated in FIG. 46, the master queue 900 contains a print field 902 and a position indicator field 903 for each set of subscriber information. As each book of signatures 629 is printed, the print indicator field 902 associated with the subscriber information field 901 is set indicating a book of signatures 629 is now on the conveyor chain 612 with this information. Once a book of signatures 629 is so printed, the associated position indicator field 903 is incremented by the digital I/O manager task whenever a lug 642 is detected by the lug detector 643. In this way, the computerized control system monitors how far along in the signature printing process the books of signatures 629 have progressed. AS mentioned earlier, one of the parameter entries made by the operator at system start-up is the number of lugs 642 between the leading edge detector 672 and the audit cell 624.

Thus, for example, if the operator indicated the audit cell 624 was thirty-seven lugs 642 from the leading edge detector 672, when the position indicator field 903 is incremented to 637 the computerized control system will know a printed book of signatures 629 containing the subscriber information in the associated subscriber information field 901 should be present at the audit cell 624. If the audit cell 624 doesn't detect a book of signatures 629 present at this location on the conveyor chain 612 and if the operator in his parameter entries indicated missing books of signatures 629 are to be reprinted, the subscriber information in the subscriber information field 901 is placed on the disc 686 to be reprinted and the subscriber information for the missing signature book 620 is deleted from the master queue 900.

If a book of signatures 629 is detected as being present by the audit cell 624, the subscriber information on that book of signatures 629 is deleted from the master queue 900 as there is no longer any need for retaining the subscriber information in the master queue 900. Note that it might be desirable to wait until the books of signatures 629 have traveled some distance beyond the audit cell, e.g., five lug 642 positions, before the subscriber information is removed from the master queue 900.

As indicated by decision block 724 in FIG. 42A, the master queue task checks a reprint flag to see if in the reprint mode, i.e., missing books of signatures 629 are currently being reprinted. If books of signatures 629 are being reprinted, then as indicated by block 726, the reprint information is obtained from the disc 686. At 728 a check is made to see if all the missing books of signatures 629, including those missing, have been completed. Next, as indicated by logic flow connector BH, regardless of whether reprinting is completed or not, an information header record identifying the formatted subscriber information is built at block 632, illustrated in FIG. 42B, after which the information with its header record is placed on the master queue at block 734 and then at 736 the program exits to the system monitor.

If at 724 the reprint flag was not set, indicating the master queue task is not in the reprint mode, a check is made at 735 to see if all the subscriber information has been obtained from the magnetic tape 684. If so, a return to system monitor occurs at 737. If any subscriber information remains on magnetic tape 694, it is obtained from the magnetic tape 684 at block 736. At 737 a check is made to see if approaching end of run. This check is made based on the parameter entry by the operator which indicates how many books of signatures 629 before the end of run the operator wants an alarm sent to the alarm panel 692. If approaching an end of run, at 739 the approaching end of run an alarm is sent to the alarm panel 692.

Next, as indicated via logic flow connector MQ, the tape data is reformatted for printing at 744. At decision block 746 a check is made for a change in mail distribution. If there is a mail distribution change, at 748 a mail distribution change mark is inserted in the reformatted subscriber information so it will be printed on the book of signatures 629 along with the subscriber information and the logic then follow along blocks 732 through 736. If there was no mail distribution change the computer program performs steps 732–736. The mail distribution change mark will indicate to the personnel sorting the books of signatures 629 for mailing that a new bundle, sack, or pallet is to be started.

If at decision block 737 it was determined the signature printing system was not approaching an end of fun, a check is then made at decision block 738 to see if all the subscriber information has been obtained from magnetic tapes 684. If it has, at 739 a check is made to see if the operator via parameter entries indicated that missing books of signatures 629 were to be reprinted. If books of signatures 629 are to be reprinted, at 741 the reprint flag is set and at 742 the end of run flag is set. If missing books of signatures 629 are not to be reprinted at 740, the end of run alarm is sent to the alarm panel 692 and then at 742 the end of run flag is set. Next, as indicated by logic flow connector MQ, steps 744 through 736 are performed in FIG. 42B.

Figure 43:
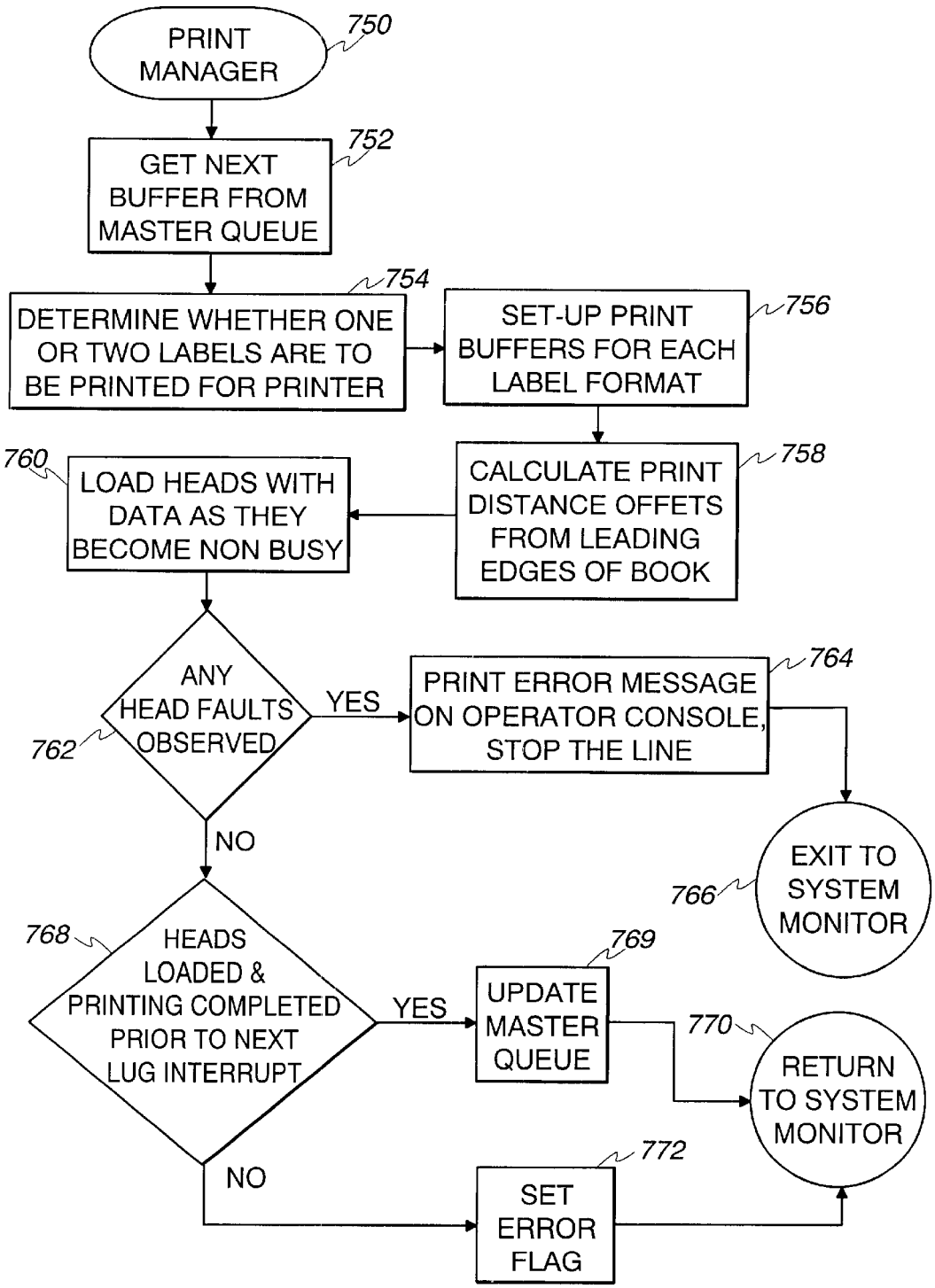
FIG. 43 is a logic flow diagram for the print manager program task.

As illustrated in FIG. 43, the print manager task controls the printing of subscriber information at the printing station 616. The print manager starts at block 750 and obtains the next subscriber information to be printed from the master queue at block 752. At 754, the print manager determines whether a duplicate set of subscriber information or double label is to be printed on a book page 631, 633. Note that this is one of the parameter entries made by the operator when the system is first started. At 756, the buffers for each label format are created for the printer heads 650. At 758, the offset distance from the leading edge of a book of signatures 629 is calculated based on the operator's parameter entry when the system is first started. At 760 the printer heads 650 are loaded with data as they become non-busy. A check is then made at 762 for any printer head faults. If a printer head fault is observed, an error message is printed at the operator console 688 and the signature printing system is stopped at 764. The print manager task then exits through the system monitor at 766.

If no faults were observed a check is next performed at 768 to see whether all the printer heads 650 are loaded and printing completed prior to the next interrupt being received from the lug detector 643. If all printing has been completed, 769 the print indicator field 902 of the master queue is set indicating the subscriber information in the subscriber information field 901 has been printed and then the print manager task returns to the system monitor at 770. If all printing is not completed prior to receipt of the next lug interrupt an error flag is set indicating the book of signatures 629 is not printed at 772. A return to the system monitor at 770 is then performed.

Figure 44A:
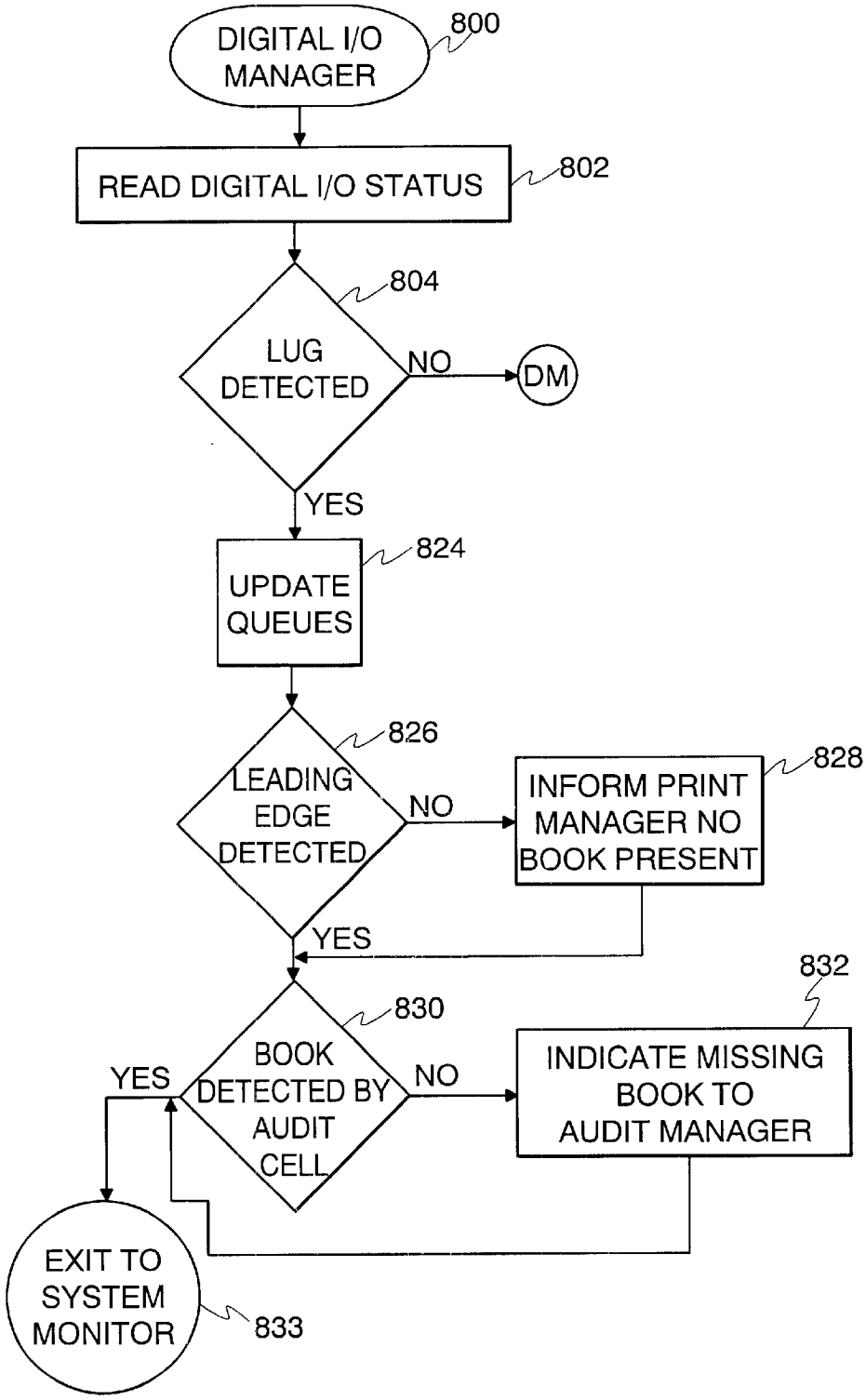
FIGS. 44A–B are logic flow diagrams for the digital I/O manager program task.
Figures 44, 44A, 44B:
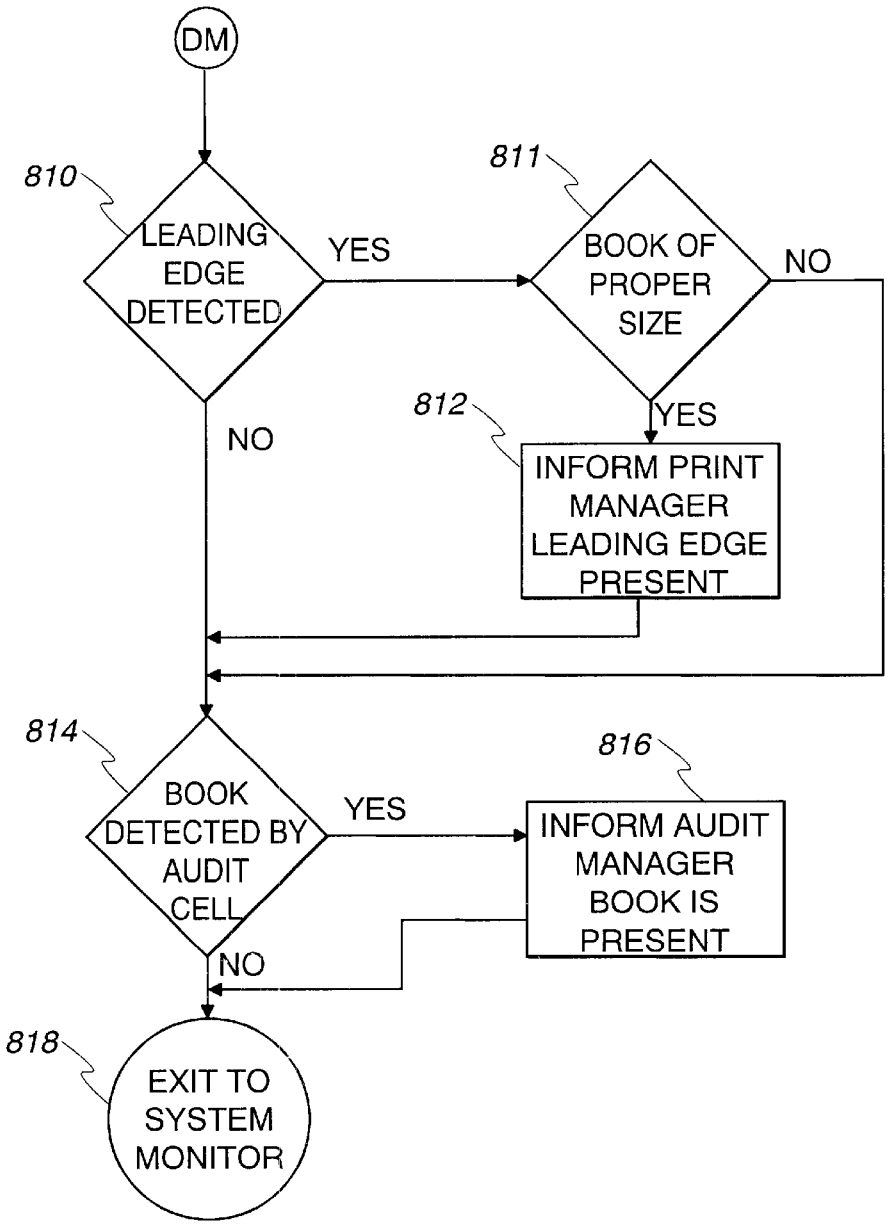

The digital I/O manager task as illustrated in FIGS. 44A–B monitors the status of the caliper 614 the lug detector 643, the leading edge detector 672, and the audit cell 624. The digital I/O manager starts at block 800 and reads the digital I/O status of the system devices at 802. A check is made at decision block 804 of whether an interrupt was received from the lug detector 643 indicating a lug 642 was detected passing the lug detector 643. If no lug is detected by the lug detector 643, at 610, as illustrated in FIG. 44B, a check is made on whether the leading edge 632 of a book of signatures 629 has been detected by the leading edge detector 672 at the print station 616. If a leading edge 632 is detected, at 811 a check is made to see if the caliper 614 indicated the book of signatures 629 had a proper number of pages 631, 633 the print manager is not informed that a leading edge is present and thus the book signatures 629 is not printed.

The I/O manager task is able to determine whether a book of signatures 629 has a proper number of pages 631, 633 due to the caliper 614 which notifies the computerized control system whether each book of signatures 629 has a proper number of pages 631, 633. As each book of signatures 629 passes the caliper 614, the caliper 614 via an interrupt informs the computerized control system if the book of signatures 629 has an improper number of book pages 631, 633. When the computerized control system is informed of a book of signatures 620 having an improper number of pages 631, 633, a location may be reserved in an area of memory 902 referred to as a size queue 906. Each location in the size queue 906 includes a position field 908 as illustrated in FIG. 34. The position field 908 for each area of the size queue 906 reserved is incremented by one each time a lug 642 is detected by the lug detector 643. Thus the computerized control system monitors how far along the conveyor chain 612 each book of signatures 629 having an improper number of pages 631, 633, has advanced beyond the caliper 614. As noted earlier, one of the parameter entries made by the operator at system start-up is the number of lugs 642 between the caliper 614 and the leading edge detector 672.

Thus, for example, if the operator says there were five lugs 642 between the caliper 614 and the leading edge detector 672, when the position field 908 for a book of signatures 629 is incremented to a value of 5, the computerized control system knows that the book of signatures 629 having an improper number of pages 631, 633, is now at the leading edge-detector 672. The computerized control system can then inhibit printing station 616. The memory 902 location for that particular book of signatures 629 is then removed from the size queue 906 as it is no longer required.

Regardless of whether a leading edge 632 is present, a check is made at 814 in FIG. 44B to see whether a book of signatures 629 has been detected by the audit cell 624. If a book of signatures 629 is detected as being present at 816, the audit manager is informed that a book of signatures 629 is present. At 818 an exit to the system monitor is performed whether or not a book of signatures 629 has been detected.

If back at decision 804 a lug 642 was detected, the position fields 903 and 908 in the master queue and size queue are updated at 824. A check is then made at 826 to see whether a leading edge 632 of a book of signatures 629 has been detected since the last lug 642 detection. If not, at 828 a no book condition at the print station 616 is indicated to the print manager. Regardless of the results of the check made above, a check is then made at 830 to determine whether or not a book of signatures 629 has been detected by the audit cell 624 since the last lug 642 detection. If not, missing book of signatures 629 condition is indicated to the audit manager at 832 and at 833 an exit to the system monitor is performed. If a book of signatures 629 has been detected at 833, an exit to the system monitor at 833 is performed.

Figure 45:
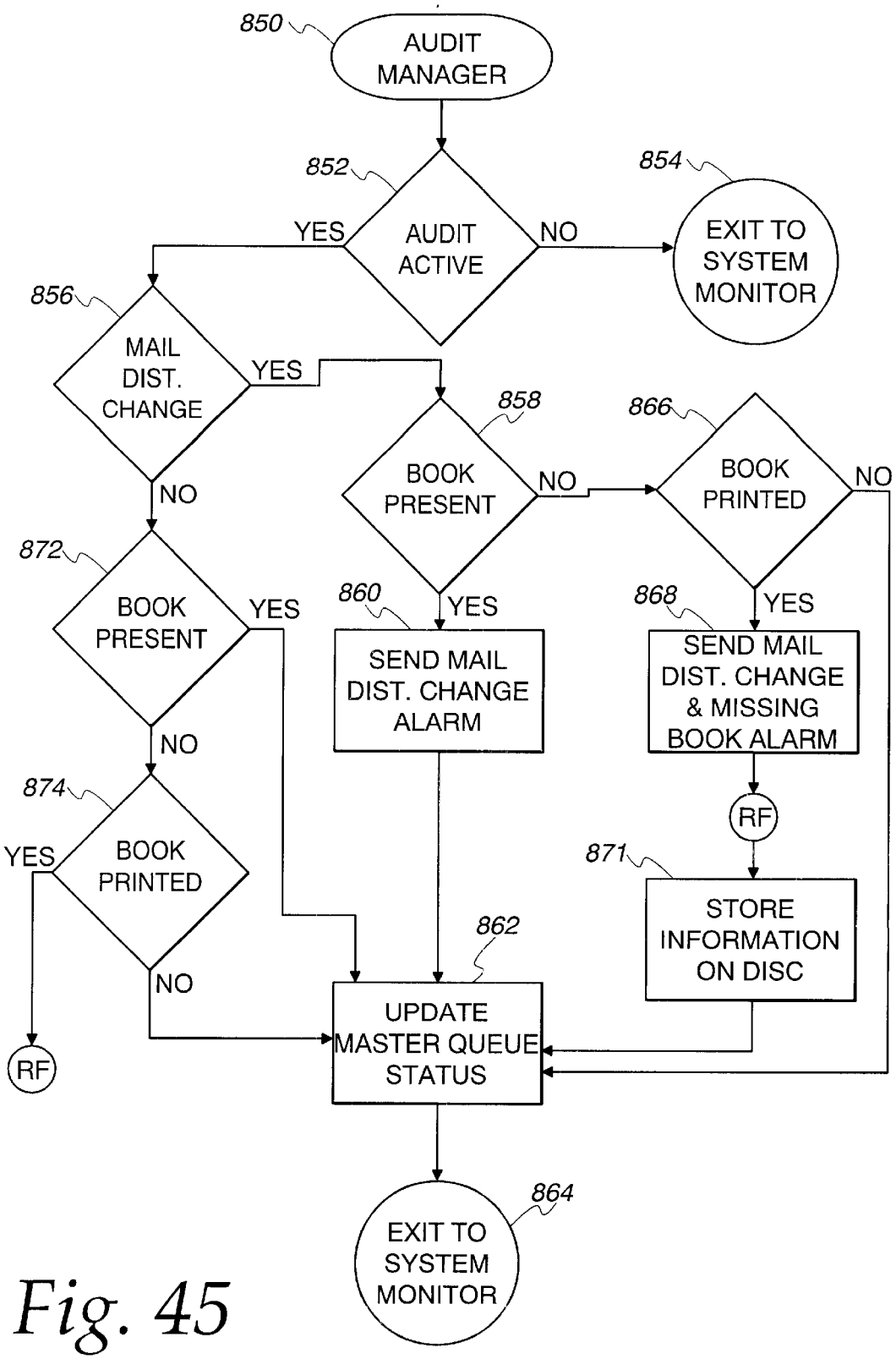
FIG. 45 is a logic flow diagram for the audit manager program task.

The audit manager task as illustrated in FIG. 45 starting at block 850, determines the action to be taken when a book of signatures 629 is present or absent at the audit cell 624 just prior to stacking for mailing. At block 852 a check is made to determine whether or not the audit cell is active. The operator indicates when the computer program is first started via parameter entry whether the audit cell 624 is to be utilized. If not, at 854 an exit to the system monitor is performed. At 856 a check is made for a mail distribution change. If a change in mail distribution is detected, at 858 a check is made for the presence of a book of signatures 629. If the book of signatures 629 is present, at 860 an alarm is sent to the alarm panel 692 indicating a mail distribution change and the presence of a book of signatures 629 so marked. At 862 the master queue 900 status is updated by removing the information for the book signatures 629 from the master queue 900 and at 864 an exit to the system monitor is performed. If there was a mail distribution change and there is no book of signatures 629 present, at decision block 866 a check is made for whether a book of signatures 629 has been printed for that location. If not, steps 862 and 864 are performed. If a book of signatures 629 has been printed, at 868 an alarm is sent to the alarm panel 692 to indicate a mail distribution change condition with the signature book 629 marked with the mail distribution change mark missing. At 871 the information for the missing book of signatures 629 is stored on the disc 684. Steps 862 and 864 are then performed. If at 856 there was no mail distribution change, a check is made at 872 for whether a book of signatures 629 is present. If no book of signatures 629 is present, at 874 a check is made as to whether a book of signatures 629 had been printed for the location. If a book of signatures 629 been printed but is now missing, steps 871, 862 and 864 are next performed so another book of signatures 629 can be reprinted. If a book of signatures 629 was not detected as being present and no book of signatures 629 had been printed for that location, steps 862 and 864 are performed. If a book of signatures 629 was detected as being present but there was no mail distribution change steps 862 and 864 are performed.

While various schematic diagrams of the computer program have been illustrated and described, it is to be understood that these have been utilized merely as a means to describe the possible logic function of a preferred embodiment of the present invention. Obviously, the logic functions can vary depending on how implemented and the nature of the computerized control system being used.

In operation, after the operator has initialized and started the system, the feeders 610 feed the signatures 630 onto the moving conveyor chain 612 so as to progressively build up the books or collections of signatures 629. Downstream from the feeders 610, the thickness of the books of signatures 629 are measured by the caliper 614. The caliper 614 detects variations in thickness which indicate a book of signatures 629 has an improper number of books pages 631, 633 or signatures 630. The caliper 614 notifies the diverter 620 and computerized control system of those books of signatures 629 which are determined to be faulty. When the faulty books of signatures 629 reaches the diverter 620, they will be diverted to the rejector or rejection. The computerized control system upon receiving notice of a faulty book of signatures 629 will inhibit printing of subscriber information on that book of signatures 629 at printing station 616.

After being measured by the caliper 614, the books of signatures 629 are conveyed downstream to the printing station 616. A leading edge detector 672 detects the approach of the books of signatures 629 and notifies the computerized control system of such. The computerized control system utilizes this information along with information from the shaft encoder 674 which monitors conveyor chain 612 movement to determine the proper indexing and spacing of characters to be printed. If the book of signatures 629 detected by the leading edge detector 672 was previously determined to have an improper number of book pages 631, 633 the computerized control system will initiate printing on the next book of signatures 629 in sequence found to have a proper number of book pages 631, 633.

Note that the computerized control system does not require a complex program architecture for indexing and collation of mailing label information printed on the cover page 633 of a book of signatures 629 and information printed on the inside page 631 of a book of signatures 629. In the present system, since both types of information are printed near simultaneously, a simplified indexing scheme can be used.

After being printed, bindings of the books of signatures 629 are stitched. Books of signatures 629 which were determined to be faulty by the caliper 614 are then directed to the rejector 621 by the diverter 620. Those books of signatures 629 found to contain a proper number of book pages 631, 633 are next trimmed by the trimmer 622.

After the stitching and trimming is completed an audit cell 624 senses or detects the presence or absence of the books of signatures 629 on the conveyor chain 612 prior to stacking for mailing. The audit cell 624 informs the computerized system of the books of signatures 629 found to be missing. The computerized control system then determines the information which was printed on the missing books of signatures 629 and stores that information on disc 686. The audit cell 624 thus assures that all of the books of signatures 629, for whatever reason missing, are reprinted and delivered to their intended subscribers.

The computerized control system monitors the status of the signature printing process and generates alerts when the signature printing system is approaching an end of a book of signatures 629 run and is at the end of a run. In addition, while printing subscriber information on the books of signatures 629 at the printing station 616, the computerized control system causes a mail distribution change mark to be printed on the book of signatures 629 where the mail distribution change occurs. In addition, the computerized control system generates an alert if there is a mail distribution change and the audit cell 624 has detected the presence of a book of signatures 629 containing the mail distribution change mark or generates a different alert if there is a mail distribution change but the audit cell 624 has detected that the book of signatures 629 so marked with the mail distribution change mark is missing. These alerts or alarms will appear at the alarm panel 692 in the form of various indicator lights or audible alarms.

The present invention thus discloses a signature printing system capable of near simultaneous printing on two or more pages 631, 633, such as a cover page 633 and an inside page 631 of a book of signatures 629. Because of this and other features, the present invention assures that subscriber mailing label information will be properly coordinated with subscriber information printed on the inside of the books of signatures 629. In addition, because of the capability to print near simultaneously on the inside page 631 and cover 633, the present invention requires a much less complicated control architecture.

It is to be understood, however, that even though these numerous characteristics and advantages of the invention have set forth in the foregoing description, together with details of the structure and function of the invention, the disclosure is illustrative only, and changes may be made in detail, especially in matters of shape, size, and arrangement of parts, within the principle of the invention, to the full extent indicated by the broad general meaning of the terms in which the appended claims are expressed.

While there has been illustrated and described a particular embodiment of the present invention, it will be appreciated that numerous changes and modifications will occur to those skilled in the art and it is intended in the appended claims to cover all those changes which fall within the true spirit and scope of the present invention.

What is claimed is:

1. A method of making versions of the same book using customized data and for providing mailing information for each of the respective book versions, the method comprising:

providing recorded data for all of the versions of the book and the customer's mailing information for each book;

sorting the recorded data into ranked order by the number of common insert signatures to define respective versions of the book, each version having the same signatures therein;

providing at least one non-customized bindery line with signature feeders for feeding signatures at least one of the higher rank order for a book versions;

providing a customized bindery line with signature feeders for feeding selectively signatures of lower order rank for different orders and different versions of the the book;

collating and forming for the higher rank customer a higher ranked book version on the non-customized bindery line and providing carrier route information for each of the customer books;

collating and forming for lower rank customers, lower ranked book versions on the non-customized bindery line and providing carrier route information for each customer book; and sorting the book versions based on the mailing information into respective bundles for a postal service.

2. A method in accordance with claim 1 comprising:

providing a computer system for determining the rank;

operating the computer to sort the recorded data and assigning a rank to each customer's order; and operating the computer to divert each high rank order to one of several non-customized bindery lines each of which is associated with one of the high ranks.

3. A method in accordance with claim 1 comprising:

transferring mailing address information for each customer order to the bindery line being used to make the customer's version of the book; and printing the customized mailing address information and providing it on the customer's version of the book.

4. A method in accordance with claim 3 comprising:

operating the same signature feeders of the non-customized bindery line for each customer order of its associated rank order and collating identical versions of the book using all of the signature feeders for said non-customized bindery line.

5. A method in accordance with claim 4 comprising:

providing a customized bindery line having signature feeders some of which are used for making a first version of the book and other signature feeders that are used only for making another version of the book; and collating different versions of the book according to the rank order for each version.

6. A method in accordance with claim 1 wherein the sorting of the recorded data into ranked order by the number of common inserts comprises:

sorting the recorded data into rank order to provide several of the highest orders with the most common inserts;

forming non-customized bindery lines using the number of signature feeders needed to feed the signatures required for an associated high rank order; and forming at least one customized line having selectively operated signature feeders with the signature feeders being selectively operated to feed a signature to collate each of several lower order rank versions of the book.

7. A method in accordance with claim 6 comprising:

collating the signatures on the non-customized bindery line over a shorter conveyor run than a longer conveyor run for customized bindey line.

8. A method in accordance with claim 1 comprising:

determining whether certain digits of a mailing address of a book version about to be assembled match the same digits of a mailing address of version of the books then being collated; and combining matched certain digit mail address book versions into bundles.

9. A method in accordance with claim 8 comprising:

determining bundle sizes based on existing postal rates for such bundle sizes of books having certain matched postal address digits; and entering such determine bundle size information into the computer for use in forming such sized bundles of books to the post office.

10. A method in accordance with claim 1 comprising:

printing a mail distribution change indicator mark on a cover page of each book version unless a change of digits for the mailing address is detected.

11. A collating and bindery system comprising:

a computer control system for operating a plurality of binder lines;

a storage media in the computer control system having stored information data for each customer as to the insert signatures to be in a book version for each customer and for applying each customer's mailing address to its book version;

a plurality of non-customized bindery lines for collating a version of the book having the same insert signatures and having a collating conveyor carrying the signatures over a collating conveyor run of a predetermined length;

at least one customized bindery line for collating each of several versions of the book with each of the several versions formed by selecting and collating some different signatures fed from some of the signature feeders but not fed from others of the signature feeders and causing the selected signatures to travel over a longer conveyor run than the predetermined length of conveyor run for the non-customized bindery line;

the computer control system forming ranked orders for each customer data based on the number of common insert signatures for that customer's book with each rank order defining a respective version of the book with the same insert signatures therein;

the computer control system sending the highest rank order customer data to an associated non-customized bindery line for feeding and collating signatures for that rank order into a first version of the book and for providing mailing address information on the first version of the each customer book being assembled; and the computer control system sending lower rank orders for customers to the customized bindery line and selecting only those signature feeders needed for these respective book versions and providing mailing addresses on each customer book versions being assembled on the customized bindery line.

12. An apparatus in accordance with claim 11 comprising:

a transfer apparatus for transferring coded data for each customer's mailing information to a printing station; and a printer at the printing station for printing the mailing information for the respective customer order being collated.

13. An apparatus in accordance with claim 11 comprising:

a printer for printing a mail distribution change indicator mark on a version of a book.

14. An apparatus in accordance with claim 11 comprising:

a printer apparatus for printing personalized information in the customer's version of the book and providing coordinated mailing information for that customer on its version of the book.

* * * * *

UNITED STATES PATENT AND TRADEMARK OFFICE

CERTIFICATE OF CORRECTION

PATENT NO. : 6,445,975 B1
DATED : September 3, 2002
INVENTOR(S) : Thomas E. Ramsey It is certified that error appears in the above-identified patent and that said Letters Patent is hereby corrected as shown below:

Title page,
Item [73], Assignee, change "Donnelly" to -- Donnelley --.

Column 34,
Line 18, change "bindey" to -- bindery --.
Line 30, change "determine" to -- determined --.
Line 40, change "binder" to -- bindery --.

Signed and Sealed this

Eleventh Day of March, 2003

JAMES E. ROGAN
*Director of the United States Patent and Trademark Office*